US006425983B1

(12) United States Patent
Marinack et al.

(10) Patent No.: US 6,425,983 B1
(45) **Date of Patent: *Jul. 30, 2002**

(54) CREPING BLADE, CREPED PAPER, AND METHOD OF MANUFACTURING PAPER

(75) Inventors: Robert J. Marinack, Oshkosh; Anthony O. Awofeso, Appleton; Frank D. Harper; Thomas N. Kershaw, both of Neenah, all of WI (US)

(73) Assignee: Fort James Corporation, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/540,267

(22) Filed: Mar. 31, 2000

Related U.S. Application Data

(63) Continuation-in-part of application No. 09/500,523, filed on Feb. 9, 2000, which is a continuation of application No. 08/816,606, filed on Mar. 13, 1997, now Pat. No. 6,096,168, which is a division of application No. 08/359,318, filed on Dec. 16, 1994, now Pat. No. 5,690,788, which is a continuation-in-part of application No. 08/320,711, filed on Oct. 11, 1994, now Pat. No. 5,685,954.

(51) Int. Cl.[7] ..... B31F 1/12; D21H 27/00

(52) U.S. Cl. ..... 162/281

(58) Field of Search ..... 162/111, 112, 162/113, 280, 281

(56) References Cited

U.S. PATENT DOCUMENTS

| | | | |
|---|---|---|---|
| 1,548,783 | A | 8/1925 | Lorenz |
| 1,571,593 | A | 2/1926 | Lorenz |
| 1,582,842 | A | 4/1926 | Lorenz |
| 1,588,732 | A | 6/1926 | Hoberg |
| 1,653,434 | A | 12/1927 | Lorenz |
| 1,702,166 | A | 2/1929 | Lorenz |
| 2,494,723 | A | 1/1950 | Rowe |
| 2,874,618 | A | 2/1959 | Yang |
| 2,995,180 | A | 8/1961 | Klenk |
| 3,044,228 | A | 7/1962 | Peterson |
| 3,163,575 | A | 12/1964 | Nobbe |
| 3,300,368 | A | 1/1967 | Cooper et al. |
| 3,301,746 | A | 1/1967 | Sanford et al. |
| 3,507,745 | A | 4/1970 | Fuerst |
| 4,185,399 | A | 1/1980 | Gladish |
| 4,304,625 | A | 12/1981 | Grube et al. |
| 4,396,502 | A | 8/1983 | Justus |
| 4,488,932 | A | 12/1984 | Eber et al. |
| 5,164,045 | A | 11/1992 | Awofeso et al. |
| 5,383,778 | A | 1/1995 | Schulz |
| 5,409,572 | A | 4/1995 | Kershaw et al. |
| 5,656,134 | A | 8/1997 | Marinack et al. |
| 5,685,954 | A | 11/1997 | Marinack et al. |
| 5,690,788 | A | 11/1997 | Marinack et al. |
| 5,885,415 | A | 3/1999 | Marinack et al. |
| 5,885,416 | A | 3/1999 | Marinack et al. |
| 5,885,417 | A | 3/1999 | Marinack et al. |
| 5,908,533 | A | 6/1999 | Marinack et al. |
| 6,027,614 | A | 2/2000 | Parker et al. |
| 6,066,234 | A | 5/2000 | Parker et al. |

FOREIGN PATENT DOCUMENTS

| | | |
|---|---|---|
| AT | 332 894 | 10/1976 |
| FR | 2361222 | 3/1978 |
| FR | 2 431 568 | 2/1980 |
| GB | 389832 | 3/1933 |
| GB | 456032 | 11/1936 |
| GB | 827735 | 2/1960 |
| IT | 615517 | 1/1961 |

*Primary Examiner*—Peter Chin
(74) *Attorney, Agent, or Firm*—Finnegan, Henderson, Farabow, Garrett & Dunner, L.L.P.

(57) ABSTRACT

A creping blade for creping a cellulosic web from a rotatable cylinder in a creping process includes first and second side faces. The first side face is at least substantially opposite to the second side file. The blade also includes an upper surface adjacent to the first and second side faces. A plurality of notches is provided along the upper surface. Each of the notches has a bottom portion and an open end defined by at least a portion of the upper surface. The notches are configured to increase the caliper of the cellulosic web when the creping blade crepes the cellulosic web from an outer surface of the rotatable cylinder. Creped paper and improved methods of manufacturing paper are also provided.

13 Claims, 62 Drawing Sheets

UNALTERED CONVENTIONAL CREPING BLADE

UNDULATORY CREPING BLADE

CREPING BLADE ACCORDING TO FUERST, US PATENT 3,507,745

UNDULATORY CREPING BLADE SHOWING BLADE PORTION THAT CONTACTS YANKEE DRYER

UNDULATORY CREPING BLADE, VARIOUS VIEWS

COMPARISON OF CREPING ANGLES; UNDULATORY CREPING BLADE AND FUERST, US PATENT 3,507,745

ALTERNATIVE UNDULATORY CREPING BLADES, VARIOUS VIEWS

ALTERNATIVE UNDULATORY CREPING BLADE; VARIOUS VIEWS

DRY CREPE PROCESS

WET CREPE PROCESS

TISSUE MADE USING 0 DEGREE BLADE

TISSUE MADE USING 15 DEGREE BLADE

TISSUE MADE USING 25 DEGREE BLADE

TISSUE MADE USING 0 DEGREE BLADE

TISSUE MADE USING 15 DEGREE BLADE

TISSUE MADE USING 25 DEGREE BLADE

CREPE BLADE HAS 25 DEGREE BEVEL; 12 UNDULATIONS/INCH
TISSUE IS EMBOSSED WITH SPOT PATTERN AT 0.075 INCHES

CREPE BLADE HAS 15 DEGREE BEVEL; 0.010" UNDULATION DEPTH
TISSUE IS EMBOSSED WITH SPOT PATTERN AT 0.075 INCHES

ALL SHEETS EMBOSSED WITH SPOT EMBOSS PATTERN
UNDULATORY BLADES HAVE 20 UNDULATIONS/INCH
AND A 0.020" UNDULATION DEPTH
OPEN SYMBOLS ARE BASE SHEET VALUES

VALUES NORMALIZED TO 18 LBS/REAM
UNDULATORY BLADES HAVE A 15 DEGREE BLADE BEVEL,
20 UNDULATIONS/INCH, AND A 0.020" UNDULATION DEPTH

KNURLED BLADE HAS 25 DEG. BEVEL, 12 KNURLS/INCH

VALUES NORMALIZED TO 16 LBS/REAM
UNDULATORY BLADE HAS 25 DEGREE BEVEL, 12 UNDULATIONS/INCH

VALUES NORMALIZED TO 16 LBS/REAM
UNDULATORY BLADE HAS 25 DEGREE BEVEL, 12 UNDULATIONS/INCH

CONTROL SHEET VALUES NORMALIZED TO 16 LBS/REAM
UNDULATORY BLADE VALUES NORMALIZED TO 14 LBS/REAM

CONTROL SHEET VALUES NORMALIZED TO 16 LBS/REAM
UNDULATORY BLADE VALUES NORMALIZED TO 14 LBS/REAM

UNDULATORY BLADE HAS 50 DEGREE BEVEL,
16 UNDULATIONS/INCH, 0.030" UNDULATION DEPTH
PRODUCTS EMBOSSED AT 0.080" DEPTH

UNDULATORY BLADE HAS 50 DEGREE BEVEL,
16 UNDULATIONS/INCH, 0.030" UNDULATION DEPTH
PRODUCTS EMBOSSED AT 0.080" DEPTH

UNDULATORY BLADE HAS 50 DEGREE BEVEL,
16 UNDULATIONS/INCH, 0.030" UNDULATION DEPTH
PRODUCTS EMBOSSED AT 0.080" DEPTH

UNDULATORY BLADE MANUFACTURING PROCESS

UNDULATORY BLADE DRESSING

CREPING BLADE, CREPED PAPER, AND METHOD OF MANUFACTURING PAPER

This application is a continuation-in-part (CIP) of U.S. patent application Ser. No. 09/500,523, filed on Feb. 9, 2000, which is a continuation of application Ser. No. 08/816,606, filed on Mar. 13, 1997 now U.S. Pat. No. 6,096,168, which is a division of application Ser. No. 08/359,318, filed Dec. 16, 1994 (now U.S. Pat. No. 5,690,788), which is a continuation-in-part of application Ser. No. 08/320,711, filed Oct. 11, 1994 (now U.S. Pat. No. 5,685,954).

BACKGROUND OF THE INVENTION

1. Field of the Invention

The present invention relates to creped paper. More-particularly, the invention relates to creped paper having desirable bulk, appearance, and softness characteristics, such that the paper is capable of being used for at least one of tissues, towels, and napkins. The invention also relates to a notched creping blade for use in a creped paper manufacturing process and a system including such a blade. The invention further relates to improved methods of manufacturing paper.

2. Description of Related Art

Paper is generally manufactured by dispersing cellulosic fiber in an aqueous medium and then removing most of the liquid. In particular, cellulosic fibers suspended in water are deposited on a moving foraminous support to form a nascent web. Water is removed from the nascent web, and the de-watered web is adhered to a heated cylindrical dryer (e.g., Yankee dryer). The web is then removed from the dryer.

Paper derives some of its strength from the mechanical interlocking of the cellulosic fibers in the web, but most of the strength is derived from hydrogen bonds that link the cellulosic fibers to one another. With paper intended for use as bathroom tissue, the degree of strength imparted by this inter-fiber bonding, while necessary to the utility of the product, can result in a lack of perceived softness by consumers. One common method of increasing the perceived softness and cushion of bathroom tissue is to crepe the paper.

Creping is a process that typically includes fixing the cellulosic web to a cylindrical dryer (e.g., with an adhesive and release agent), and then scraping the web off of the dryer with a creping blade. Creping the paper advantageously breaks inter-fiber bonds, thereby increasing the perceived softness of the paper. However, creping with a conventional blade may not be sufficient to impart desired combinations of softness, bulk (i.e., thickness or caliper), and appearance to the paper. Therefore, creped paper for use as bathroom tissue generally requires additional processing after creping, particularly when produced using conventional wet pressing technology.

Paper produced using through air drying techniques normally have sufficient caliper, but may have an unattractive appearance. To overcome this shortcoming, an overall pattern can be imparted to the web during the forming and drying process by use of a patterned fabric having proprietary designs to enhance appearance. However, such patterned fabrics are not available to all producers. Moreover, through air dried tissues can be deficient in surface smoothness and softness, unless they are further processed using techniques such as calendering, embossing, and/or stratification of low coarseness fibers on the tissue's outer layers.

Conventional tissues produced by wet pressing also generally require post-creping processes to impart softness and bulk. For example wet-pressed tissues are often calendered and/or embossed to bring softness and bulk parameters into acceptable ranges for premium quality products. Calendering, however, adversely affects caliper (i.e., thickness) and may raise the tensile modulus of the paper, which is inversely related to tissue softness. Embossing increases product caliper and can reduce the tensile modulus, but lowers strength and can decrease the surface softness of the paper. Accordingly, it can be appreciated that various combinations of calendering and/or embossing can have adverse effects on strength, appearance, surface smoothness, and thickness perception of the paper. In particular, there is a fundamental conflict between the use of calendering and the desire to increase the caliper of paper.

Conventional processes for creping paper using patterned or non-uniform creping blades are known. These processes, however, are suited for production of wadding, insulating papers, and other extremely coarse papers, but are not acceptable for production of premium quality bath tissue, facial tissue, and/or kitchen toweling.

Three references of interest are U.S. Pat. No. 3,507,745 to Fuerst, U.S. Pat. No. 3,163,575 to Nobbe, British Patent No. 456,032 to Pashley. Fuerst teaches the use of a highly beveled blade having square shouldered notches formed into the blade. The Fuerst blade is suitable for producing very high bulk for cushioning and insulation purposes, but is not generally suitable for premium quality towel and tissue products.

Nobbe discloses a doctor blade for differentially creping sheets from a drum to produce a product that is quite similar to the product described in the Fuerst patent. Nobbe teaches a flat blade having cut notches. The portions of the sheet that contact the notched portions of the blade will have a coarse crepe or no crepe, while the areas of the sheet that contact the unnotched blade portions will have a fine crepe.

The blade disclosed in Fuerst has a large bevel angle with portions of the creping edge being-flattened to produce a surface that results in fine crepe in the portions of the sheet that contact this surface. The portions of the sheet that contact the unmodified sections of the blade will have very coarse crepe, thus giving an appearance of having almost no crepe. Our experience suggests that neither the Nobbe nor the Fuerst blades are suitable for the manufacture of commercially acceptable premium quality tissue and towel products.

The Pashley reference teaches creping a sheet from a cylinder using a creping blade having an edge serrated in a sawtooth pattern. The teeth are disclosed as being about one-eighth (0.125) inch deep and having a frequency of about 8 per inch. The paper disclosed in Pashley is much coarser and more irregular than the crepe of a product made using conventional creping technology, and therefore not acceptable for use in premium tissue and towel products.

In light of the foregoing, there is a need in the art for an improved creped paper, creping blade, creping system, and method of producing paper.

SUMMARY OF THE INVENTION

Accordingly, the present invention is directed to creped paper, a creping blade, a creping system, and methods of producing paper that substantially obviate one or more of the limitations of the related art. To achieve these and other advantages and in accordance with the purpose of the invention, as embodied and broadly described herein, the invention includes creped paper capable of being used for at least one of tissues, towels, and napkins. The creped paper includes a cellulosic web including crepe bars and undulations. Preferably, the cellulosic web includes recycled material. The crepe bars extend in a direction transverse to a machine direction and preferably have a spatial frequency of about 5 to about 150 crepe bars per inch. The undulations include ridges, furrows, crests, and sulcations extending longitudinally in the machine direction. The ridges and furrows are interspersed on the air side of the web, and the crests and sulcations are interspersed on a Yankee side of the web. The ridges preferably have a spatial frequency of about 5 to about 50 ridges per inch. A basis weight of the web is preferably about 7 to about 40 pounds per 3,000 square foot ream of the web. The undulations and crepe bars intersect to form a reticulum. The creped paper is preferably at least one of one-ply, multi-ply, embossed, calendered, wet-pressed, and through air dried.

In another aspect, the invention includes a creping blade for creping a cellulosic web from a rotatable cylinder in a creping process. The creping blade includes first and second side faces. The first side face is at least substantially opposite to the second side file. The blade also includes an upper surface adjacent to the first and second side faces. Preferably, the upper surface is not perpendicular to at least one of the first and second side faces. A plurality of notches are provided along the upper surface. Each of the notches has a bottom portion and an open end defined by at least a portion of the upper surface. The notches are configured to increase the caliper of the cellulosic web when the creping blade crepes the cellulosic web from an outer surface of the rotatable cylinder. In one embodiment, the notches are serrulate shaped; however, the notches could include a number of different shapes. The blade further includes an engagement surface adjacent to the upper surface and one of the first and second side faces. The engagement surface is dressed such that an angle between the engagement surface and the adjacent side face is approximately equal to a wear angle of the creping blade when the creping blade is positioned on an outer surface of the rotatable cylinder. A perpendicular distance between a lower portion of the engagement surface and an upper edge of the upper surface is at least as large as a perpendicular distance between the bottom portion of each of the notches and the upper edge. The engagement surface forms a substantially continuous line of contact with the outer surface of the rotatable cylinder when the creping blade is positioned on the outer surface, thereby obviating the need for substantial running in of the creping blade.

In a preferred embodiment, the perpendicular distance between the lower portion of the engagement surface and the upper edge of the upper surface is larger than the perpendicular distance between the bottom portion of each of the notches and the upper edge.

In a further aspect, the blade includes a plurality of protrusions that are adjacent to the notches and extend from the adjacent side face. Each of the protrusions preferably includes an engagement portion defining at least a part of the engagement surface. Preferably, the engagement portion of each protrusion extends from an edge of the bottom portion of a respective notch so that the edge intersects the adjacent side face. The plurality of protrusions are preferably spaced apart from one another. Preferably, the notches and protrusions are formed by displacing material from the creping blade.

In yet another aspect, the blade further includes rectilinear regions between the protrusions. The rectilinear regions are preferably formed when the engagement surface is dressed. Preferably, outer faces of the rectilinear regions form a portion of the engagement surface.

Preferably, the upper surface is beveled at an angle ranging from approximately 0° to approximately 50° with respect to a plane perpendicular to the adjacent side face. The frequency of the notches preferably ranges from approximately 5 per inch to approximately 50 per inch.

In still another aspect, the invention includes a system for creping a cellulosic web. The system includes a rotatable cylinder and at least one of the creping blades described above. The creping blade is positioned with respect to the cylinder so that the creping blade is capable of creping the cellulosic web from an outer surface of the cylinder when the web is on the outer surface and the cylinder is rotated.

In a further aspect, the invention includes a method of making paper, wherein a cellulosic web is creped from an outer surface of a rotatable cylinder with one of the creping blades described above. The cellulosic web preferably includes recycled material.

In yet another aspect, the invention includes a method of making paper, wherein cellulosic web is creped from an outer surface of a rotatable cylinder to produce one of the creped papers described above.

In another aspect, the invention includes a method of making paper, wherein one of the creping blades described above is placed in a mount adjacent to the rotatable cylinder.

Paper manufactured according to the present invention preferably is more capable of withstanding calendering without excessive degradation as compared to a conventional wet press tissue web. Accordingly, the paper making process is more forgiving and flexible than conventional processes. In particular, the present invention can be used to manufacture premium products including high softness tissues and towels having high strength and high bulk and absorbency, as well as paper having various combinations of bulk, strength and absorbency desirable for lower grade commercial products. For example, in commercial (i.e., away-from-home) toweling, it is generally considered important to have a relatively long length of toweling on a small diameter roll. In the past, this preferred feature has severely restricted the absorbency of commercial toweling products, because absorbency was adversely affected by the processing used to produce toweling having limited bulk (i.e., absorbency and bulk are directly proportional). Unlike conventional blades, the blade of the present invention preferably makes it possible to achieve high absorbency in a relatively non-bulky towel. Additionally, cellulosic web produced according to the present invention can be more heavily calendered than many conventional webs, while retaining bulk and absorbency. Thus the present invention preferably produces paper that is smoother and softer feeling, without unduly increasing the tensile modulus or unduly decreasing the caliper.

Paper made according to the present invention also saves on the cost of raw materials over conventional processes. In particular, the method of the present invention preferably can produce paper having a desirable degree of bulk at a low basis weight without an excessive sacrifice in strength, or it can preferably produce paper having a low percent crepe and a large caliper. Accordingly, it can be appreciated that the advantages of the present invention can be manipulated to produce novel products having many combinations of properties.

Furthermore, the method and creping blade of the present invention are at least comparable in runnability and forgivingness to conventional creping processes, and may be run on equipment adapted to use conventional creping blades. In particular, the creping blades of the present invention will fit into conventional holders and will operate at roughly equivalent holder angles. The life of the preferred blades is at least about the same as the life expected with conventional blades. At this time, preliminary results indicate that the life of preferred undulatory creping blades according to the present invention could possibly even be significantly greater than the life of a conventional blade, although to be able to claim this definitively would require a substantial amount of commercial operating data which are, of course, simply not available.

In contrast to conventional creped paper having creping bars generally running transversely, the tissue of the present invention has a biaxially undulatory surface, wherein the transversely extending crepe bars are intersected by longitudinally extending undulations imparted by the undulatory creping blade.

Besides the structural arrangements set forth above, the invention could include a number of other arrangements, such as those explained hereinafter. It is to be understood that both the foregoing description and the following description are exemplary, and are intended to provide further explanation of the invention as claimed.

BRIEF DESCRIPTION OF THE DRAWINGS

The accompanying drawings are included to provide a further understanding of the invention and are incorporated in and constitute a part of this specification. The drawings illustrate embodiments of the invention and, together with the description, serve to explain the principles of the invention. In the drawings.

FIGS. 3A, 3B & 3C are views of a creping blade similar to the creping blade disclosed in U.S. Pat. No. 3,507,745 to Fuerst after it has been run in;

DETAILED DESCRIPTION OF THE PREFERRED EMBODIMENTS

Figure 1A:
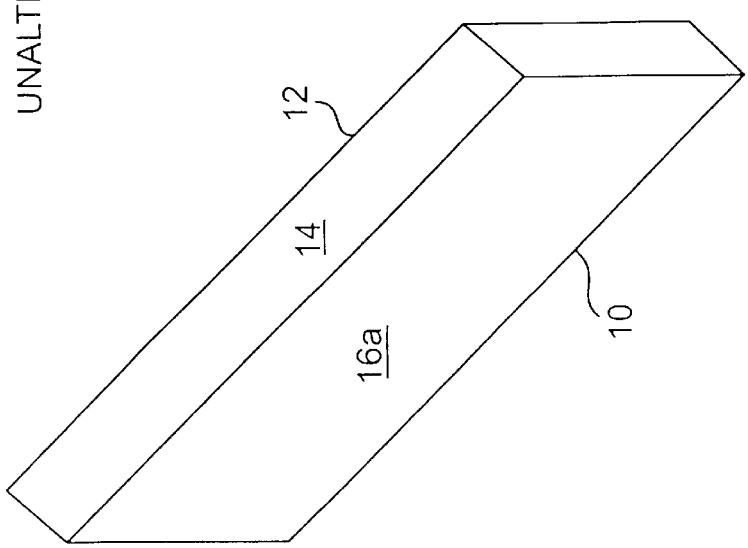
FIGS. 1A, 1B & 1C are views of a blank for making an undulatory creping blade.

Reference will now be made in detail to the present preferred embodiments of the invention, examples of which are illustrated in the accompanying drawings. Wherever possible, the same reference numbers are used in the drawings and the description to refer to the same or like parts, and the same reference numbers with alphabetical suffixes are used to refer to similar parts.

Figure 1C:
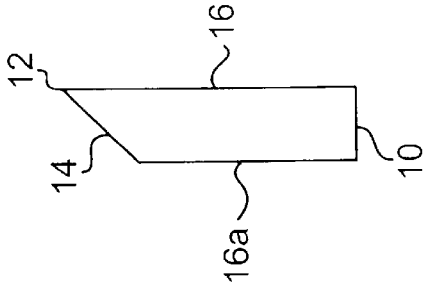
Figure 1B:
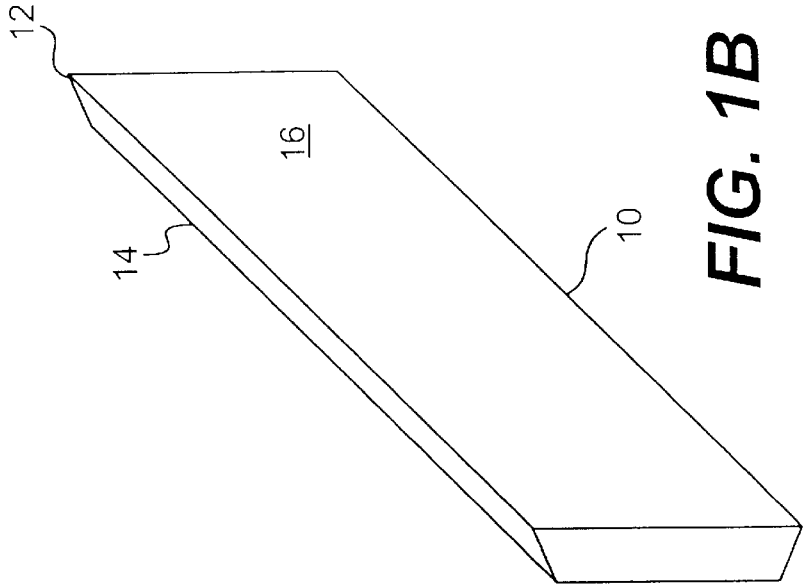

FIGS. 1A–1C show a portion of a blank 10 used to make the creping blade of the present invention. The blank 10 includes first and second side faces 16, 16*a* substantially opposite to one another. The blank 10 also includes an upper surface 14 and an edge 12. Preferably, the upper surface 14 is not perpendicular to at least one of the first and second side surfaces 16, 16*a*. More preferably, the upper surface 14 is beveled at an angle ranging from approximately 0° to approximately 50° with respect to a plane perpendicular to the at least one of the first and second side surfaces 16, 16*a*. Although the first and second side surfaces 16, 16*a* are shown in FIGS. 1A–1C as being substantially parallel to one another, one of ordinary skill in the art would recognize that such a configuration is not necessary to practice the invention.

Figure 2B:
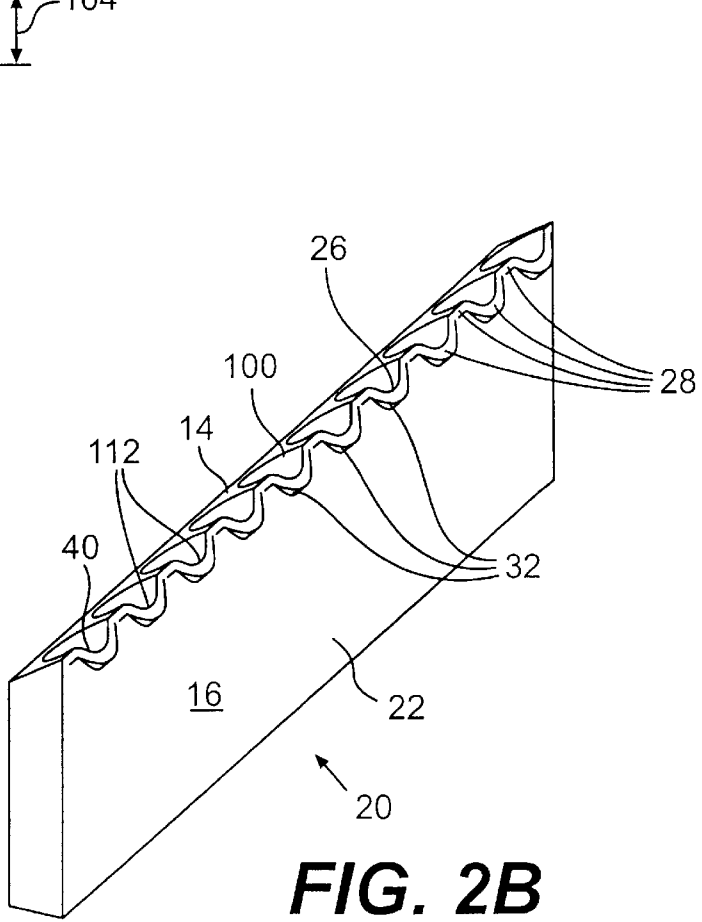
FIGS. 2A, 2B and 2C are views of an embodiment of a creping blade of the invention.
Figure 2C:
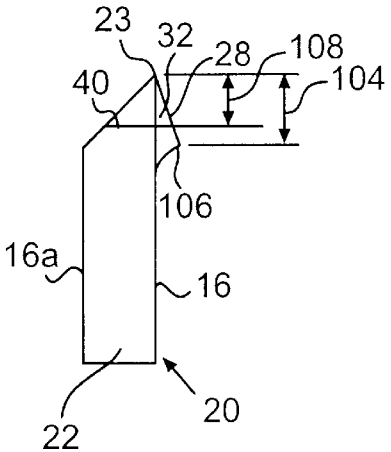
Figure 2A:
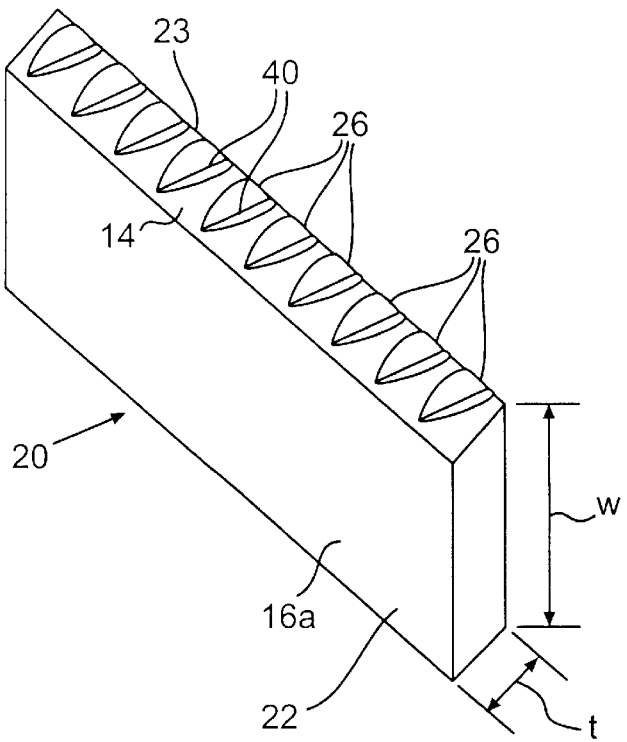
Figure 3B:
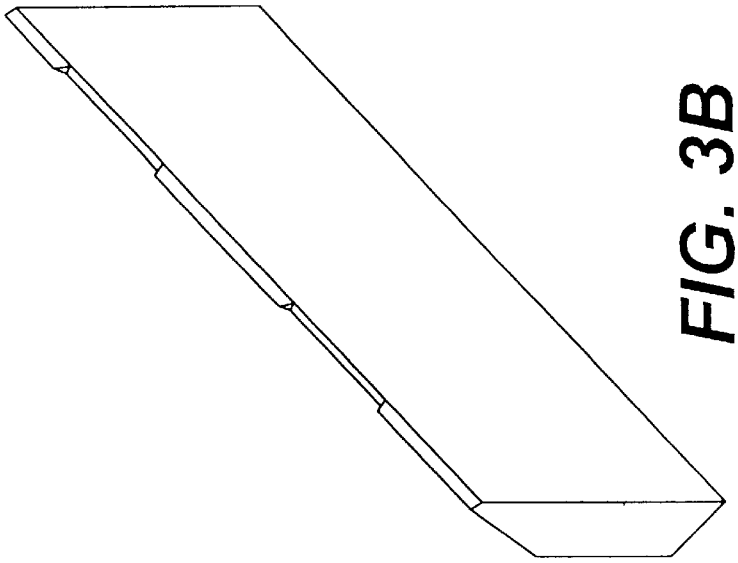
Figure 3C:
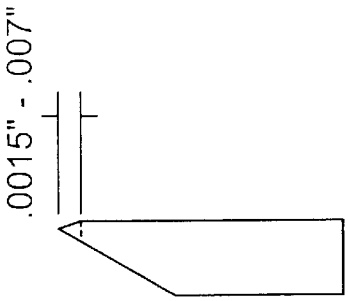
Figure 3A:
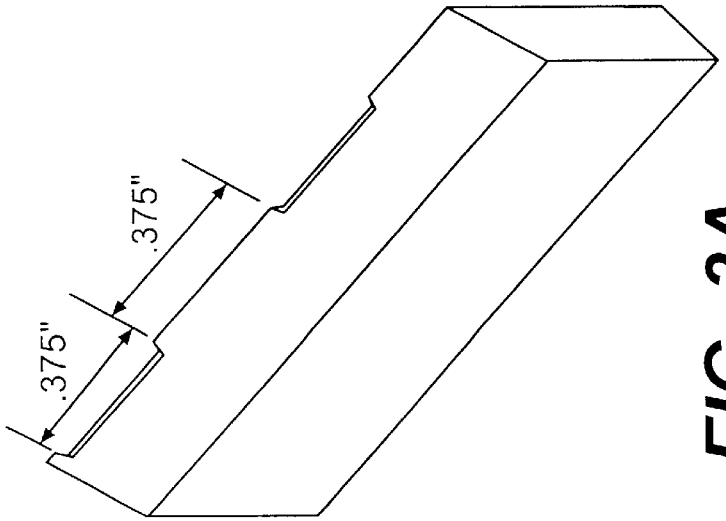

FIGS. 2A and 2B are perspective views of a portion of a preferred creping blade 20. The creping blade 20 preferably extends to a length corresponding to the width of the cylindrical "Yankee" dryers included in large, modern paper machines (i.e., typically from more than 100 inches to over 26 feet in length) In an alternate embodiment, however, the length of the blade 20 is several times the width of the Yankee dryer. For this embodiment, the blade 20 is preferably flexible and can be placed on a spool for use with machines employing a continuous creping system. The width "w" of the blade 20 is preferably on the order of several inches while the thickness "t" of the blade is preferably on the order of fractions of an inch. (See FIG. 2A.)

Referring to FIGS. 2A–2C, the blade 20 includes a plurality of notches 26 spaced along the upper surface 14. Each of the notches 26 has a bottom portion 40 and an open end 100 defined by at least a portion of the upper surface 14. Preferably, the frequency of the notches ranges from approximately 5 notches per inch to approximately 50 notches per inch along the length of the blade 20.

The preferred notch frequency range described herein are merely exemplary, and one of ordinary skill in the art would recognize that the invention could be practiced in certain regions outside of this range. Indeed, it may be preferable to use lower notch frequencies when producing heavier sheets. Heavy weight sheets are sometimes made with low-grade recycle furnish, which includes fibers that are more pliant than higher grade furnishes. The fibers of lower grade furnish are less porous and more fiber is thus required to achieve the desired absorbency for a given toweling grade. Due to the lower specific absorbency of sheets made with lower-grade furnishes, about 20% more furnish basis weight is required to deliver comparable absorbency based on weight absorbed per unit area of towel. The use of more furnish basis weight results in a thicker, stronger, heavier sheet that can take more abuse than the lighter toweling made with higher-grade furnishes. Because these tougher sheets will not necessarily conform (i.e. stretch) to creping blades having high notch frequencies, it is preferable to use blades having lower notch frequencies when making such sheets, particularly when using recycle furnish.

The use of lower notch frequencies is also preferred when using a large notch depth. Deeper notches advantageously increase bulk, soften the web, and open the structure of the web for increased absorbency and improved softness. As the depth of the notches is increased, however, the web is forced to undergo more stretching. To offset the increased stretching corresponding to the increased notch depth, it may be preferable to use a blade having a lower notch frequency.

Softeners facilitate movement of the fibers of the web relative to one other, which may make it possible to use a blade having both higher tooth counts and deeper notches. In particular, softener may facilitate the use of such a blade with furnish having relatively flexible fibers, such as Northern Soft wood Kraft. If the fibers are relatively stiff, however, as in Southern Softwood Kraft, the effect of adding softener may not be enough to facilitate the use of a blade having both high tooth counts and deep notches. Softeners are particularly effective when used with recycled fibers that have been reprocessed and worked a number of times, collapsing the lumens in the fibers. Indeed, the effect of softener increases with the drapability of the fiber at a constant fiber length.

The degree of adhesion of the web to the Yankee dryer also impacts the choice of blade notch frequency and depth. In particular, the degree of adhesion should be enough to force the sheet to conform to the blade. If there is not too much adhesion, the web may not be released from the Yankee, while if there is not enough adhesion, the web may not conform to the creping blade. The frequency and depth of the notches will impact the amount of adhesion required to conform the web to the blade.

We note that the term "undulations" is also use to herein to refer to the notches of the blade, as well as the configuration of the resulting creped paper. In addition, the creping blade of the present invention will be occasionally referred to as an "undulatory" or "undulating" blade.

Figure 7:
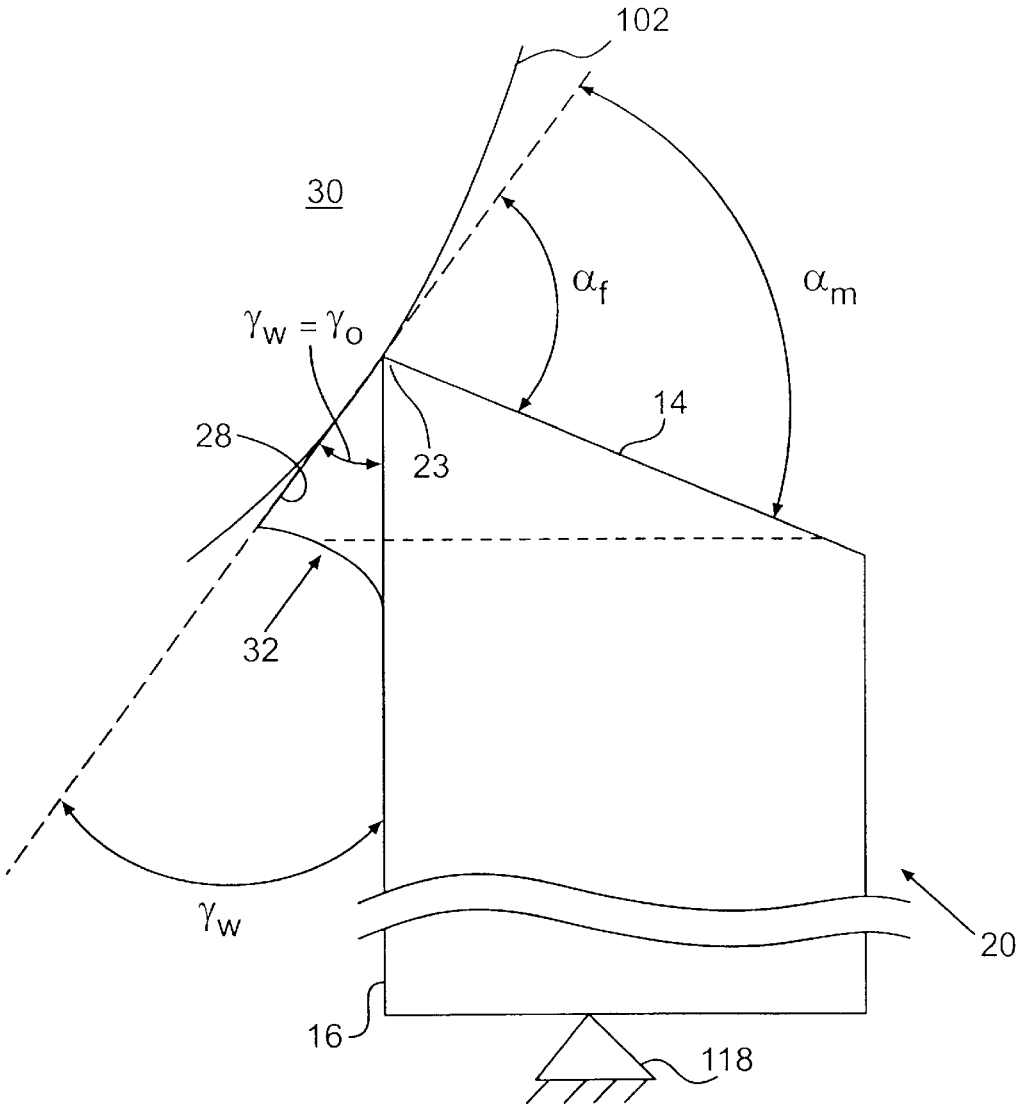
FIG. 7 is a view of the creping blade of the invention positioned with respect to a rotatable cylinder.
Figure 7A:
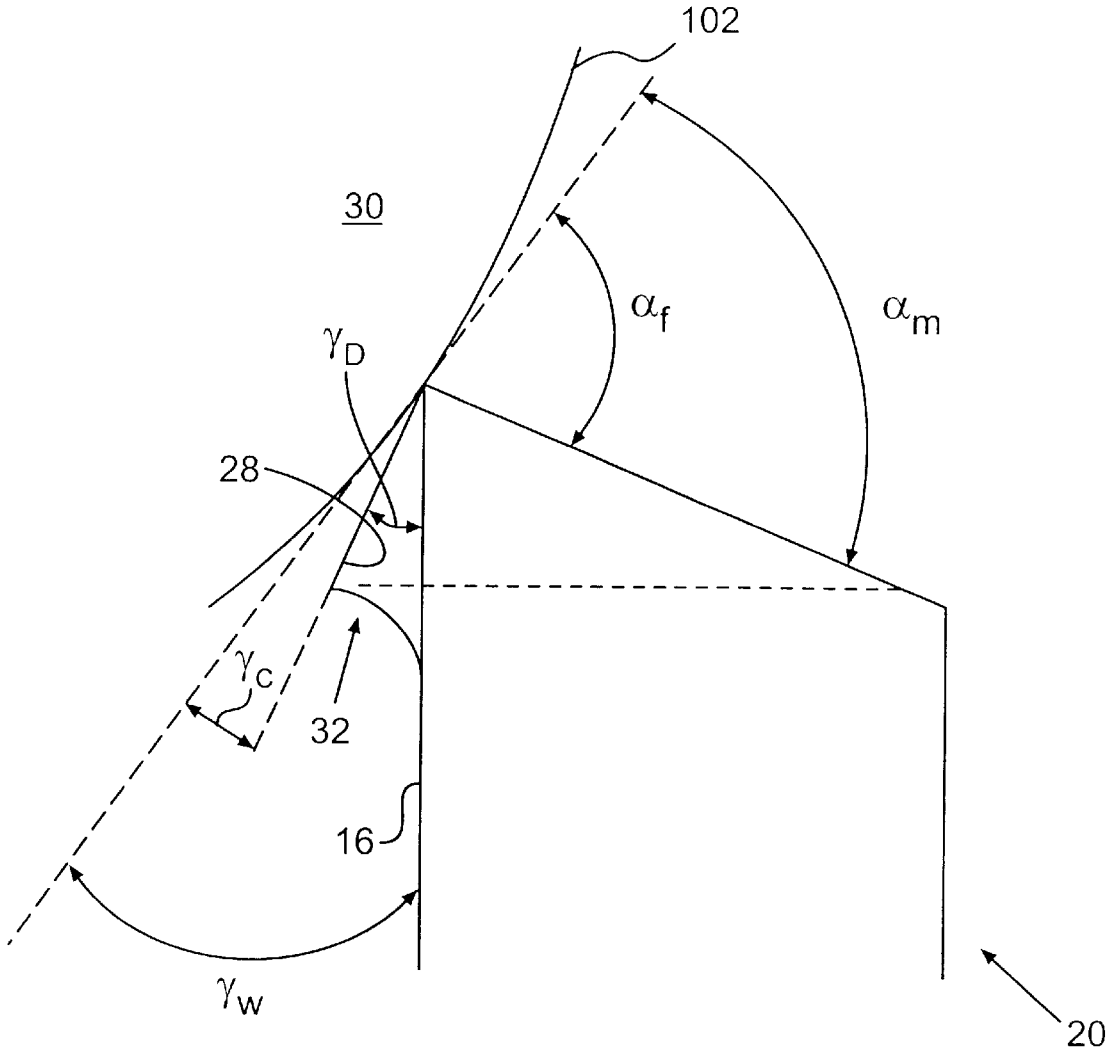
FIG. 7A is a view of an alternate embodiment of the creping blade of the invention positioned with respect to a rotatable cylinder.

The blade 20 also includes an engagement surface 28 adjacent to the upper surface 14 and the side face 16 (i.e., the adjacent side face). As shown in FIG. 7, the engagement surface 28 is preferably dressed (i.e., machined) such that an angle $\gamma_D$ between the engagement surface 28 and the adjacent side face 16 (i.e., the dressed angle) is approximately equal to a blade wear angle $\gamma_W$ of the creping blade 20 when the creping blade 20 is positioned on an outer surface 102 of a rotatable cylinder 30 (e.g., Yankee dryer). Although the wear angle $\gamma_w$ is preferably substantially equal to the dressed angle $\gamma_D$, the invention could be practiced with a blade having a blade dressed angle $\gamma_D$ slightly different than the wear angle $\gamma_W$, as shown in FIG. 7A (e.g., $\gamma_W-\gamma_D=\gamma_c$). For example, the dressed angle $\gamma_D$ could be at least two thousandth of a degree less or more than the wear angle $\gamma_W$.

As shown in FIG. 2C, a distance 104 between a lower portion 106 of the engagement surface 28 and an upper edge 23 of the upper surface 14 is at least as large as a distance 108 between the bottom portion 40 of each of the notches 26 and the upper edge 23. The distances 104, 108 are also referred to as "perpendicular" distances because they are equal to the distance of a line perpendicular to pairs of imaginary lines that are perpendicular to the side face 16 and include the various reference points (i.e, the lower portion 106, the upper edge 23, and the bottom portion 40). Preferably, as shown in FIG. 2C, the distance 104 is larger than the distance 108.

Referring to FIG. 7, the engagement surface 28 preferably forms a substantially continuous line of contact with the outer surface 102 of the rotatable cylinder 30 when the creping blade 20 is positioned on the outer surface 102, thereby obviating the need for substantial running in of the blade 20. This feature of the invention is advantageous because saleable paper generally cannot be manufacturing during the running in of creping blades. The blade of the present invention thus increases the efficiency of the paper making process.

As shown in FIGS. 2B, 2C and 7, the creping blade 20 preferably includes a plurality of protrusions 32 adjacent to the notches 26. The protrusions 32 extend from the adjacent side face 16. Each of the protrusions 32 includes an engagement portion 110 defining at least a part of the engagement surface 28. (See FIG. 4.) The engagement portion 110 of each protrusion 32 preferably extends from an edge 112 on the bottom portion 40 of a respective notch 26, wherein the edge 112 intersects an imaginary plane including the adjacent side face 16. Preferably, the creping blade 20 includes rectilinear regions 46 between the protrusions 32. Outer faces of the rectilinear regions 46 preferably form a portion of the engagement surface 28. Preferably, the rectilinear regions 46 are formed when the engagement surface 28 is dressed.

Figure 53:
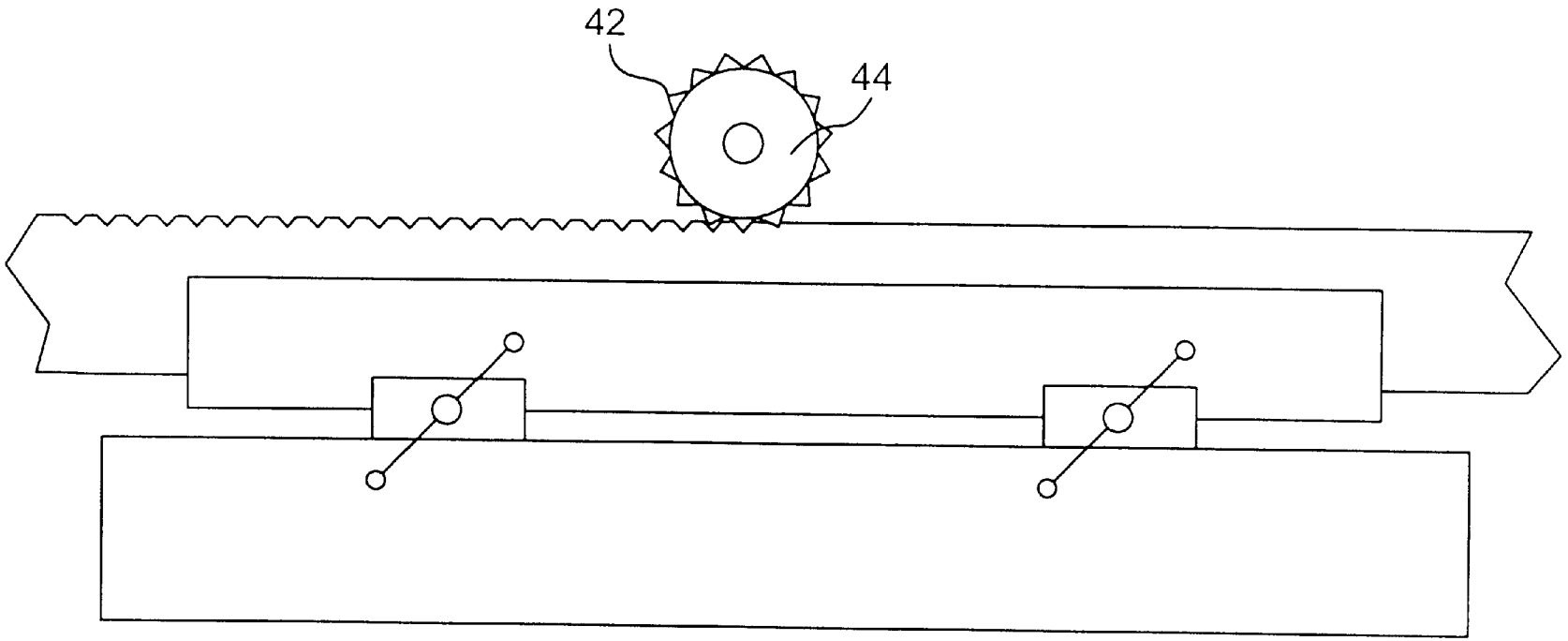
FIGS. 53, 54A and 54B are schematic views of a process of manufacturing creping blades of the invention.

The protrusions 32 and the notches 26 are preferably formed by displacing material from the blank 10 during the manufacturing of he creping blade 20. As shown in FIG. 53, more preferably, the material is displaced from the blank 10 using a knurling wheel 44. The process for manufacturing the creping blade 20 will be described in more detail below.

As shown in FIG. 7, the creping blade 20 is positioned with respect to the rotatable cylinder 30 so that the creping blade 20 is capable of creping cellulosic web from the outer surface 102 of the cylinder 30 when the web is on the outer surface 102 and the cylinder 30 is rotated. (See also FIGS. 8, 15 and 16.)

Although a definitive explanation of the relative contribution of each aspect of the geometry is not yet available, it appears that several aspects of the geometry of the blade 20 have predominant importance. In particular, the following four features of the invention appear to contribute to the superiority of the creping blade 20 of the present invention over conventional blades: the shape of the engagement surface 28; the shape of adjacent side face 16; the shape of upper surface 14; and the shape of actual upper edge 23. The geometry of engagement surface 28 and the side face 16 (i.e., relief surface) appear to be associated with increased stability of the creping blade 20. The shape of upper edge 23 and the shape of the upper surface 14 appear to advantageously influence the configuration of the creped web.

Figure 6A:
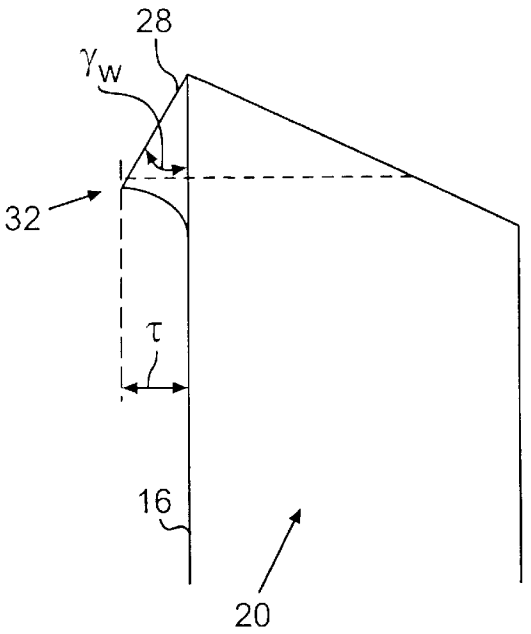
FIG. 6A is a view of an embodiment of a creping blade dressed to a wear angle of the creping blade.
Figure 6B:
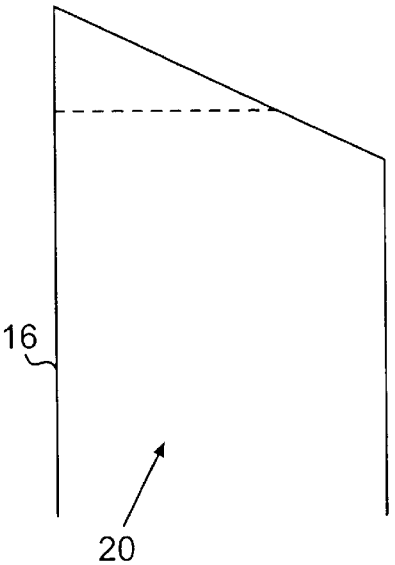
FIG. 6B is a view of an embodiment of a flush-dressed creping blade.
Figure 6C:
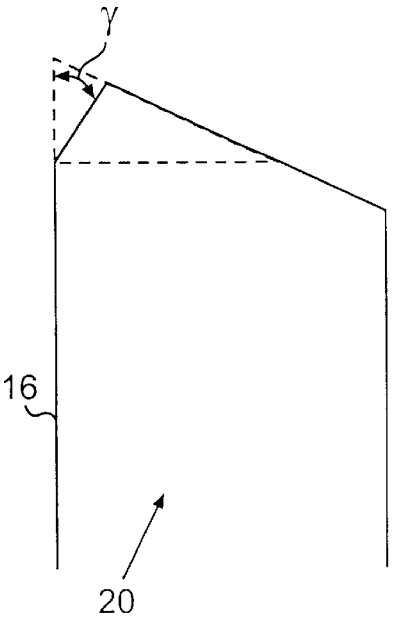
FIG. 6C is a view of an embodiment of a reverse-relieved creping blade.

It also appears that improved stability of the creping operation is associated with the combination of: (1) the engagement surface 28 having increased engagement area; and (2) the protrusions 32 extending from the side face 16 providing a much higher degree of relief than is usually encountered in conventional creping. This aspect is illustrated in FIGS. 6A, 6B and 6C. FIG. 6A illustrates a preferred blade of the present invention, wherein the protrusions 32 are dressed to an angle substantially equal to the wear angle $\gamma_w$ of the blade so that the blade has surface-to-surface contact with the rotatable cylinder 30. (See FIG. 7.) In FIG. 6B, the protrusions 32 are removed (i.e., dressed away) so that the side face 16 of the blade 20 is flat and the blade 20 engages the surface of the rotatable cylinder 30 in line-to-surface contact. In FIG. 6C, the protrusions 32 have been removed and a portion of the blade 20 has been beveled at an angle approximately equal to the wear angle $\gamma_W$ of the blade.

It is also hypothesized that hardening of the blade due to cold working during the knurling process may contribute to improved wear life. Microhardness of the steel at the bottom portion of a notch can show an increase of 3–5 points on the Rockwell 'C' scale. Such hardening is believed to be insufficient to increase the wear experienced by the Yankee dryer, but may increase blade life.

It appears that the biaxially undulatory geometry of the creped web is largely associated with presence of: (i) the upper surface 14 including the plurality of notches 26 spaced along the upper surface 14; and (ii) the upper edge 23. Both of these features provide a shaping and bulking influence on the creped web.

Figure 5A:
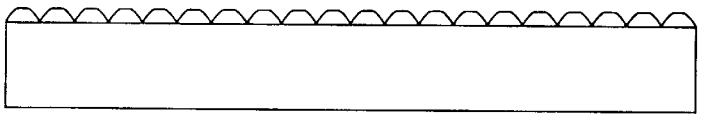
FIGS. 5A–5G are views of the creping blade of FIGS. 2A–2C.
Figure 5B:
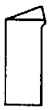
Figure 5C:
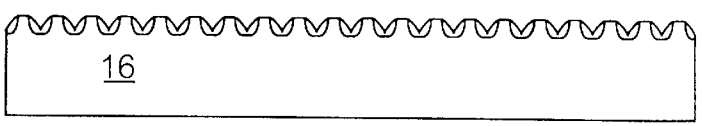
Figure 5D:
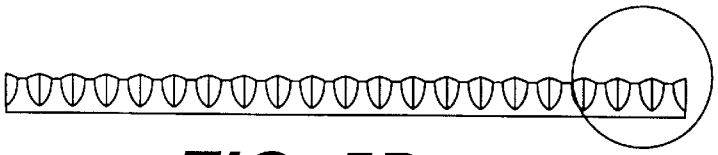
Figure 5E:
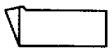
Figure 5F:
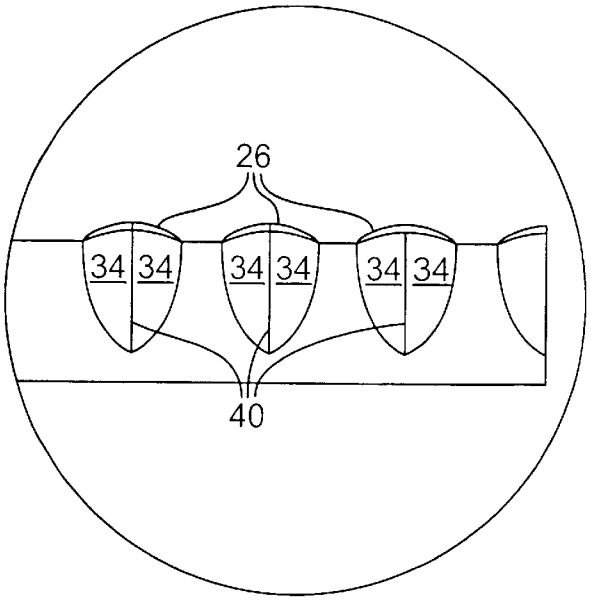
Figure 5G:
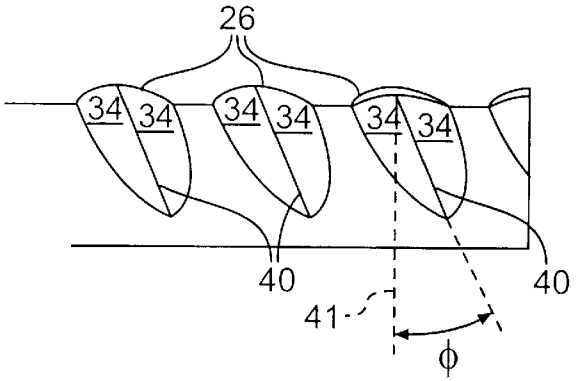

As shown in FIGS. 5F and 5G, the notches 26 are serrulate shaped and include two leaflet-shaped lower surfaces 34 separated by the lower portion 40. This configuration is formed when using a knurling tool like the knurling tool 44 having a knurling edge 42, as shown in FIG. 53. Such serrulate shaped notches are suitable to practice the invention, but the invention could still be practiced with notches of a number of different shapes. Moreover, although FIGS. 5F and 5G show two separate leaflet-shaped lower surfaces 34, there is no requirement that the surfaces 34 be discontinuous. Indeed, as knurling tool 44 is used repeatedly, the knurling edge 42 becomes blunted, resulting in a continuous surface. In our experience, either type of surface is suitable.

Figure 4:
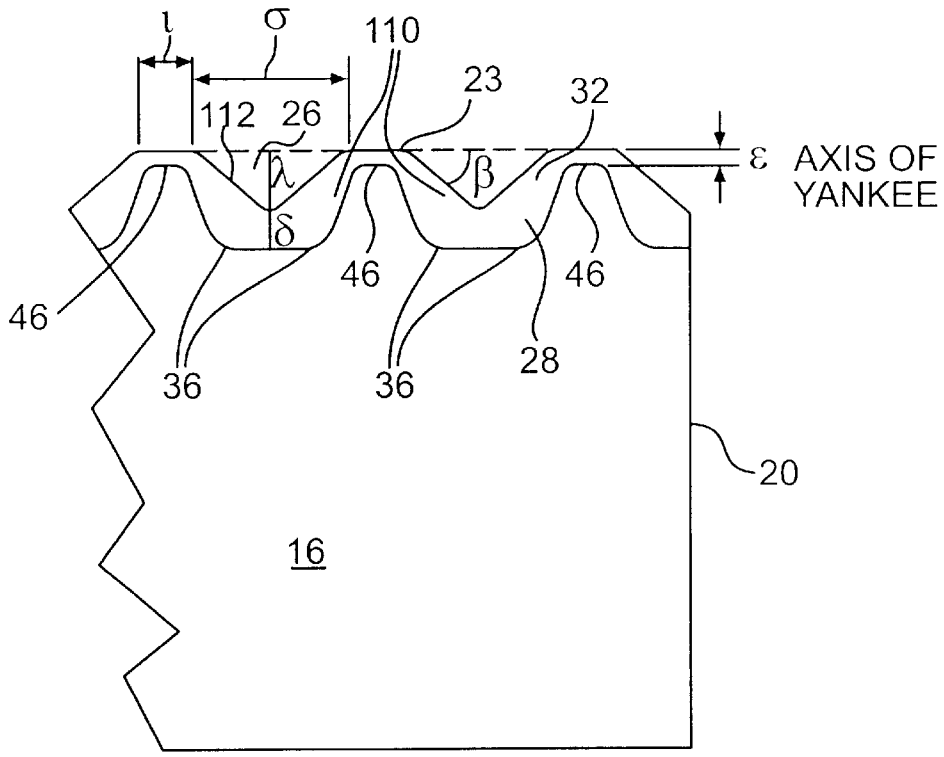
FIG. 4 is a schematic view of the creping blade of FIGS. 2A–2C.

Referring to FIG. 4, the rectilinear regions 46 between the protrusions 32 are preferably co-linear and have a width "$\epsilon$", and a length "l". In the embodiment shown in the FIGS. 2A–2C and 4 (i.e., serrulate-shaped notches), the rectilinear regions 46 are connected by substantially planar crescent-shaped bands 36 having a width, "$\delta$", a depth "$\lambda$", and a span "$\sigma$". The crescent shaped bands combine to form the engagement portions 110. Preferably, the width "$\epsilon$" of rectilinear regions 46 is substantially less than width "$\delta$" of the crescent-shaped bands 36 (at least when the blade is new). The length "l" of rectilinear regions 46 is preferably from about 0.002" to about 0.084". More preferably, the length "l" is less than about 0.05". Preferably, the depth "$\lambda$" of the notches 26 ranges from about 0.008" to about 0.050". More preferably, the depth "$\lambda$" of the notches 26 ranges from about 0.010" to about 0.035". Most preferably, the depth "$\lambda$" of the notches 26 ranges from about 0.015"to about 0.030". The span "$\sigma$" of crescent-shaped bands 36 preferably ranges from about 0.01" to about 0.095". More preferably, the span "$\sigma$" of crescent-shaped bands 36 ranges from about 0.02" to about 0.125". Most preferably, the span "$\sigma$" of crescent-shaped bands 36 ranges from about 0.03" to about 0.08".

In some applications, the engagement surface 28 may be discontinuous. Referring to FIG. 7, this can be achieved if the blade 20 is rotated slightly counterclockwise, so that the engagement surface 28 only includes the rectilinear regions 46 or a combination of the rectilinear regions 46 and upper portions of crescent-shaped bands 36. Alternatively, if the blade 20 is rotated slightly clockwise, the engagement surface 28 may only include lower portions of the crescent-shaped bands 36. Both of these configurations do run stably and in fact, have run satisfactorily for extended periods.

Figure 8B:
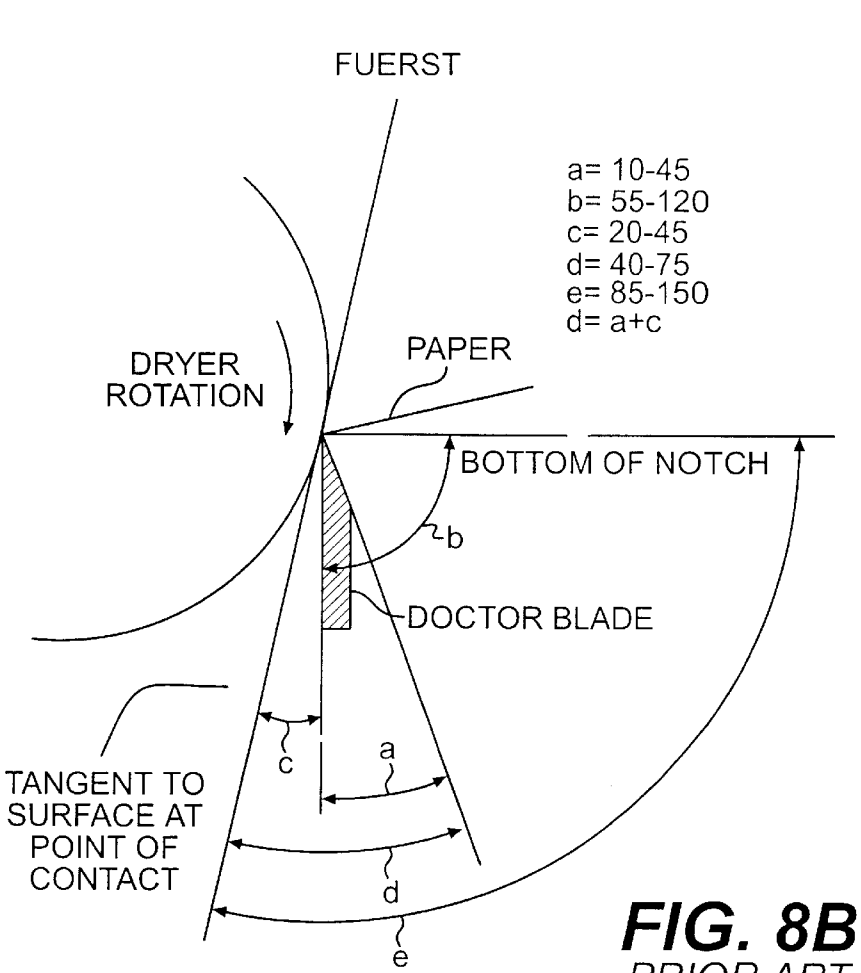
FIG. 8B PRIOR ART
FIG. 8B is a view of the creping blade disclosed in U.S. Pat. No. 3,507,745 to Fuerst positioned with respect to a Yankee dryer.

To further define the geometry of the embodiment of the creping blade shown in the drawings, it is helpful to define the following angles:

- creping angle "$\alpha$"—the angle between the upper surface 14 of the blade 20 and a plane tangent to the Yankee dryer 30 at the point of intersection between the upper edge 23 and Yankee 30 (see FIG. 7);
- axial rake angle "$\beta$"—the angle between the axis of the Yankee dryer 30 and the upper edge 23, (i.e., the curve defined by the intersection of the surface of Yankee 30 with the lower surface 34 of the notch 26) (see FIG. 4);
- wear angle "$\gamma_w$"—the angle between the adjacent side surface 16 of the blade 20 and the plane tangent to the Yankee 30 at the intersection between Yankee 30 and the upper edge 23 (also known as the blade angle or holder angle; see FIG. 7);
- dressed angle "$\gamma_D$"—the angle between the adjacent side surface 16 and the engagement surface 28 (see FIG. 7); preferably, the dressed angle is substantially equal to the wear angle; and
- side rake angle "$\phi$", shown in FIG. 5G—the angle between a line 40 on the lower surface 34 and the normal 41 to Yankee 30 in the plane defined by the normal to the Yankee at the points of contact between the cutting edge of the blade (Line 23, FIGS. 2 and 4) and the axis of the Yankee dryer. The Yankee 30 is shown in FIG. 8.

The value of each of these angles will vary depending upon the precise location along the cutting edge at which it is to be determined. We believe that the remarkable results achieved with the creping blades of the present invention are due to those variations in these angles along the cutting edge. Accordingly, in many cases it will be convenient to denote the location at which each of these angles is determined by a subscript attached to the basic symbol for that angle. We prefer to use the subscripts "f", "c" and "m" to indicate angles measured at the rectilinear regions 46, at the crescent shaped regions 36 and the minima of the upper edge 23, respectively.

Figure 8A:
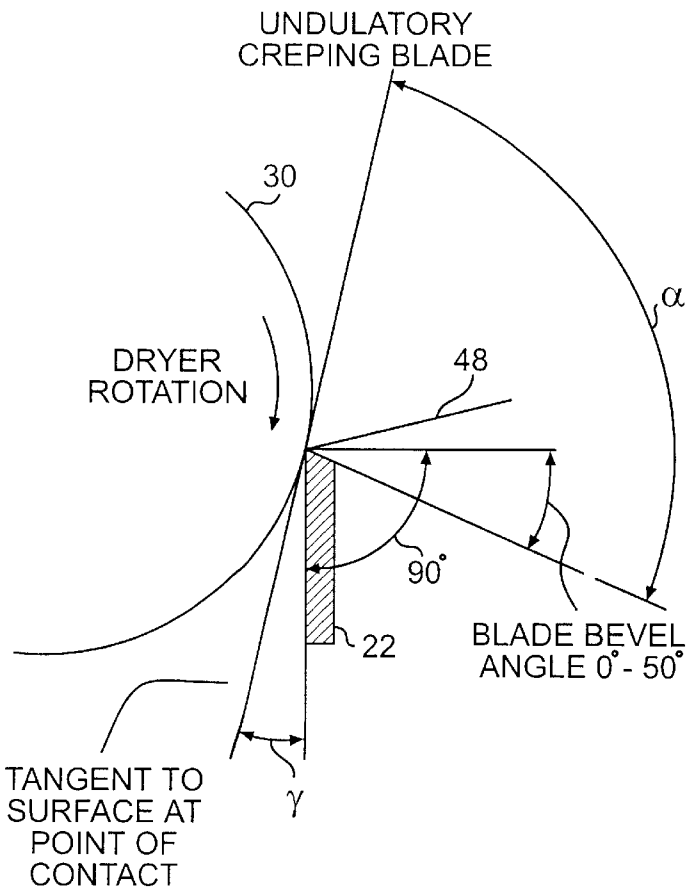
FIGS. 8A is a view of the creping blade of the present invention positioned with respect to a Yankee dryer.
Figure 9A:
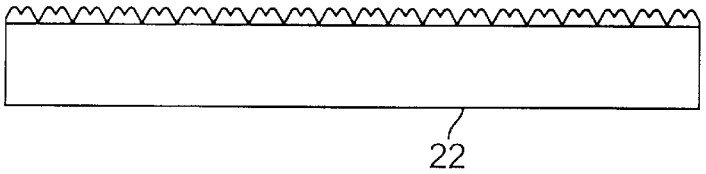
FIGS. 9A–9F and 10A–10F are schematic views of embodiments of irregular creping blades of the invention.
Figure 9B:
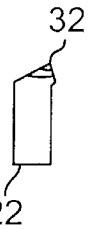
Figure 9C:
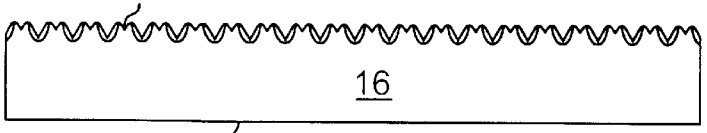
Figure 9F:
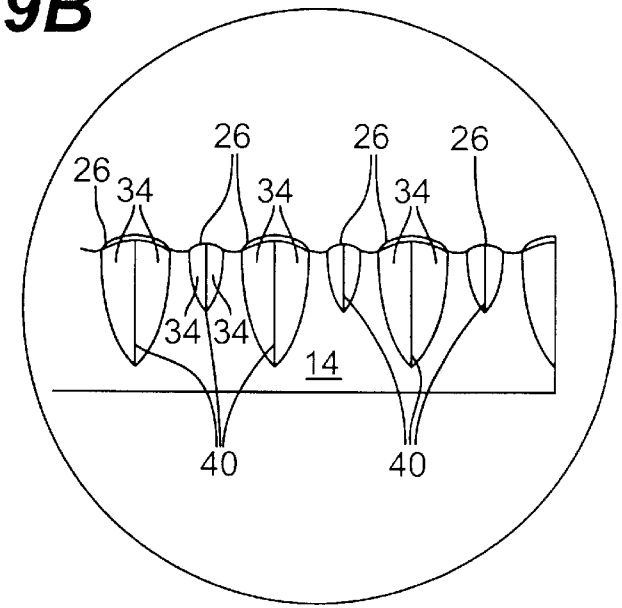
Figure 9D:
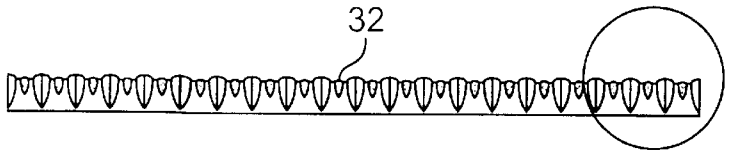
Figure 9E:
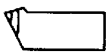
Figure 10A:
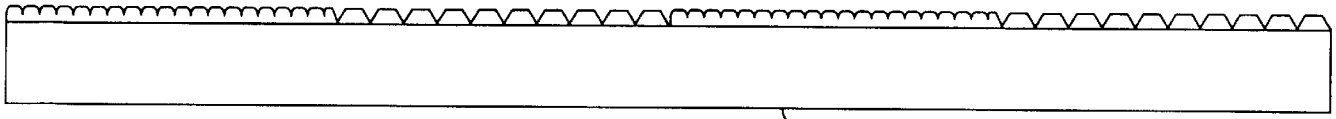
Figure 10C:
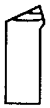
Figure 10G:
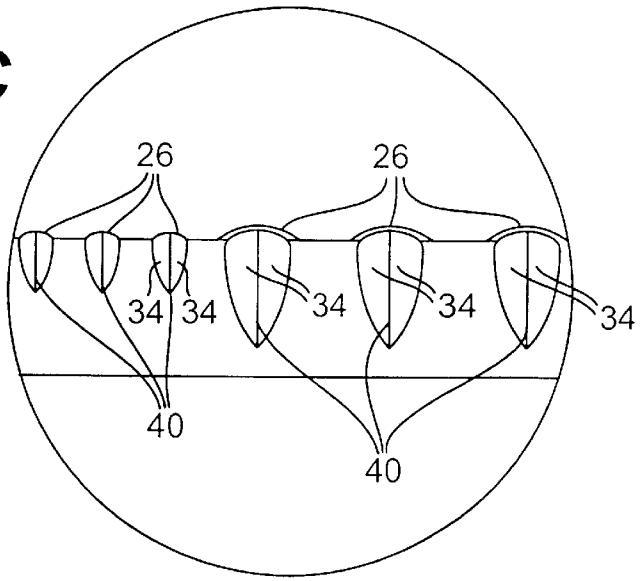
FIG. 10G is a view of the circled portion of the creping blade of FIG. 10E.
Figure 10B:
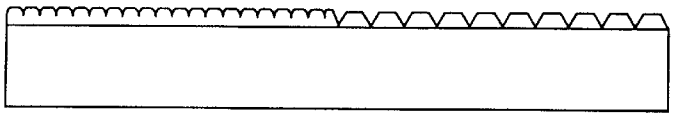
Figure 10D:
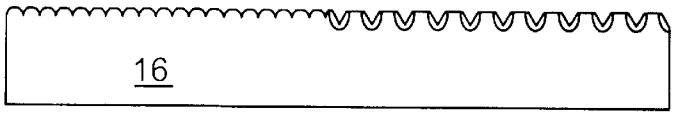
Figure 10F:
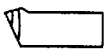
Figure 10E:
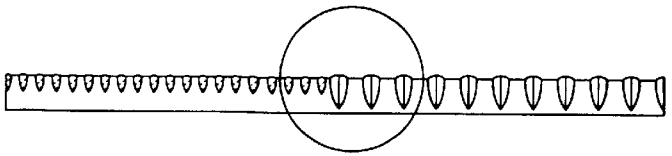

Referring to FIGS. 2, 7 and 8A, the local creping angle "$\alpha$" is defined at each location along upper edge 23 as being the angle between upper surface 14 of blade 20 and the plane tangent to Yankee 30. Preferably, the local creping angle "$\alpha_f$" (adjacent to substantially rectilinear regions 46) is usually larger than the local creping angle "$\alpha_c$" (adjacent to nearly planar crescent-shaped bands 36). The local creping angle "$\alpha_c$" preferably varies from higher values adjacent to each rectilinear elongate region 46 to lower values "$\alpha_m$" in the lowest portions of each notch 26. Angle "$\alpha_c$", though not labeled in FIG. 7, is the creping angle measured at any point on the surface 34 (shown in FIG. 5F and 5G). As such, the local creping angle "$\alpha_c$" will preferably have a value between "$\alpha_f$" and "$\alpha_m$".

Referring to FIG. 4, the local axial rake angle "$\beta$" is defined at each location along upper edge 23. Preferably, the local axial rake angle along substantially co-linear rectilinear regions 46 "$\beta_f$" is substantially 0°. The local axial rake angle along nearly planar crescent-shaped bands 36 $\beta_c$" preferably varies from positive to negative along the length of each notch 26. Preferably, the absolute value of "$\beta_c$" varies from relatively high values adjacent to each rectilinear region 46 to lower values (e.g., approximately 0°) in the lowest portions of each notch 26. "$\beta_c$" preferably ranges in absolute value from about 15° to about 75°. More preferably, "$\beta_c$" ranges from about 20° to about 60°. Most preferably, "$\beta_c$" ranges from about 25° to about 45°.

As explained above, the preferred creping blades of the present invention include protrusions 32 extending from the adjacent side surface 16 of the blade 20. While blades 20 not having protrusion 32 can be used in the creping process, we have found that the presence of the protrusions 32 makes the procedure much less temperamental and much more forgiving. We have found that for very light or weak sheets, the process often does not run easily without the protrusions 32.

FIG. 6A shows the blade 20 with protrusions 32, while FIGS. 6B and 6C show various configuration without the protrusions 32. In the blade 20 with protrusions 32, the width "T" of each protrusion 32 is preferably at least about 0.005" before using the blade 20. It appears that the most stable creping continues for at least the time in which protrusions 32 have a width "T" of at least about 0.002" and that, once the protrusions 32 are entirely eroded and the area of surface 28 becomes excessively large, the web 48 (shown in FIG. 52) becomes much more susceptible to tearing and perforations.

As shown in FIGS. 7*a* and 8, local relief angle "$\gamma$" is defined at each location along engagement surface 28 as being the angle between side surface 16 of blade 20 and the plane tangent to Yankee 30. Accordingly, it can be appreciated that "$\gamma_w$", the local relief angle having an apex at surface 23 (i.e., the blade wear angle), is greater than or equal to "$\gamma_c$", the local relief angle adjacent to nearly planar crescent-shaped bands 36. Further, it can be appreciated that the local relief angle "$\gamma_c$" varies from relatively high values adjacent to each rectilinear elongate region 46 to lower values close to 0° in the lowest portions of each notch 26. In preferred blades of the present invention, "$\gamma_w$" will range from about 5° to about 60°, preferably from about 10° to about 45°, and more preferably from about 15° to about 30°. The local angle "$\gamma_c$" will be less than or equal to $\gamma_w$, preferably less than 10° and more preferably approximately 0° if measured precisely at upper edge 23. However, even though relief angle "$\gamma_c$" when measured precisely at upper edge 23 is very small, it should be noted that side surface 16, which is quite highly relieved (i.e., $\gamma_w > \gamma_c$). is spaced only slightly away from upper edge 23.

Preferably, the side rake angle "$\phi$", defined above, is between about 0° and about 45°, and is "balanced" by another surface of mirror image configuration defining another opposing surface 34. The axis of symmetry of the notches is preferably substantially normal to side surface 16 of blade 20. (See FIG. 5F.) However, we have obtained desirable results when the notches are not "balanced," but rather are "skewed," as shown in FIG. 5G.

Figure 15:
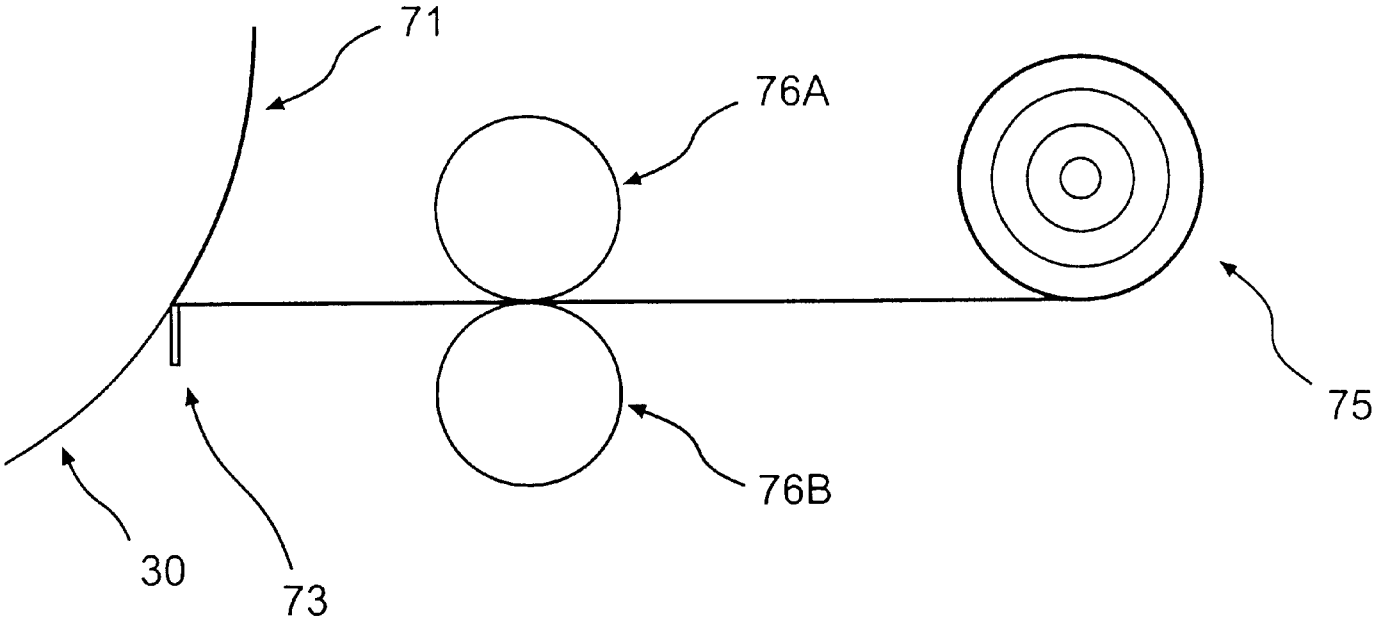
FIG. 15 is a schematic view of a dry crepe process.

The creping blade of the present invention can advantageously be used with wet crepe and through air drying (TAD) processes, as well as with conventional dry crepe technology. The dry crepe process is shown in FIG. 15. In this process, a web 71 is creped from the Yankee dryer 30 using the creping blade 73. The moisture content of the sheet when it contacts the creping blade 73 preferably ranges from about 1 percent to about 8 percent. Optionally, the creped sheet may be calendered by passing it through calender rolls 76*a* and 76*b,* which impart smoothness to the sheet while reducing its thickness. After calendering, the sheet is wound on reel 75.

Figure 16:
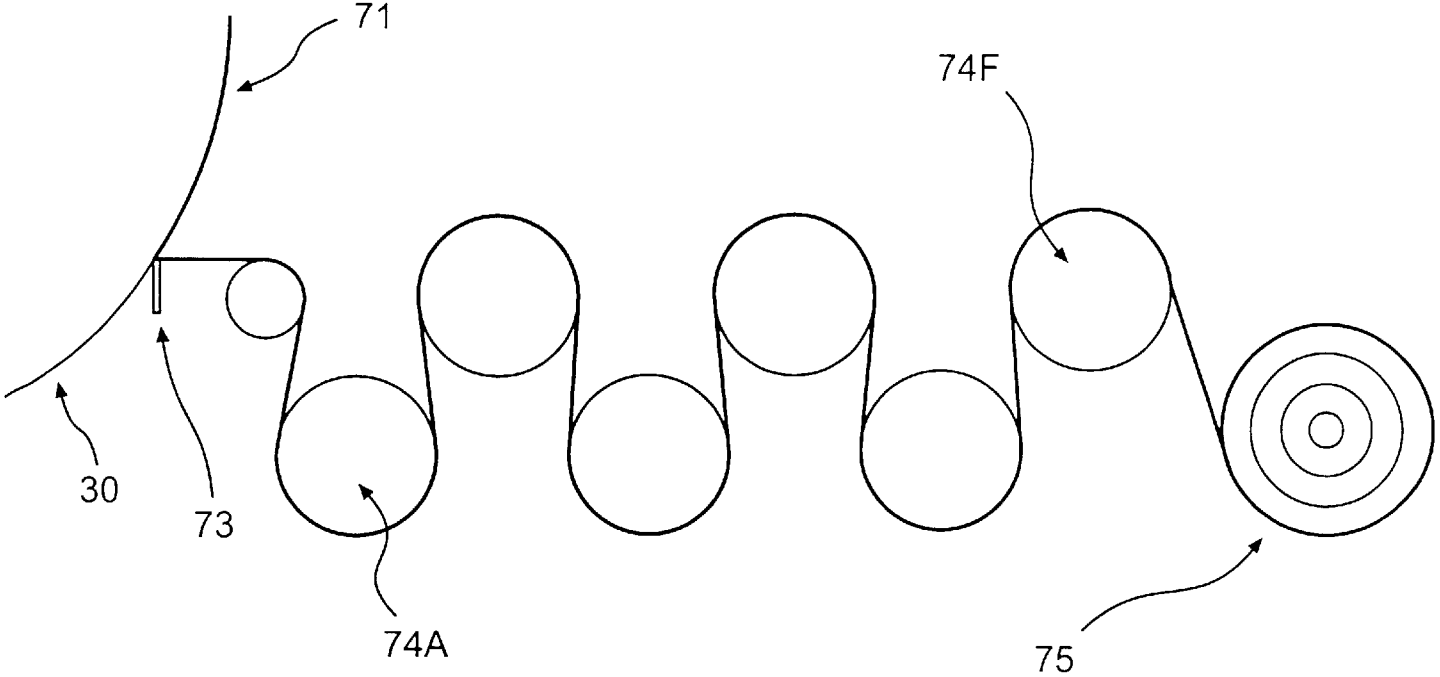
FIG. 16 is a schematic view of a wet crepe process.

The wet crepe process is shown in FIG. 16. In this process, the web 71 is creped from the Yankee dryer 30 using the creping blade 73. The moisture content of the sheet contacting creping blade 73 preferably ranges from about 10 to about 60 percent. After the creping operation, the drying process is completed by use of one or more steam-heated can dryers 74*a*–74*f*. These dryers are used to reduce the moisture content to a desired level, preferably from about 2 to about 8 percent. The completely dried sheet is then wound on reel 75.

Figure 17:
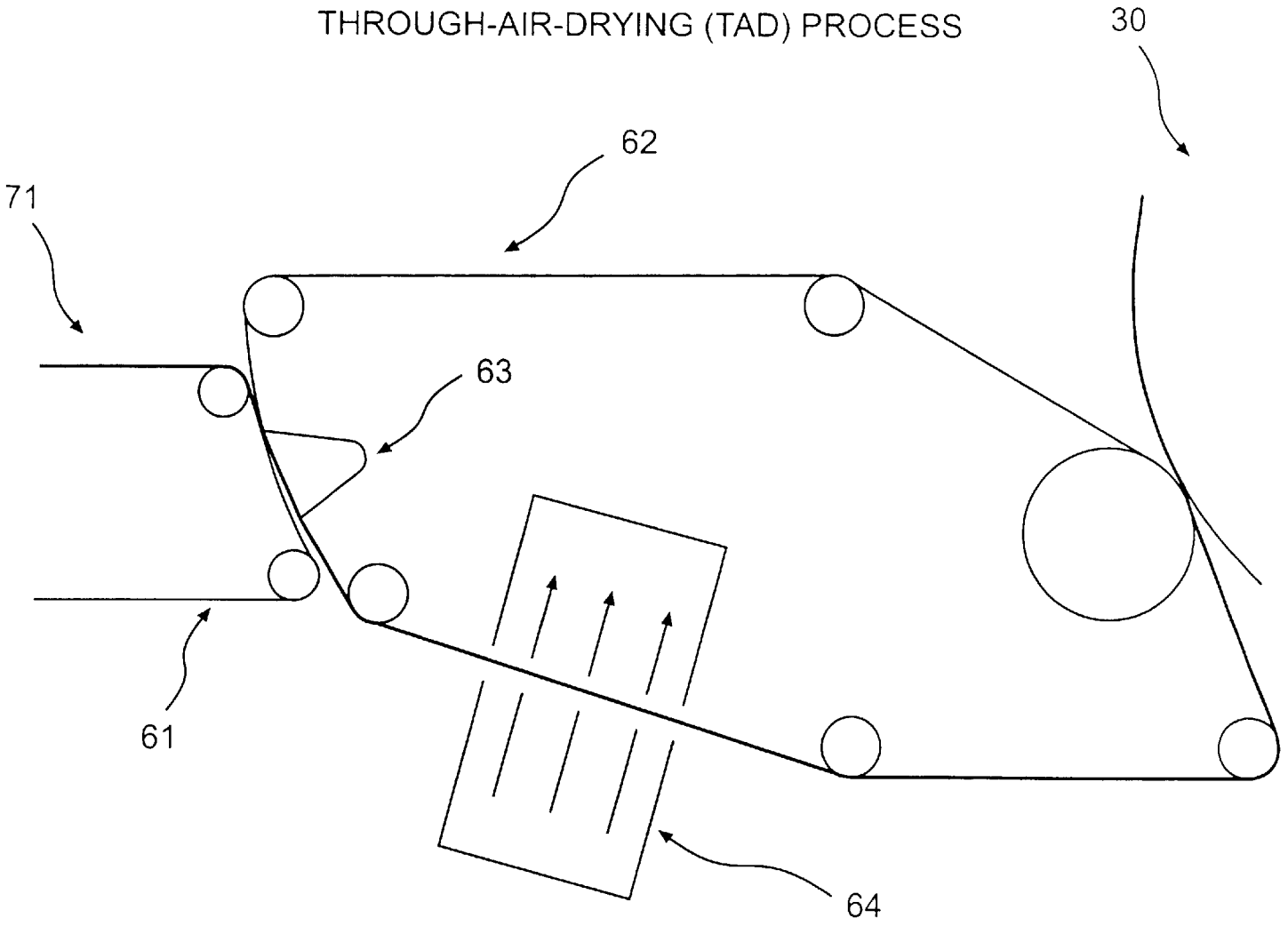
FIG. 17 is a schematic view of a through-air-drying (TAD) process.

The through air drying ("TAD") process is shown in FIG. 17. In this process, the wet web 71, having been formed on forming fabric 61, is transferred to through-air-drying fabric 62, preferably by a vacuum device 63. The TAD fabric 62 is preferably a coarsely woven fabric that allows relatively free passage of air through both the fabric 62 and the web 71. While on fabric 62, the web 71 is dried by blowing hot air through web 71 using through-air-dryer 64. This operation reduces the webs moisture to a value usually between about 5 and about 65 percent. The partially dried web 71 is then transferred to the Yankee dryer 30, where it is dried to its final desired moisture content and is subsequently creped off the Yankee.

Figure 55:
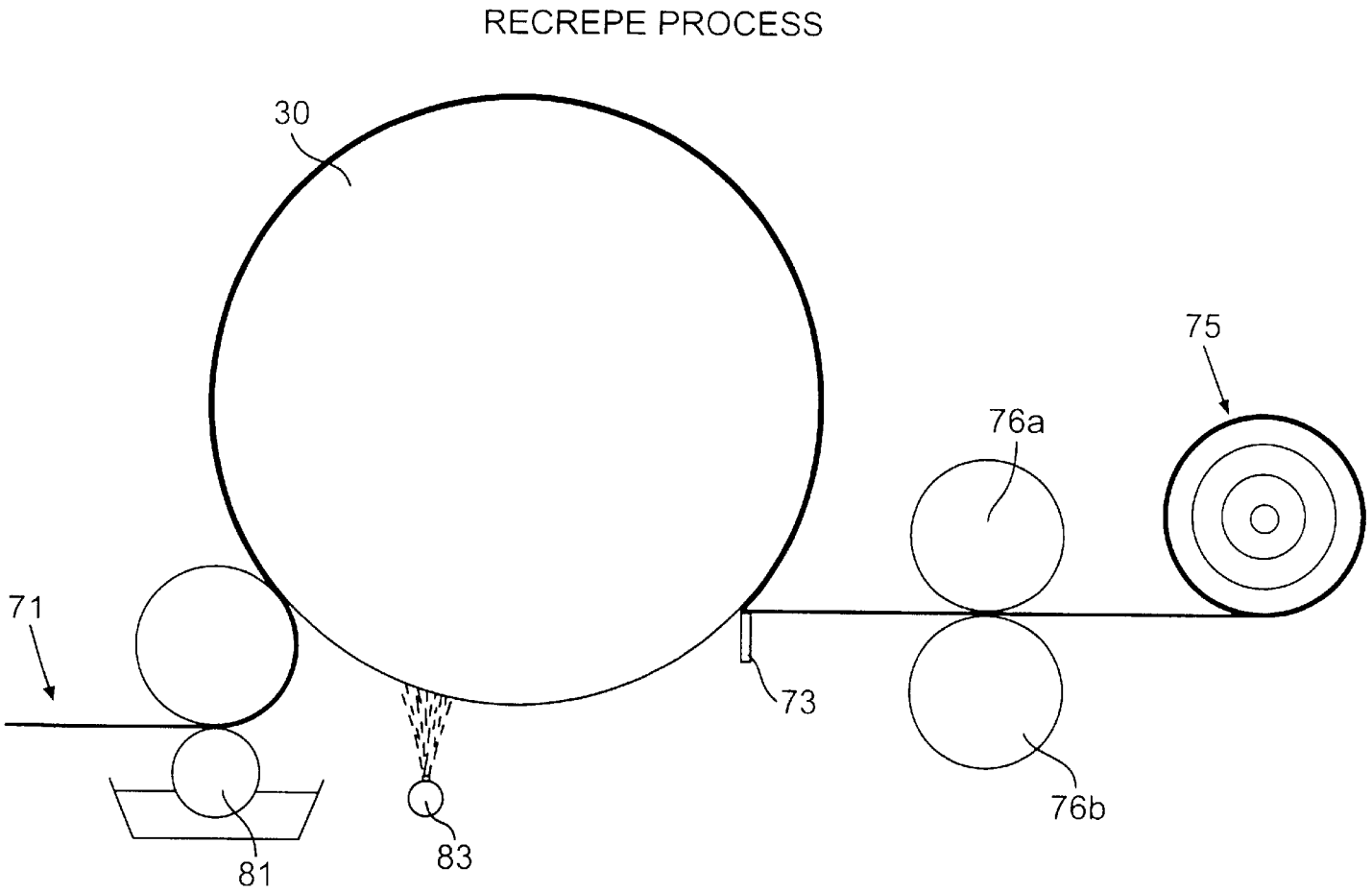
FIG. 55 is a schematic view of a re-crepe process.
Figure 56C:
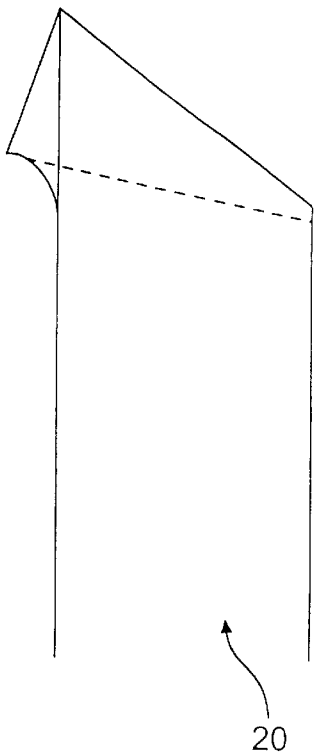
FIG. 56C is a view of a creping blade wherein the bottom portion of the notches declines with respect to a line perpendicular to the adjacent side face.
Figure 56B:
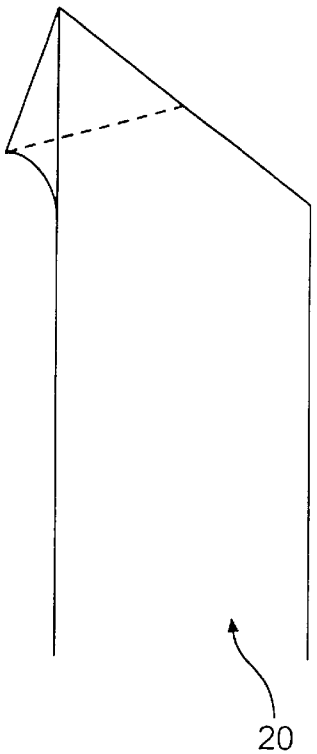
FIG. 56B is a view of a creping blade wherein the bottom portion of the notches is inclined with respect to a line perpendicular to the adjacent side face.
Figure 56A:
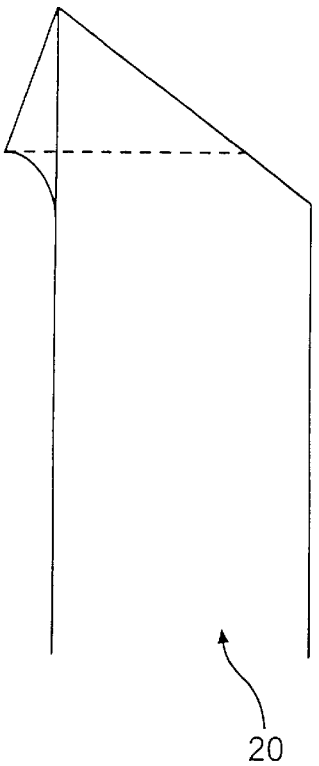
FIG. 56A is a view of a creping blade wherein the bottom portion of the notches is substantially perpendicular to the adjacent side face.

As shown in FIG. 55, the present invention also includes an improved process for production of a double or re-creped sheet. In the preferred process, a once-creped web is adhered to the surface of a Yankee dryer. The moisture is reduced in the web while it is in contact with the Yankee dryer, and the web is then recreped from the Yankee dryer. In the re-crepe process, adhesive is applied to either a substantially dried once-creped web 71, the Yankee/crepe dryer 30, or to both the web 71 and the Yankee 30. The adhesive may be applied in any of a variety of ways, for example, by using a patterned applicator roll 81, an adhesive spray device 83, or by various combinations of applicators known to those skilled in the art. Moisture from the adhesive and possibly some residual moisture in the sheet are removed using Yankee/crepe dryer 30. The web 71 is then creped from Yankee/crepe dryer 30 using the crepe blade 73. Optionally, the web 71 is calendered using calender rolls 76*a* and 76*b,* and wound on the reel 75.

Our invention also comprises an improved process for production of a creped tissue web, including the steps of: forming a latent cellulosic web on a foraminous surface; adhering said latent cellulosic web to the surface of a Yankee dryer; drying the latent cellulosic web while in contact with the Yankee dryer to form a dried cellulosic web; and creping the dried cellulosic web from the Yankee dryer; wherein the improvement includes the use of one of the creping blades described above to crepe the dried cellulosic web from the Yankee dryer. Preferably, the creping geometry and the adhesion between the Yankee dryer and the latent cellulosic web are controlled during drying such that the resulting web has from about 5 to about 150 crepe bars per inch, said crepe bars extending transversely in the cross machine direction, the geometry of the undulatory creping blade being such that the web formed has undulations extending longitudinally in the machine direction, the number of longitudinally extending undulations per inch being from about 5 to about 50.

Figure 52:
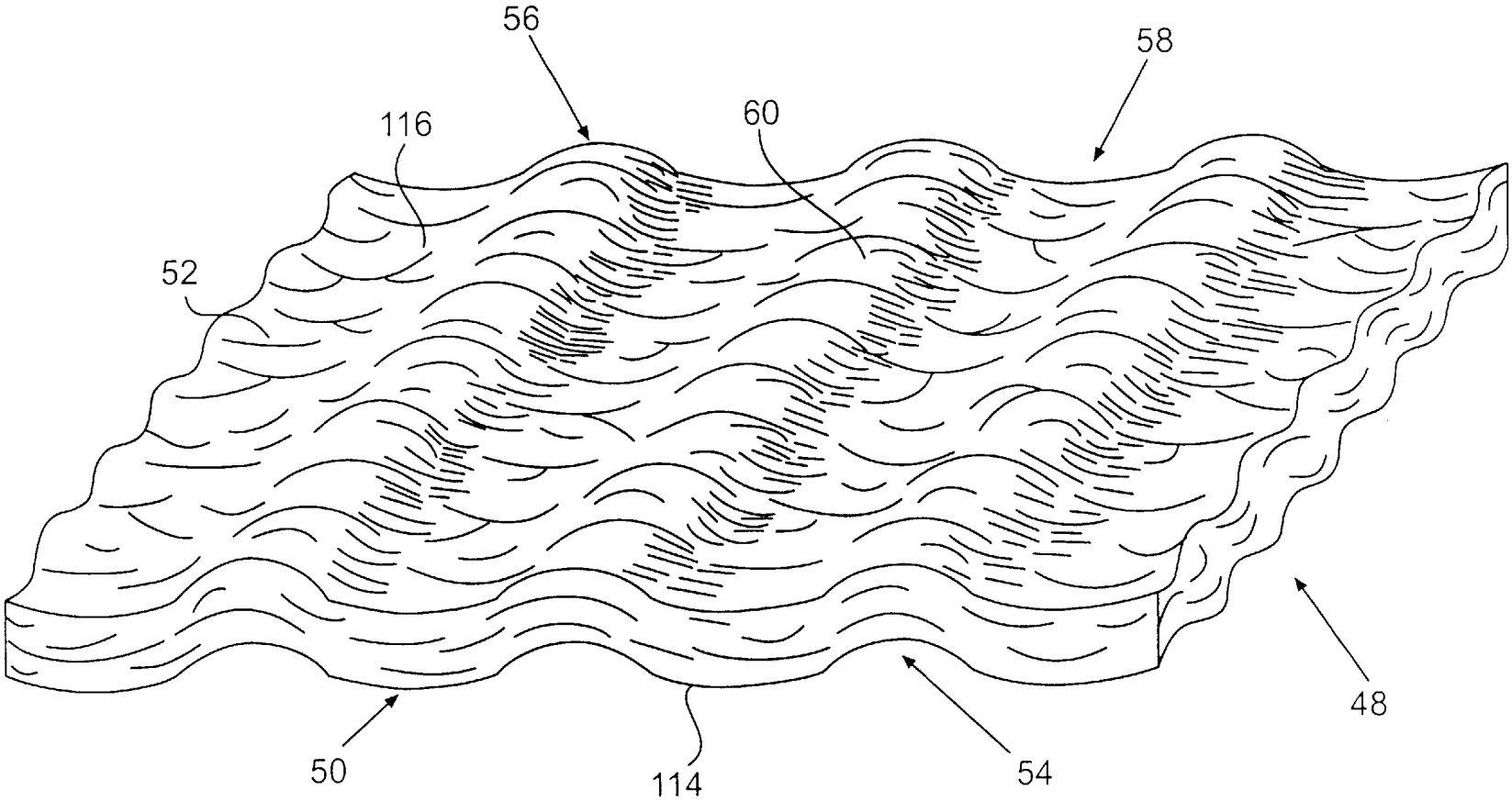
FIG. 52 is a schematic view of creped web of the invention.

Referring to FIG. 52, the present invention also includes a creped or recreped paper including a biaxially undulatory cellulosic fibrous web 48 creped from a Yankee dryer 30. (See FIG. 8.) The web 48 includes crepe bars 52 extending in a direction transverse to a machine direction and undulations including ridges 50, furrows 54, crests 56, and sulcations 58 extending longitudinally in the machine direction. The crepe bars 52 and the undulations preferably intersect to form a reticulum. The crepe bars 52 preferably have a spatial frequency of about 5 to about 150 crepe bars per inch. The ridges 50 and furrows 54 are interspersed on the air side 114 of the web 48 (i.e., the side facing away from the Yankee during creping), and the crests 56 and sulcations 58 are interspersed on a Yankee side 116 of the web 48 (i.e., the side facing the Yankee during creping). The ridges 50 preferably have a spatial frequency of about 5 to about 50 ridges per inch. Preferably, a basis weight of the web 48 is from about 7 to about 40 pounds per 3,000 square foot ream of the web 48.

The crepe frequency for a creped base sheet or product is preferably measured with a microscope, such as the Leica Stereozoom.RTM. 4 microscope. The sheet sample is placed on the microscope stage with its Yankee side up and the cross direction of the sheet vertical in the field of view. Preferably, the sample is placed over a black background to improve the crepe definition. During the procurement and mounting of the sample, care should be taken such that the sample is not stretched. Using a total magnification of about 18 to 20 times, the microscope is focused on the sheet. An illumination source is placed on either the right or left side of the microscope stage, with the position of the source being adjusted so that the light from it strikes the sample at an angle of approximately 45°. It has been found that Leica or Nicholas illuminators are suitable light sources. After the sample has been mounted and illuminated, the crepe bars are counted by placing a scale horizontally in the field of view and counting the crepe bars that touch the scale over a one-half centimeter distance. This procedure is repeated at least two times using different areas of the sample. The values obtained in the counts are then averaged and multiplied by the appropriate conversion factor to obtain the crepe frequency in the desired unit length.

Preferably, the thickness of the portion of the web 48 between the crests 56 and the furrows 54 is about 5% greater than the thickness between the ridges 50 and the sulcations 58. The portions of the web 48 adjacent to the ridges 50 are preferably from about 1% to about 7% thinner than the thickness of the portion adjacent to furrows 54.

The height of ridges 50 is generally related, to the depth of the notches 26 formed in creping blade 20. At a notch depth of about 0.010 inch, the ridge height is usually from about 0.0007 to about 0.003 inch for sheets having a basis weight of about 14 to about 19 pounds per ream. At double the depth, the ridge height increases from about 0.005 .to about 0.008 inch. At notch depths of about 0.030 inch, the ridge height is from about 0.010 to about 0.013 inch. At higher notch depths, the height of ridges 50 may not increase and could in fact decrease. Among other factors, the height of ridges 50 also depends on the basis weight of the sheet and the strength of the sheet.

Preferably, the average thickness of the portion of web 48 adjacent to crests 56 is significantly greater than the thickness of the portions of web 48 adjacent to sulcations 58. As a result, the density of the portion of web 48 adjacent crests 56 is preferably less than the density of the portion of the web 48 adjacent to the sulcations 58.

The process of the present invention preferably produces a web having a specific caliper of from about 3.5 to about 8 mils per 8 sheets per pound of basis weight. The usual basis weight of web 48 is from about 7 to about 35 lbs/3000 sq. ft. ream.

Preferably, when the web 48 is calendered, the specific caliper of the web 48 is from about 2.0 to about 6.0 mils per 8 sheets per pound of basis weight and the basis weight of said web is from about 7 to about 35 lbs/3000 sq. ft. ream.

Figure 11A:
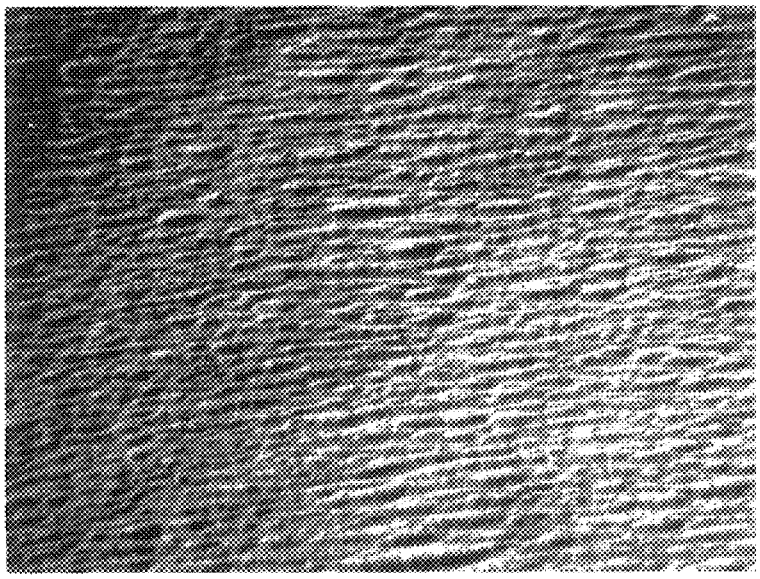
FIG. 11A is a low angle photomicrograph (8 times) of a conventional creped tissue (long direction of the photograph is the cross direction of the sheet)
Figure 11B:
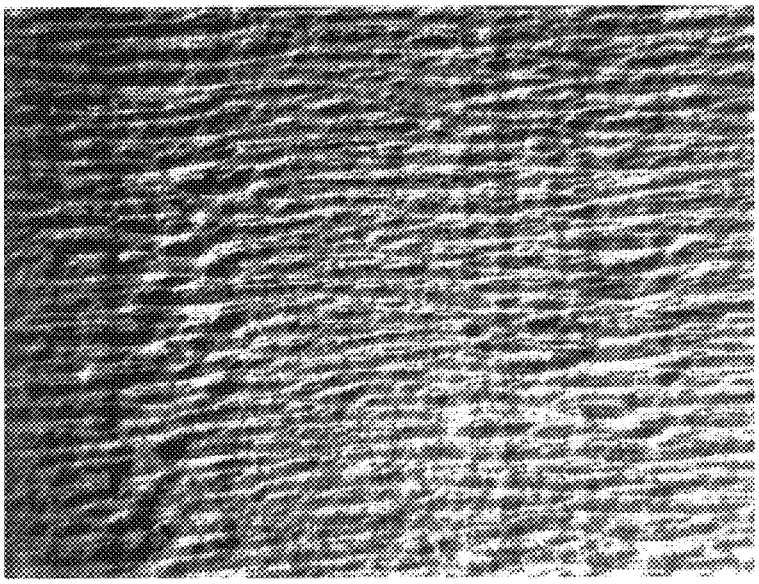
FIG. 11B is a low angle photomicrograph (8 times) of a sheet made according to the teachings of the Fuerst reference (long direction of the photograph is the cross direction of the sheet)
Figure 11C:
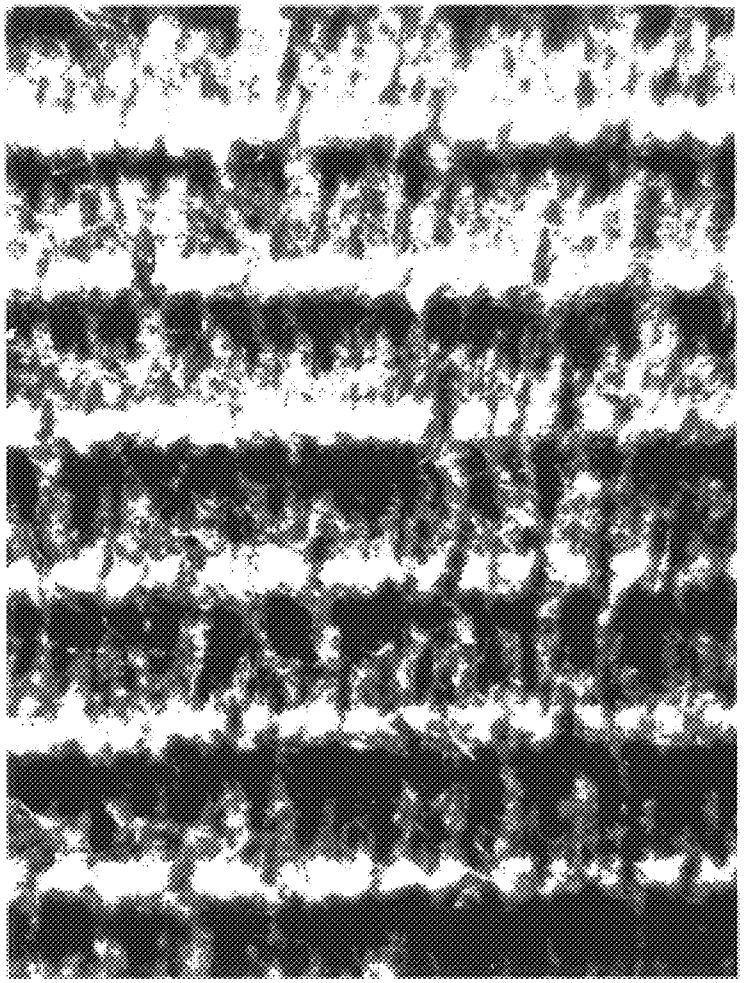
FIG. 11C is a low angle photomicrograph (8 times) of an embodiment of creped paper produced using one of the creping blades of the invention (long direction of the photograph is the cross direction of the sheet)

FIG. 11A shows the surface of a tissue sheet that has been creped using a conventional square (0 degree bevel) creping blade. FIG. 11B shows the surface of a tissue base sheet that has been creped using a blade such as that described in the U.S. Pat. No. 3,507,745 to Fuerst. The surface of a base sheet creped using the process of the present invention is shown in FIG. 11C. For all three tissue sheets, the long dimension of the photomicrograph corresponds to the cross direction of the base sheet. As can be seen from the photomicrograph FIG. 11A, the sheet surface has crepe bars extending in the sheet's cross direction.

FIG. 11B shows a photomicrograph of a sheet produced using a creping blade constructed following as closely as possible the teachings of Fuerst. This sheet, like the control sheet shown in FIG. 11A, has crepe ridges that extend in the cross direction only. Close examination of FIG. 11B reveals relatively wide (0.3125") alternating bands of coarser and finer crepe that extend in the base sheet's machine direction, corresponding to the sharpened and flattened edges of the blade.

FIG. 11C is a photomicrograph of a sheet of the present invention produced using the creping blade 20. FIG. 11C shows the biaxially undulatory nature of this product which has a reticulum of intersecting crepe bars and undulations, the crepe bars extending transversely in the sheets's cross direction and intersecting longitudinally extending crests comprising machine-direction "lunes."

In one embodiment, the web is calendered and has a specific caliper from about 2.0 to about 4.5 mils per 8 sheets per pound of basis weight, and the basis weight of the web is from about 7 to about 14 lbs per 3,000 sq. ft. ream. In the calendered web, the density difference between the areas adjoining crests and the areas adjoining sulcations is diminished.

Figure 12A:
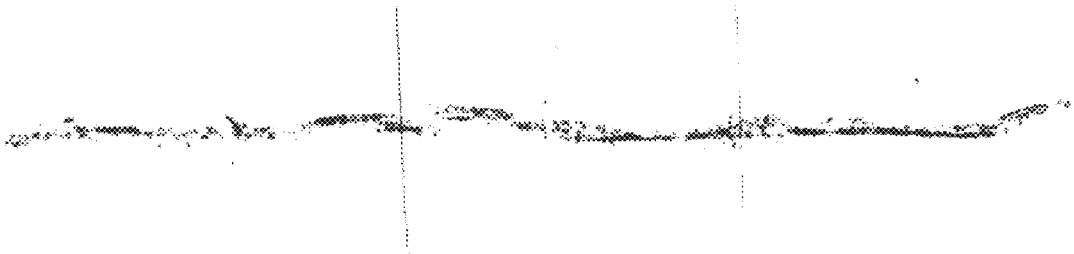
FIG. 12A is a photomicrograph (50 times) of conventionally creped tissue (looking in the machine direction)
Figure 12B:
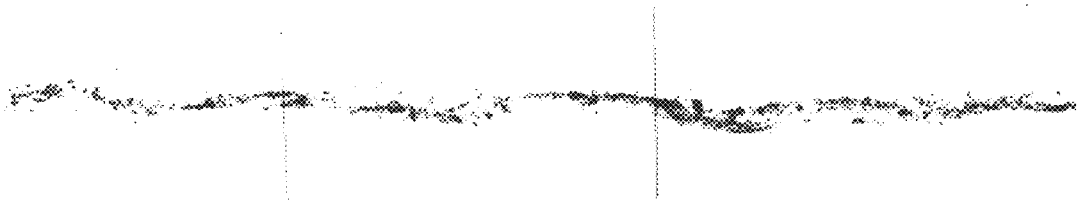
FIG. 12B is a photomicrograph (50 times) of a sheet made according to the teachings of the Fuerst reference (looking in the machine direction)
Figure 12C:
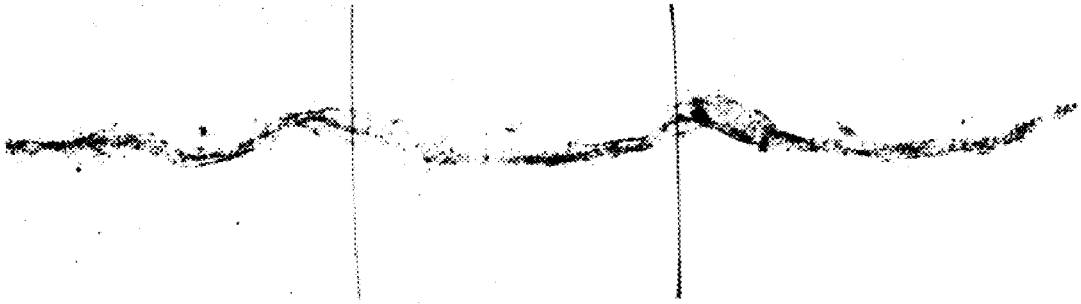
FIG. 12C is a photomicrograph (50 times) of an embodiment of creped paper produced using one of the creping blades of the invention.

FIGS. 12A–C are photomicrographs (50 times magnification) of the edges of three base sheets, looking in the machine direction. FIGS. 12A and 12B compare the control (i.e., square blade) and the Fuerst products, which have similar, relatively flat profiles. In contrast, FIG. 12C shows a sheet creped using the creping blade of the present invention, which exhibits undulations extending in the machine direction.

Figure 13A:
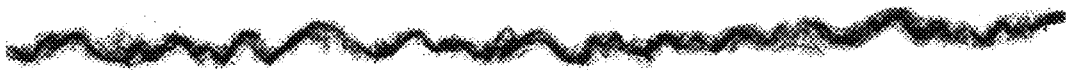
FIG. 13A is a photomicrograph (50 times) of conventionally creped tissue (looking in the cross machine direction)
Figure 13B:
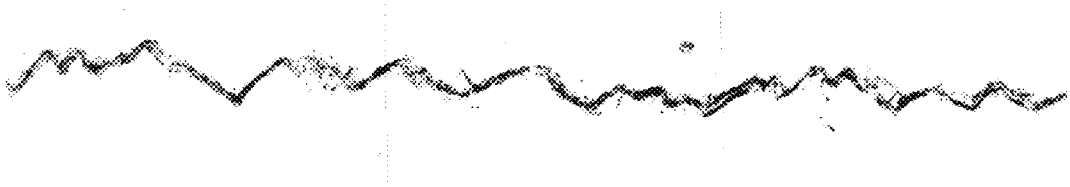
FIG. 13B is a photomicrograph (50 times) of a sheet creped using a sharpened section of the Fuerst creping blade (looking in the cross machine direction)
Figure 13C:
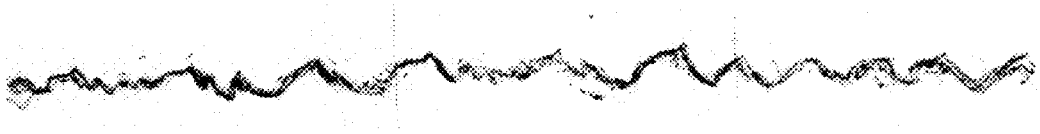
FIG. 13C is a photomicrograph (50 times) of a sheet creped using a flattened section of the Fuerst creping blade (looking in the cross machine direction)
Figure 13D:
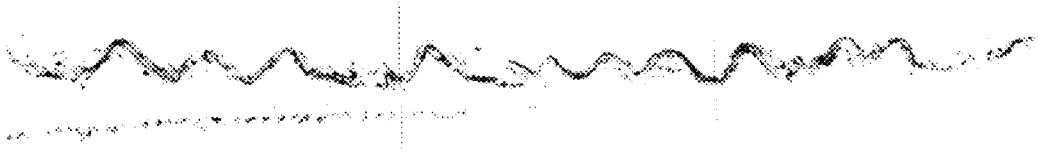
FIG. 13D is a photomicrograph (50 times) of an embodiment of creped paper produced using one of the creping blades of the present invention (looking in the cross machine direction)

FIGS. 13A–D show photomicrographic views (50 times magnification) of the edges of the base sheets looking in the sheets' cross directions. These figures allow comparisons of the sheets' crepe frequency to be made. FIG. 13A shows the sheet creped using the control (i.e., square) crepe blade. FIGS. 13B and 13C show the crepe pattern for the sheet manufactured using the Fuerst blade. FIG. 13B shows a section of the sheet that was creped at one of the blade's sharpened sections, while FIG. 13C shows a section creped on a flattened section of the blade. It can be seen that the crepe originating from the sharpened region of the Fuerst blade has, in general, crepes having a longer wavelength as compared to those corresponding to the portions of the sheet creped using the flatter portion of the blade, which have a crepe frequency more similar to that of the control blade. The crepe frequency of the sheet produced by the creping blade of the present invention has a crepe appearance similar to that of the control blade, demonstrating that the use of this type of undulatory creping blade does not substantially alter the sheet's overall crepe frequency.

Our process produces novel single- and multi-ply tissue, towel, napkins and facial tissue having the characteristic biaxially undulatory geometry described for the web. However, certain physical properties differ. The following tables will illustrate the properties of the various paper products produced by the novel undulatory creping blade process. Please note that for multi-ply tissue, the caliper is based on 8 multi-ply sheets (8×number of multiply sheets= plies total). For example, the caliper of two-ply tissues based on 8 two-ply sheets has 16 plies total. This holds true also for multi-ply towel paper products. In the wet crepe process the nascent web is subjected to overall compaction while the percent solids is less than fifty percent by weight.

TABLE A

| Physical Properties of Single-Ply and Multi-Ply Tissue and Single-Ply and Multi-Ply Towel | | |
|---|---|---|
| Single-Ply Tissue | | |
| Base Sheet; Uncalendered: | | |
| Basis Weight: | 10–20 | lbs./ream |
| Caliper: | 35–100 | mils/8 sheets |
| Specific Caliper: | 3.0–5.5 | mils/8 sheets/lbs/ream |
| CD Dry Tensile: | at least 250 | grams/3 inches |
| Base Sheet; Calendered | | |
| Basis Weight: | 10–20 | lbs/ream |
| Caliper: | 30–80 | mils/8 sheets |
| Specific Caliper: | 2.5–4.5 | mils/8 sheets/lbs/ream |
| CD Dry Tensile: | at least 250 | grams/3 inches |
| Tensile Modulus: | less than 75 | grams/inch/% |
| Friction Deviation: | less than 0.300 | |
| Finished Product; Unembossed: | | |
| Basis Weight: | 10–20 | lbs/ream |
| Caliper: | 30–80 | mils/8 sheets |
| Specific Caliper: | 2.5–4.5 | mils/8 sheets/lbs/ream |
| CD Dry Tensile: | at least 250 | grams/3 inches |
| Tensile Modulus: | less than 75 | grams/inch/% |
| Friction Deviation: | less than 0.300 | |
| Finished Product; Embossed: | | |
| Basis Weight: | 10–20 | lbs/ream |
| Caliper: | 35–100 | mils/8 sheets |
| Specific Caliper: | 2.75–5.5 | mils/8 sheets/lbs/ream |
| CD Dry Tensile: | at least 200 | grams/3 inches |
| Tensile Modulus: | less than 50 | grams/inch/% |
| Friction Deviation: | less than 0.330 | |
| Multi-Ply Tissue | | |
| Base Sheet; Uncalendered: | | |
| Basis Weight: | 7–14 | lbs/ream |
| Caliper: | 25–85 | mils/8 sheets |
| Specific Caliper: | 3.0–6.5 | mils/8 sheets/lbs/ream |
| CD Dry Tensile: | at least 150 | grams/3 inches |
| Base Sheet; Calendered | | |
| Basis Weight: | 7–14 | lbs/ream |
| Caliper: | 20–70 | mils/8 sheets |
| Specific Caliper: | 2.5–5.5 | mils/8 sheets/lbs/ream |
| CD Dry Tensile: | at least 150 | grams/3 inches |
| Tensile Modulus: | less than 40 | grams/inch/% |
| Friction Deviation: | less than 0.250 | |
| Finished Product; Unembossed: | | |
| Basis Weight: | 13–35 | lbs/ream |
| Caliper: | 40–135 | mils/8 sheets |
| Specific Caliper: | 2.5–5.5 | mils/8 sheets/lbs/ream* |
| CD Dry Tensile: | at least 250 | grams/3 inches |
| Tensile Modulus: | less than 80 | grams/inch/% |
| Friction Deviation: | less than 0.250 | |
| Finished Product; Embossed: | | |
| Basis Weight: | 13–35 | lbs/ream |
| Caliper: | 45–160 | mils/8 sheets |
| Specific Caliper: | 2.5–5.5 | mils/8 sheets/lbs/ream* |
| CD Dry Tensile: | at least 225 | grams/3 inches |
| Tensile Modulus: | less than 50 | grams/inch/% |
| Friction Deviation: | less than 0.300 | |
| Single-Ply Towel; Dry Creped | | |
| Base Sheet; Uncalendered: | | |
| Basis Weight: | 15–35 | lbs/ream |
| Caliper: | 45–135 | mils/8 sheets |
| Specific Caliper: | 2.5–4.5 | mils/8 sheets/lbs/ream |
| CD Wet Tensile: | at least 250 | grams/3 inches |
| Tensile Modulus: | less than 250 | grams/inch/% |
| Base Sheet; Calendered | | |
| Basis Weight: | 15–35 | lbs/ream |
| Caliper: | 35–100 | mils/8 sheets |
| Specific Caliper: | 2.0–4.0 | mils/8 sheets/lbs/ream |
| CD Wet Tensile: | at least 250 | grams/3 inches |

TABLE A-continued

| Physical Properties of Single-Ply and Multi-Ply Tissue and Single-Ply and Multi-Ply Towel | | |
|---|---|---|
| Tensile Modulus: | less than 250 | grams/inch/% |
| Friction Deviation: | less than 0.400 | |
| Note: Base sheets are not usually calendered | | |
| Finished Product; Unembossed: | | |
| Basis Weight: | 15–35 | lbs/ream |
| Caliper: | 30–135 | mils/8 sheets |
| Specific Caliper: | 2.0–4.0 | mils/8 sheets/lbs/ream |
| CD Wet Tensile: | at least 250 | grams/3 inches |
| Tensile Modulus: | less than 250 | grams/inch/% |
| Friction Deviation: | less than 0.500 | |
| Absorbency: | at least 100 | grams/sq. meter |
| Finished Product; Embossed: | | |
| Basis Weight: | 15–35 | lbs/ream |
| Caliper: | 75–200 | mils/8 sheets |
| Specific Caliper: | 3.0–8.0 | mils/8 sheets/lbs/ream |
| CD Wet Tensile: | at least 200 | grams/3 inches |
| Tensile Modulus: | less than 150 | grams/inch/% |
| Friction Deviation: | less than 0.520 | |
| Absorbency: | at least 150 | grams/sq. meter |
| Single-Ply Towel; Wet Creped | | |
| Base Sheet; Uncalendered: | | |
| Basis Weight: | 15–35 | lbs/ream |
| Caliper: | 35–125 | mils/8 sheets |
| Specific Caliper: | 2.2–4.0 | mils/8 sheets/lbs/ream |
| CD Wet Tensile: | at least 390 | grams/3 inches |
| Tensile Modulus: | less than 500 | grams/3 inches |
| Base Sheet; Calendered | | |
| Basis Weight: | 15–35 | lbs/ream |
| Caliper: | 25–100 | mils/8 sheets |
| Specific Caliper: | 2.0–3.5 | mils/8 sheets/lbs/ream |
| CD Wet Tensile: | at least 300 | grams/3 inches |
| Tensile Modulus: | less than 500 | grams/inch/% |
| Friction Deviation: | less than 0.400 | |
| Note: Base sheets are not usually calendered | | |
| Finished Product; Unembossed: | | |
| Basis Weight: | 15–35 | lbs/ream |
| Caliper: | 25–125 | mils/8 sheets |
| Specific Caliper: | 2.0–4.0 | mils/8 sheets/lbs/ream |
| CD Wet Tensile: | at least 300 | grams/3 inches |
| Tensile Modulus: | less than 500 | grams/inch/% |
| Friction Deviation: | less than 0.400 | |
| Absorbency: | at least 75 | grams/sq. meter |
| Finished Product; Embossed: | | |
| Basis Weight: | 15–35 | lbs/ream |
| Caliper: | 40–175 | mils/8 sheets |
| Specific Caliper: | 2.2–5.5 | mils/8 sheets/lbs/ream |
| CD Wet Tensile: | at least 250 | grams/3 inches |
| Tensile Modulus: | less than 400 | grams/inch/% |
| Friction Deviation: | less than 0.425 | |
| Absorbency: | at least 100 | grams/sq. meter |
| Multi-Ply Towel; Dry Creped | | |
| Base Sheet; Uncalendered: | | |
| Basis Weight: | 9–18 | lbs/team |
| Caliper: | 35–120 | mil/8 sheets |
| Specific Caliper: | 3.0–7.0 | mils/8 sheets/lbs/ream |
| CD Wet Tensile: | at least 150 | grams/3 inches |
| Tensile Modulus: | less than 150 | grams/3 inches |
| Base Sheet; Calendered | | |
| Basis Weight: | 9–18 | lbs/ream |
| Caliper: | 30–100 | mils/8 sheets |
| Specific Caliper: | 2.5–6.0 | mils/8 sheets/lbs/ream |
| CD Wet Tensile: | at least 150 | grams/3 inches |
| Tensile Modulus: | less than 150 | grams/inch/% |
| Friction Deviation: | less than 0.350 | |
| Note: Base sheets are not usually calendered | | |

TABLE A-continued

| Physical Properties of Single-Ply and Multi-Ply Tissue and Single-Ply and Multi-Ply Towel | | |
|---|---|---|
| Finished Product; Unembossed: | | |
| Basis Weight: | 17–36 | lbs/ream |
| Caliper: | 50–200 | mils/8 sheets |
| Specific Caliper: | 2.5–7.0 | mils/8 sheets/lbs/ream |
| CD Wet Tensile: | at least 250 | grams/3 inches |
| Tensile Modulus: | less than 300 | grams/inch/% |
| Friction Deviation: | less than 0.425 | |
| Absorbency: | at least 175 | grams/sq. meter |
| Finished Product; Embossed: | | |
| Basis Weight: | 17–40 | lbs/ream |
| Caliper: | 75–225 | mils/8 sheets |
| Specific Caliper: | 4.0–7.0 | mils/8 sheets/lbs/ream |
| CD Wet Tensile: | at least 250 | grams/3 inches |
| Tensile Modulus: | less than 150 | grams/inch/% |
| Friction Deviation: | less than 0.450 | |
| Absorbency: | at least 175 | grams/sq. meter |
| Multi-Ply Towel; Wet Creped | | |
| Base Sheet; Uncalendered: | | |
| Basis Weight: | 10–17 | lbs/ream |
| Caliper: | 35–125 | mils/8 sheets |
| Specific Caliper: | 3.0–7.5 | mils/8 sheets/lbs/ream |
| CD Wet Tensile: | at least 200 | grams/3 inches |
| Tensile Modulus: | less than 400 | grams/3 inches |
| Base Sheet; Calendered | | |
| Basis Weight: | 10–17 | lbs/ream |
| Caliper: | 25–100 | mils/8 sheets |
| Specific Caliper: | 2.5–6.5 | mils/8 sheets/lbs/ream |
| CD Wet Tensile: | at least 200 | grams/3 inches- |
| Tensile Modulus: | less than 400 | grams/inch/% |
| Friction Deviation: | less than 0.375 | |
| Note: Base sheets are not-usually calendered | | |
| Finished Product; Unembossed: | | |
| Basis Weight: | 18–34 | lbs/ream |
| Caliper: | 50–200 | mils/8 sheets |
| Specific Caliper: | 2.5–7.5 | mils/8 sheets/lbs/ream |
| CD Wet Tensile: | at least 350 | grams/3 inches |
| Tensile Modulus: | less than 600 | grams/inch/% |
| Friction Deviation: | less than 0.400 | |
| Absorbency: | at least 100 | grams/sq. meter |
| Finished Product; Embossed: | | |
| Basis Weight: | 18–34 | lbs/ream |
| Caliper: | 50–200 | mils/8 sheets |
| Specific Caliper: | 2.5–7.5 | mils/8 sheets/lbs/ream |
| CD Wet Tensile: | at least 250 | grams/3 inches |
| Tensile Modulus: | less than 400 | grams/inch/% |
| Friction Deviation: | less than 0.425 | |
| Absorbency: | at least 100 | grams/sq. meter |

Tissues of the present invention will have pleasing tactile properties, sometimes referred to as softness or texture. In Table A, tensile modulus and friction deviation are presented as indicia of perceived softness. Softness is not a directly measurable, unambiguous quantity, but rather is somewhat subjective.

Bates has reported that the two most important components for predicting perceived softness are roughness and modulus referred to herein as stiffness modulus or tensile modulus. See J. D. Bates "Softness Index: Fact or Mirage?," TAPPI, vol. 48, No. 4, pp 63–64A, 1965. See also H. Hollmark, "Evaluation of Tissue Paper Softness", TAPPI, vol. 66, No. 2, pp 97–99, February, 1983, relating tensile stiffness and surface profile to perceived softness.

Alternatively, surface texture can be evaluated by measuring geometric mean deviation (MMD) in the coefficient of friction using a Kawabata KES-SE Friction Tester equipped with a fingerprint type sensing unit using the low sensitivity range, a 25 g stylus weight and dividing the instrument readout by 20 to obtain the mean deviation in the coefficient of friction. The geometric mean deviation in the coefficient of friction is then, of course, the square root of the product of the MMD in the machine direction and the cross direction.

Tensile strengths reported herein were determined on an Instron Model 4000:Series IX using cut samples three inches wide, the length of the samples being normally six inches, for products having a sheet size of less than six inches the sample length is the between perforation distance in the case of machine direction tensile and the roll width in the case of the cross direction, the test is run employing the 2 lb. load cell with lightweight grips applied to the total width of the sample and recording the maximum load. The results are reported in grams/3 inch strip.

Tensile modulus, reported in grams per inch per percent strain is determined by the procedure used for tensile strength except that the modulus recorded is the geometric mean of the slopes on the cross direction and machine direction load-strain curves from a load of 0 to 50 g/in and a sample width of only 1 inch is used.

Throughout this specification and claims, where the absorbency of a product is mentioned, the absorbency is measured using a Third Generation Gravimetric Absorbency Testing System model M/K 241, available from M/K Systems Inc., Danvers, Mass. modified as follows: a customized sample holder is fabricated to accept the sample to be tested, a 50 mm diameter circular section of the base sheet or finished product, which is normally cut using a circular die. When base sheet intended for a two-ply product is tested, it is customary that two base sheet samples be inserted into the apparatus and tested together.

The sample holder consists of two parts, a base and a cover. The base is made from a circular piece of acrylic, six inches in diameter by one inch thick. The outer 0.3855 inch bottom side of the disk is removed to a depth of 0.75 inch. Removing this outer portion of the disk's bottom allows it to fit in the apparatus' base holder. In the center of the disk, a 0.118 inch diameter hole is drilled all the way through the disk to allow water to be conducted through the bottom of the base to the sample. On the bottom side of the base, this hole is enlarged by drilling for a distance of 0.56 inch using an 11/32 (0.34375) inch drill. This enlargement will be tapped to a depth of 0.375 inch to allow insertion of a tube fitting that will convey water through the base and to the sample.

On the top side of the base, a circular section 2.377 inches in diameter by 0.0625 inch deep is machined from the center of the base. Additional machining is done to cut a series of four concentric circular channels about the hole in the base's center. The innermost of these channels begins at a distance 0.125 inch from the center of the base and extends radially outward for a width of 0.168 inch. The second channel begins 0.333 inch from the center and also extends outward for 0.168 inch. The third channel begins 0.541 inch from the center and also extends outward for 0.168 inch. The fourth channel begins 0.749 inch from the base center and also extends outward for 0.168 inch. Each of the channels will extend to a depth of 0.2975 inch below the unmachined top surface of the base. In addition to the four channels described immediately above, a circular sample-holding ring that extends from a distance of 0.917 inch from the base center outward to a distance of 1.00 inch from the center is etched into the base. This ring extends an additional 0.01 inch below the surface of the 0.0625 inch cut described above; thus the bottom of this ring is 0.0725 inch below the unaltered top of the base. This ring is designed to contact the outer edge of the sample to be tested and to hold it in place.

The sample cover is also made of acrylic. It is circular with a diameter of 2.375 inches and a total thickness of 0.375 inch. The top of the cover is completely removed to a depth of 0.125 inch except for a circle in its center that is 0.625 inch in diameter. The center of this unremoved portion of the top is recessed to a depth of 0.0625 inch. The recess is circular and has a diameter of 0.375 inch.

The cover's bottom surface will contact the top surface of the sample being tested. A circular section in the center of the cover's bottom 0.250 inch in diameter and the cover's outer perimeter to a distance of 0.3125 inch from the cover edge is left unaltered. The remainder of the cover bottom is recessed to a depth of 0.1875 inch.

The sample cover as described above should have a weight of 32.5 grams. The dimensions of the top of the cover may be slightly modified to insure that the targeted weight is obtained. It should also be noted that all of the sample holder dimensions described above have a tolerance of 0.0005 inch.

In addition to the customized sample holder, the instrument must also be modified by fitting it with a pinch valve and a timing/control system. A suitable pinch valve is the model 388-NO-12-12-15 made by Anger Scientific. The pinch valve is located along the flexible tubing leading from the supply reservoir to the bottom of the sample holder base. It has been found that ¼" ID by ⅜" OD, 1/16" wall thickness Close Tolerance Medical Grade Silicone Tubing, T5715-124 S/P Brand, available from Baxter Laboratory, McGraw Park, Ill. is suitable for this application. When a test is initiated, the action of the valve momentarily constricts the tubing so that water is forced up to contact the bottom of the sample. The restriction time is limited to that which will allow the water to contact the sample without forcing water into the sample. After the contact has been made, the wicking action of the sample will allow water to continue to flow until the sample is saturated. To insure that the constriction time will be constant from test to test, the valve should be equipped with a timer control system. A suitable timer is the National Semiconductor Model LM 555.

To run an absorbency test, the height of the sample holder must be adjusted. The adjustment is made by placing a towel sample in the sample holder and lowering the holder until the sample begins to absorb water. The sample holder is then raised 5 mm above this level. After several samples have been run, the sample height will have to be adjusted, as the amount of water introduced from the make-up reservoir to the supply reservoir may not exactly match the amount of water absorbed by the sample.

The novel paper products prepared by utilizing the novel undulatory creping blade can be prepared using any suitable conventional furnish such as softwood, hardwood, recycle fibers, mechanical pulps, including thermo mechanical and chemi-thermo-mechanical pulp, anfractuous fibers and combinations of these.

In general, it is contemplated that neither a strength enhancing agent nor a softener/debonder is required to produce the web creped by the novel undulatory creping blade. However, if the furnish contains a large portion of hardwood, then it may be advantageous to use strength enhancing agents, preferably water soluble starch. The starch can be present in an amount of about 1 to 10 pounds per ton of the furnish. Alternatively, if the furnish contains a lot of coarse fibers, such as softwood or recycled fiber, it may be advantageous to employ a softener.

Some preferred softeners include Quasoft® 202-JR and 209-JR made by Quaker Chemical Corporation, which include a mixture of linear amine amides and imidazolines of the following structure:

(i)

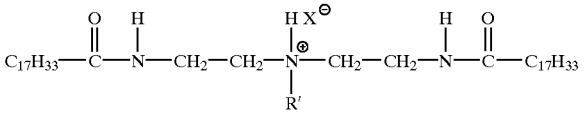

(ii)

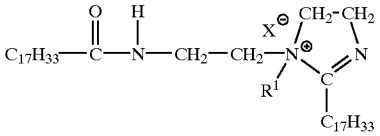

wherein X is an anion.

As the nitrogenous cationic softener/debonder reacts with a paper product during formation, the softener/debonder ionically attaches to cellulose and reduces the number of sites available for hydrogen bonding, thereby decreasing the extent of fiber-to-fiber bonding.

Quasoft® 202-JR and 209-JR are derived by alkylating a condensation product of oleic acid and diethylenetriamine. Synthesis conditions using a deficiency of alkylating agent (e.g., diethyl sulfate) and only one alkylating step, followed by Ph adjustment to protonate the non-ethylated species, result in a mixture consisting of cationic ethylated and cationic non-ethylated species. A minor proportion (e.g., about 10%) of the resulting amido amines cyclize to imidazoline compounds. Since these materials are not quaternary ammonium compounds, they are Ph-sensitive. Therefore, when using this class of chemicals, the Ph in the headbox should be approximately 6 to 8, more preferably 6 to 7 and most preferably 6.5 to 7.

Other suitable softeners and debonders are described in the patent literature. A comprehensive, but non-exhaustive list includes U.S. Pat. Nos. 4,795,530; 5,225,047; 5,399,241; 3,844,880; 3,554,863; 3,554,862; 4,795,530; 4,720,383; 5,223,096; 5,262,007; 5,312,522; 5,354,425; 5,145,737, 5,725,736, and EPA 0 675 225. The entire disclosures of each of these patents are incorporated herein by reference.

These softeners are suitably nitrogen containing organic compounds, preferably cationic nitrogenous softeners, and may be selected from trivalent and tetravalent cationic organic nitrogen compounds incorporating long fatty acid chains; compounds including imidazolines, amino acid salts, linear amine amides, tetravalent or quaternary ammonium salts, or mixtures of the foregoing. Other suitable softeners include the amphoteric softeners, which may consist of mixtures of such compounds as lecithin, polyethylene glycol (PEG), castor oil, and lanolin.

The present invention may be used with a particular class of softener materials—amido amine salts derived from partially acid neutralized amines. Such materials are disclosed in U.S. Pat. No. 4,720,383; column 3, lines 40–41. Also relevant are the following articles: Evans, *Chemistry and Industry,* Jul. 5, 1969, pp. 893–903; Egan, *J. Am. Oil Chemist's Soc.,* Vol. 55 (1978), pp.118–121; and Trivedi et al., *J. Am. Oil Chemist's Soc.,* June 1981, pp. 754, 756. All of the above are incorporated herein by reference. As indicated therein, softeners are often available commercially only as complex mixtures rather than as single compounds. While this discussion will focus on the predominant species, it should be understood that commercially available mixtures would generally be used to practice the invention.

The softener having a charge, usually cationic softeners, can be supplied to the furnish prior to web formation, applied directly onto the partially dewatered web, or applied by both methods in combination. Alternatively, the softener may be applied to the completely dried, creped sheet, either on the paper machine or during the converting process. Softeners having no change are applied at the dry end of the paper making process.

The softener employed for treatment of the furnish is provided at a treatment level that is sufficient to impart a perceptible degree of softness to the paper product but less than an amount that would cause significant runnability and sheet strength problems in the final commercial product. The amount of softener employed, on a 100% active bases, is preferably from about 1 pound per ton of furnish up to about 25 pounds per ton of furnish. More preferred is from about 2 to about 15 pounds per ton of furnish.

Treatment of the wet web with the softener can be accomplished by various means. For instance, the treatment step can comprise spraying, applying with a direct contact applicator means, or by employing an applicator felt. When applying the softener after the web is formed, it can be sprayed with at least about 0.5 to about 3.5 lbs/ton of softener, more preferably about 0.5 to about 2.0 lbs/ton of softener. Alternatively, a softener may be incorporated into the wet end of the process to result in a softened web.

Imidazoline-based softeners that are added to the furnish prior to its formation into a web have been found to be particularly effective in producing soft tissue products and constitute a preferred embodiment of this invention. Of particular utility for producing the soft tissue product of this invention are the cold-water dispersible imidazolines. These imidazolines are mixed with alcohols or diols, which render the usually insoluble imidazolines water dispersible. Representative initially water insoluble imidazolines rendered water soluble by the water soluble alcohol or diol treatment include Witco Corporation's Arosurf PA 806 and DPSC 43/13, which are water dispersible versions of tallow and oleic-based imidazolines, respectively.

Treatment of the partially dewatered web with the softener can be accomplished by various means. For instance, the treatment step can comprise spraying, applying with a direct contact applicator means, or by employing an applicator felt. It is often preferred to supply the softener to the air side of the webs so as to avoid chemical contamination of the paper making process. It has been found in practice that a softener applied to the web from either side penetrates the entire web and uniformly treats it.

Useful softeners for spray application include softeners having the following structure:

$$[(RCO)_2EDA]HX$$

wherein EDA is a diethylenetriamine residue, R is the residue of a fatty acid having from 12 to 22 carbon atoms, and X is an anion or $$[(RCONHCH_2CH_2)_2NR']HX$$

wherein R is the residue of a fatty acid having from 12 to 22 carbon atoms, R' is a lower alkyl group, and X is an anion.

More specifically, preferred softeners for application to the partially dewatered web are Quasoft® 218, 202, and 209-JR made by Quaker Chemical Corporation, which contain a mixture of linear amine amides and imidazolines.

Another suitable softener is a dialkyl dimethyl fatty quaterary ammonium compound of the following structure:

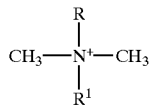

wherein R and $R^1$ are the same or different and are aliphatic hydrocarbons having fourteen to twenty carbon atoms, preferably the hydrocarbons are selected from the following $C_{16}H_{35}$ and $C_{18}H_{37}$.

A new class of softeners are imidazolines, which have a melting point of about 0°–40° C. in aliphatic diols, alkoxylated aliphatic diols, or a mixture of aliphatic diols and alkoxylated aliphatic diols. These are useful in the manufacture of the tissues of this invention. The imidazoline moiety in aliphatic polyols, aliphatic diols, alkoxylated aliphatic polyols, alkoxylated aliphatic diols or in a mixture of these compounds, functions as a softener and is dispersible in water at a temperature of about 1° C. to about 40° C. The imidazoline moiety is of the formula:

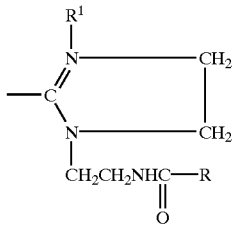

wherein X is an anion and R is selected from the group of saturated and unsaturated parafinic moieties having a carbon chain of $C_{12}$ to $C_{20}$ and $R^1$ is selected from the groups of methyl and ethyl moieties. Suitably the anion is methyl sulfate of the chloride moiety. The preferred carbon chain length is $C_{12}$ to $C_{18}$. The preferred diol is 2, 2, 4 trimethyl 1, 3 pentane diol, and the preferred alkoxylated diol is ethoxylated 2, 2, 4 trimethyl 1, 3 pentane diol. A commercially available example of the type of softener is AROSURF® PA 806 manufactured by Witco Corporation of Ohio.

Preferred Softeners and debonders also include Quasoft®206, Quasoft®216, Quasoft®228, Quasoft®230, and Quasoft®233, manufactured by the Quaker Chemical Company of Conshohocken, Pennsylvania, and Varisoft®475, Varisoft®3690, and Arosurf® PA 806, which are available from Witco of Ohio.

To facilitate the creping process, adhesives are applied directly to the Yankee. Usual paper making adhesives are suitable. Preferable nitrogen containing adhesives include glyoxylated polyacrylamides and polyaminoamides. Blends such as the gloyoxylated polyacrylamide blend comprise at least of 40 weight percent polyacrylamide and at least 4 weight percent of glyoxal. Polydiallyldimethyl ammonium chloride is not needed for use as an adhesive, but it is found in commercial products and is not detrimental to our operations.

The preferred blends comprise about 2 to about 50 weight percent of the glyoxylated polyacrylamide, about 40 to about 95 percent of polyacrylamide.

Suitable polyaminoamide resins are disclosed in U.S. Pat. No. 3,761,354, the disclosure of which is incorporated herein by reference. The preparation of polyacrylamide adhesives is disclosed in U.S. Pat. No. 4,217,425, the disclosure of which is incorporated herein by reference.

Other suitable adhesives are disclosed in U.S. Pat. Nos. 5,730,839; 5,494,554; 5,468,796, 5,833,806, 5,944,954; 5,865,950; 4,064,213; 4,063,995; 4,304,625; 4,436,867; 4,440,898; 4,501,640; 4,528,316; 4,684,439; 4,788,243; 4,883,564; 4,886,579; 4,994,146; 5,025,046; 5,187,219; 5,246,544; 5,370,773; 5,326,434; 5,374,334; 5,382,323; 5,468,796; 5,490,903; 5,635,028; 5,660,687; 5,833,806, 5,786,429; 5,902,862; 5,837,768; 5,858,171, as well as Billmeyer, *Textbook of Polymer Science,* 3rd Ed., 1984, pp.151–154, the entire disclosures of which are incorporated herein by reference.

EXAMPLE 1

This example illustrates the advantages of the undulatory creping blade over conventional blade and a blade following the teachings disclosed in U.S. Pat. No. 3,507,745 to Fuerst. Towel and tissue base sheets were made on a crescent former pilot paper machine from a furnish consisting of 50% Northern Softwood Kraft, 50% Northern Hardwood Kraft. Three different crepe blades were used to crepe the product from the Yankee dryer: a square control (i.e., conventional) creping blade, a blade which we made following the teachings of the Fuerst patent, and the creping blade of the present invention. The blade we made following the Fuerst patent had a 70° blade bevel, a notch depth of 0.005 inch, and a notch width of 0.3125 inch, which corresponds to our best understanding of the teachings therein. The creping blade of the present invention had a 25° bevel, a notch depth of 0.020 inch, and a notch frequency of 20 notches/inch.

When the blade made following the Fuerst patent was initially inserted into the creping blade holder, the sheet produced by the blade contained many holes and could not be wound onto the reel. It was found that it was necessary to allow the blade to "run-in," as taught in Fuerst, by running it against the Yankee dryer for approximately 20 minutes before a sheet could be successfully threaded and wound onto the reel. This run-in time, which Fuerst describes as being necessary to successful operation, represents a substantial loss of production and contrasts sharply with our experience with creping blades of the present invention, which can normally be used to produce product directly after insertion into a blade holder.

FIG. 7 shows a schematic representation of a blade holder or mount 118. The mount 118 is preferably located adjacent to the rotatable cylinder 30 so that the creping blade 20 is positioned for creping cellulosic web from the cylinder 30 when the blade 20 is placed in the mount 118.

Towel base sheets were made on a crescent former pilot paper machine using the 50% Northern Softwood Kraft, 50% Northern Hardwood Kraft furnish. Sixteen pounds of wet strength resin (aminopolyamide-epichlorohydrin Kymene® 557H manufactured by Hercules) per ton of pulp was added to the furnish. The sheets were all made using a 20% crepe. The percent crepe is obtained by dividing the difference between the Yankee dryer speed and the reel speed, by the Yankee dryer speed, and then expressing the result as a percentage (i.e., multiplying by 100). The product was creped using the three different crepe blades described above. For the sheets made using the control creping blade and the creping blade of the present invention, base sheets were made at several strength levels,, with refining being used to vary the tissue's strength. The product creped using the Fuest blade was made at a single strength level.

Figure 18:
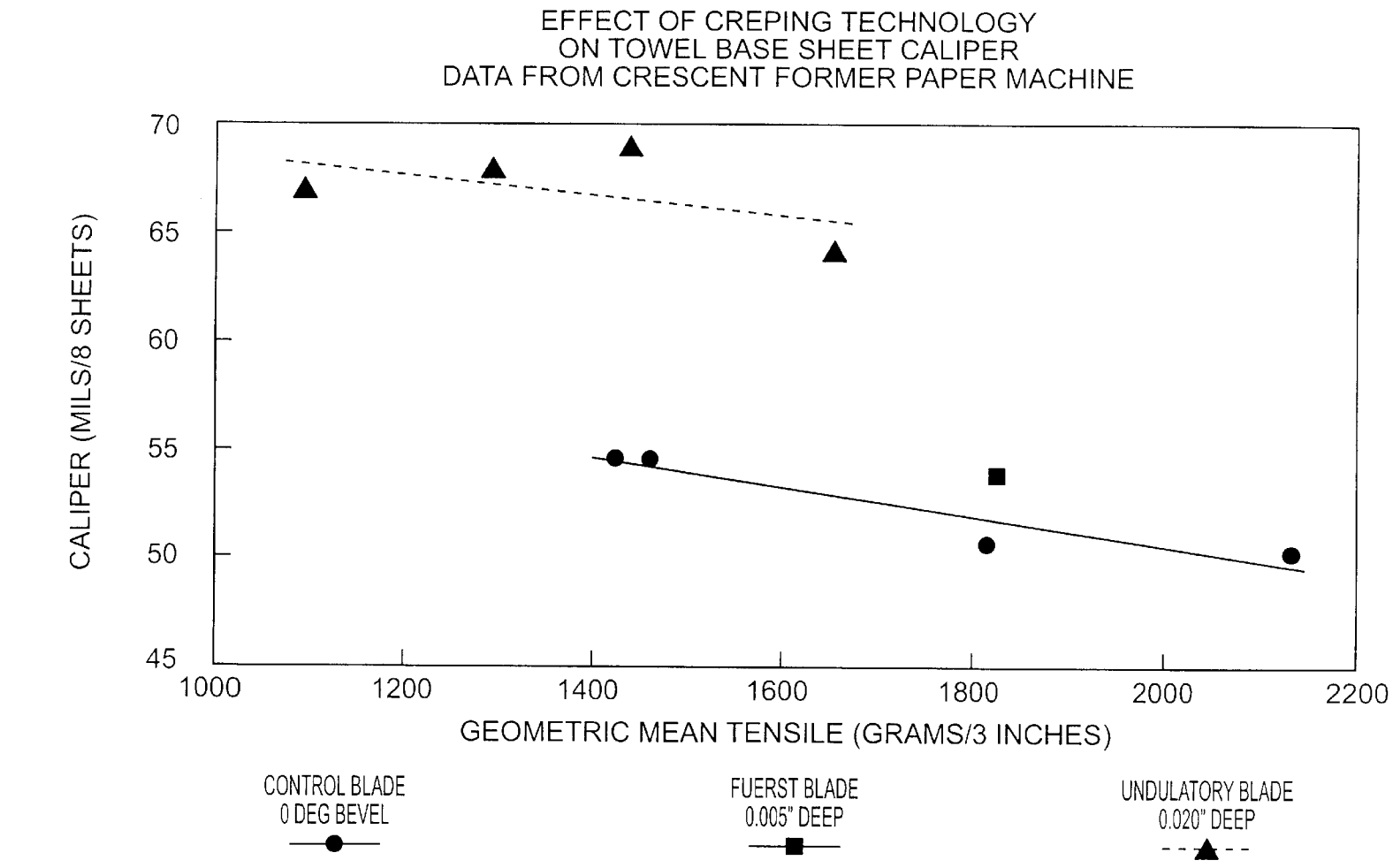
FIG. 18 is a graph of caliper (i.e., bulk) versus geometric mean tensile strength comparing creped paper manufactured with one of the creping blades of the invention, a conventional creping blade, and the Fuerst blade.

The calipers of the base sheets as functions of the sheets' tensile strengths are plotted in FIG. 18. From the figure it can be seen that the base sheet made using the crepe blade described in the Fuerst patent resulted in little or no increase in specific caliper versus the control product. On the other hand, the base sheets made using the creping blade of the present invention exhibited caliper values 15 to 20 percent higher than those of the control.

Figure 19:
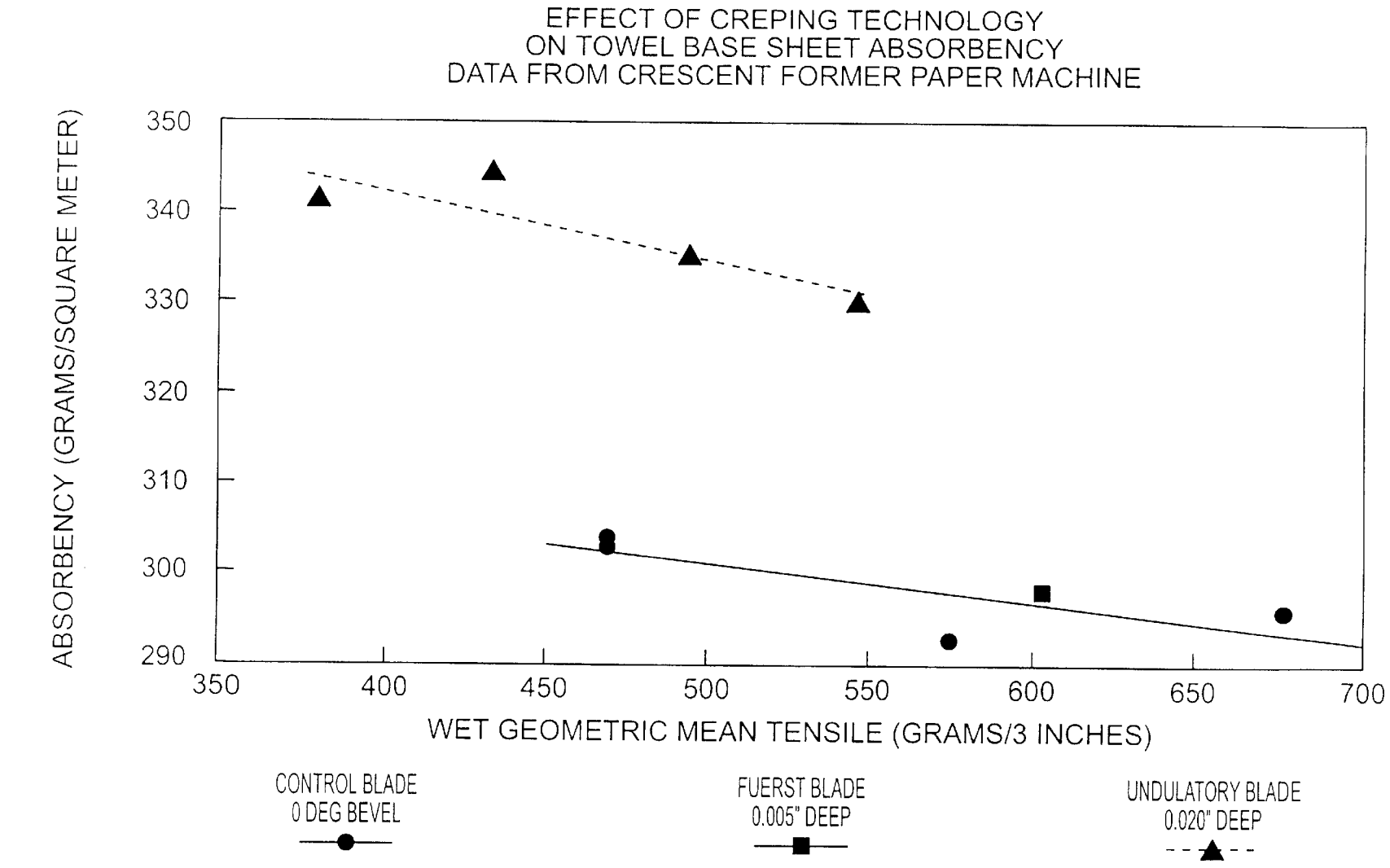
FIG. 19 is a graph of absorbency versus wet geometric mean tensile strength comparing creped paper manufactured with one of the creping blades of the invention, a conventional creping blade, and the Fuerst blade.

FIG. 19 shows the absorbency of the three products as a function of their wet tensile strength. The plot indicates that the sheet made using the Fuerst blade has an absorbency value that is similar to those exhibited by the control products. The towel base sheets made using the creping blade of the present invention, on the other hand, exhibit about a 10% gain in absorbency.

Tissue base sheets were made at a targeted weight of 18 lbs/ream from the same furnish using the three creping technologies. Both uncalendered and calendered sheets were produced. The calendered sheets were all calendered at the same calender loading—10.9 pli. The sheets were all made using 23% reel crepe. The physical properties of the uncalendered and calendered base sheets are shown in Table 1.

TABLE 1

Physical Properties of Tissue Base Sheets

| | Creping Blade Type | | | | | |
|---|---|---|---|---|---|---|
| | Control | | Fuerst | | Undulatory | |
| Calendering-(pli) | — | 10.9 | — | 10.9 | — | 10.9 |
| Basis Weight (lbs/ream) | 17.65 | 17.44 | 18.24 | 17.93 | 17.63 | 17.20 |
| Caliper (miles/8 sheets) | 56.5 | 45.1 | 65.6 | 48.6 | 83.6 | 54.0 |
| Specific Caliper (mils/8 sheets/lb basis weight) | 3.20 | 2.59 | 3.60 | 2.71 | 4.74 | 3.14 |
| MD Tensile (grams/3 inches) | 1275 | 1386 | 1224 | 1140 | 981 | 893 |
| CD Tensile (grams/3 inches) | 972 | 1049 | 868 | 913 | 740 | 639 |
| MD Stretch (%) | 34.4 | 31.3 | 33.7 | 31.5 | 32.3 | 30.6 |
| CD Stretch (%) | 4.1 | 4.1 | 3.8 | 4.3 | 6.2 | 5.8 |
| Tensile Modulus (grams/inch/%) | — | 26.0 | — | 24.5 | — | 19.5 |
| Friction Deviation | — | 0.236 | — | 0.222 | — | 0.206 |

As can be seen from the Table 1, the uncalendered product produced using the blade made according to the Fuerst patent had a higher uncalendered caliper than did the control sheet. However, after calendering, the sheet made using the Fuerst crepe blade exhibited only a small gain (approximately 5%) in caliper over the caliper of the control product. The product made using the creping blade of the present invention, on the other hand, not only exhibited a gain in caliper over the control for the uncalendered sheet, but maintained a substantial gain (almost 20%) in caliper even after calendering. The product made using the blade of the present invention, however, has a lower strength than the control.

Tissue base sheets of a lower basis weight were also made on the pilot paper machine from the same furnish. The sheets were all made using a 36% crepe and were calendered at a calender loading of 10.9 pli. Uncalendered samples were also made. The three different crepe blades described above in Example 1 were used to crepe the product from the Yankee dryer. The physical properties of the uncalendered and calendered base sheets are shown in Table 2.

As was the case for the 18 lb/ream sheets, the tissue made using the Fuerst blade exhibited a higher uncalendered caliper than did the control; however, this advantage is substantially negated by calendering. The calendered sheet made using the creping blade of the present invention, on the other hand, had a caliper approximately 20% higher than that of the control, even after calendering. Also, the tissue base sheet made using the blade described in the Fuerst patent exhibited a friction deviation value that was approximately 35% higher than that measured for either the control or sheets produced using the creping blade of the present invention. This higher friction deviation value will adversely impact the perceived surface softness of products produced from this base sheet.

TABLE 2

Physical Properties of Tissue Base Sheets

| | Creping Blade Type | | | | | |
|---|---|---|---|---|---|---|
| | Control | | Fuerst | | Undulatory | |
| Calendering-(pli) | — | 10.9 | — | 10.9 | — | 10.9 |
| Basis Weight (lbs/ream) | 11.57 | 11.37 | 11.68 | 11.16 | 11.08 | 11.15 |
| Caliper (miles/8 sheets) | 47.8 | 34.9 | 55.3 | 36.4 | 70.6 | 41.7 |
| Specific Caliper (mils/8 sheets/lb basis weight) | 4.13 | 3.07 | 4.75 | 3.26 | 6.37 | 3.74 |
| MD Tensile (grams/3 inches) | 368 | 428 | 322 | 389 | 310 | 290 |
| CD Tensile (grams/3 inches) | 466 | 641 | 477 | 615 | 462 | 428 |
| MD Stretch (%) | 49.4 | 45.7 | 49.3 | 45.3 | 47.8 | 42.4 |
| CD Stretch (%) | 3.1 | 4.3 | 3.3 | 4.5 | 6.7 | 5.8 |
| Tensile Modulus (grams/inch/%) | — | 13.4 | — | 12.3 | — | 8.0 |
| Friction Deviation | — | 0.185 | — | 0.260 | — | 0.192 |

Uncalendered base sheet samples of the towel and tissues produced using the creping blade of the present invention and those made using the Fuerst blade were tested using Fourier analysis. In this analysis, a sample of base sheet measuring 5.88 cm square was illuminated using low-angle lighting along the sheet's cross direction. The image of the shadows cast on the sheet by this lighting were then analyzed using discrete two-dimensional Fourier transforms to detect the presence of any periodic structures in the sheet.

Because of the direction of the illumination, structures in the sheets' machine direction are highlighted.

Figure 51A:
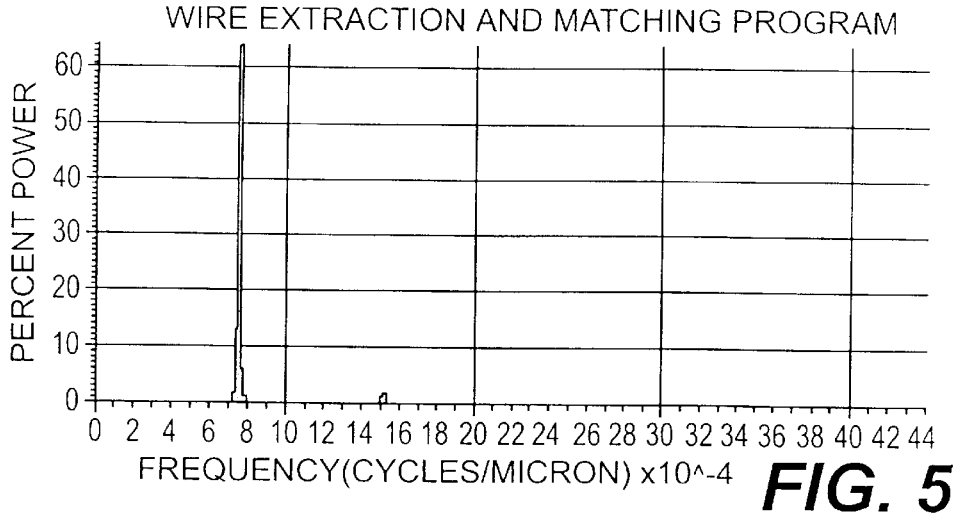
FIGS. 51A–51F compare the results of Fourier analysis of webs creped using one of the creping blades of the invention and the Fuerst blade.
Figure 51B:
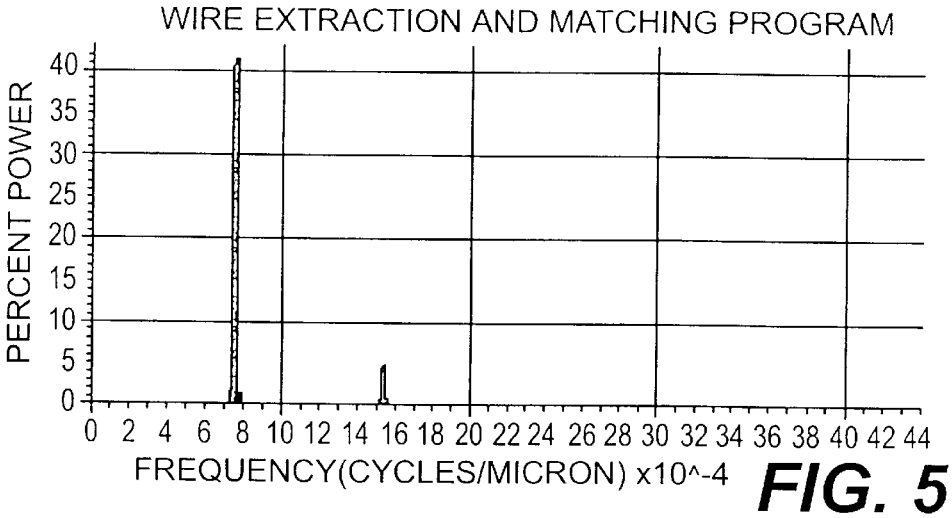
Figure 51C:
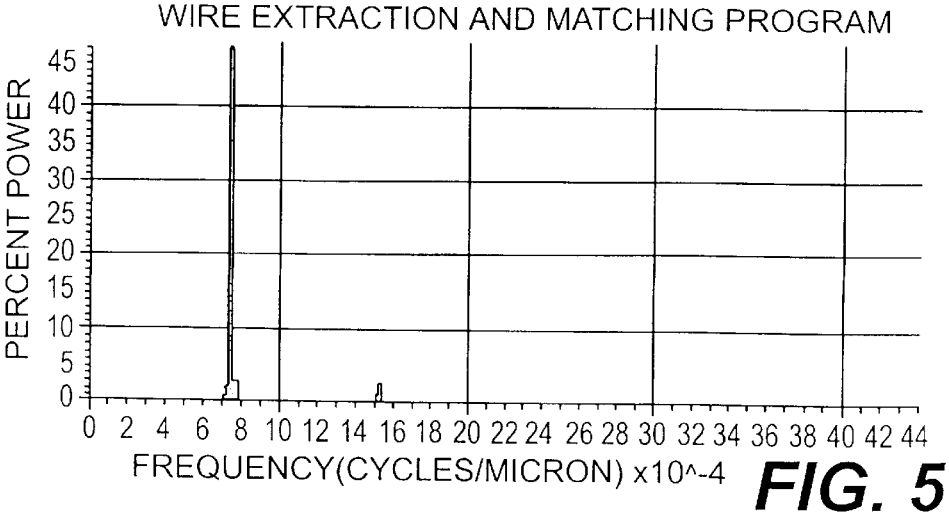
Figure 51D:
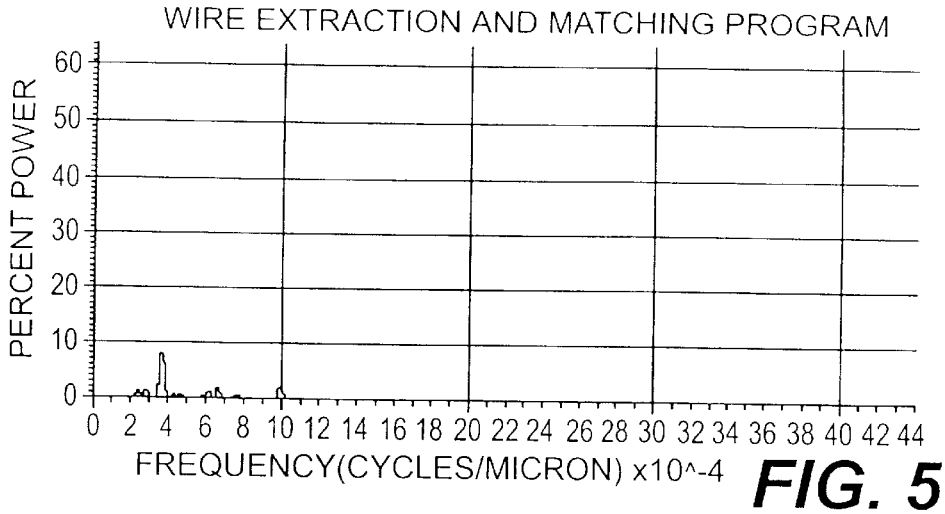
Figure 51E:
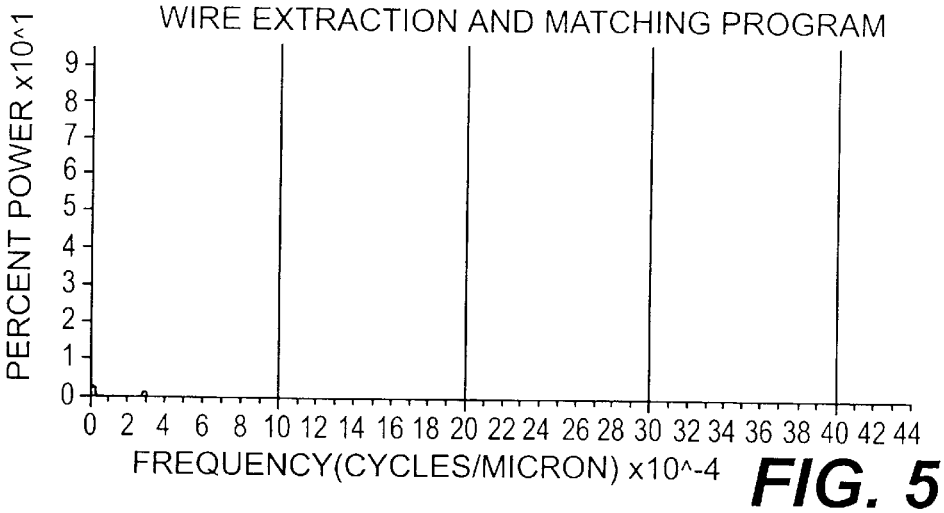
Figure 51F:
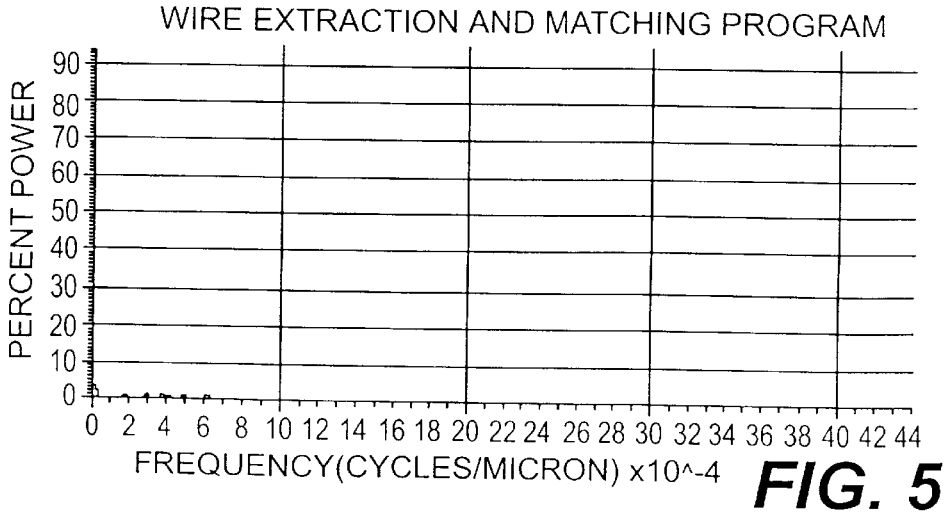

The results of this analysis are shown in FIGS. 51A–F. FIGS. 51A, 51B, and 51C show the frequency spectra for the towel, high-weight tissue, and low-weight tissue samples, respectively, that were creped using the creping blade of the present invention, while FIGS. 51D, 51E, and 51F show the frequency spectra for the same products that were produced using the Fuerst blade. All three products creped with the creping blade of the present invention show a dominant peak at a frequency in the range of 0.00075 to 0.0008 cycles/micron. This frequency is equivalent to about 19 to 20 cycles/inch, which corresponds to the blade's notch frequency of 20 notches/inch. The spectra for the products produced using the Fuerst blade, on the other hand, show little or no evidence of a dominant frequency. Instead, the results of the analysis indicate a sheet that is more-or-less uniform in the cross direction, similar to the results that would be expected from a sheet creped using a standard creping blade. This analysis again demonstrates the differences in tissue sheets produced using the creping blade of the present invention to those creped using blades of the prior art.

EXAMPLE 2

Effect of Blade Parameters on Product Properties

To properly choose a creping blade for an application, the principal blade parameters that should be specified include the notch depth, the notch frequency, and the blade bevel angle. The choice of the blade parameter combination will depend on the desired properties for the particular product being made. In general, the base sheet specific caliper of a product will increase with increasing notch depth. This effect can be seen in FIGS. 21 and 22, which plot the uncalendered specific caliper of the single-ply tissue base sheets as a function of the base sheets'strength. It can be seen that increasing the notch depth from 0.010 to 0.020 inch has resulted in a specific caliper increase for base sheets made using both a 15° and a 25° beveled blade. However, it has been found that, at large notch depths, the specific caliper of the base sheet may actually decrease as the notch depth increases. It is believed that at these extreme notch depths, the loss of strength resulting from use of the creping blade begins to overcome its caliper-enhancing features.

Table 3 illustrates this point. Two-ply base sheets made from a furnish containing 60% Southern Hardwood kraft, 30% Northern Softwood Kraft, and 10% Broke were produced on a pilot paper machine, which is a crescent former. The products were all made at the same targeted basis weight and to the same targeted strength. Both a standard 0° creping blade and several creping blades of the present invention having various configurations were employed in the creping operation. After creping, the sheets were calendered to the same targeted caliper.

TABLE 3

| | Properties of Two-Ply Tissue Base Sheets | | | | | | |
|---|---|---|---|---|---|---|---|
| | Blade Bevel (degrees) | | | | | | |
| | 0 | 15 | 15 | 35 | 35 | 15 | 25 |
| Notch frequency (lines/inch) | 0 | 12 | 30 | 12 | 30 | 12 | 20 |
| Notch depth (inches) | 0 | 0.010 | 0.010 | 0.010 | 0.010 | 0.030 | 0.020 |
| Basis Weight (lbs/ream) | 9.40 | 9.31 | 9.11 | 9.33 | 9.41 | 9.38 | 9.37 |
| Caliper (mils/8 sheets) | 27.9 | 28.0 | 27.2 | 28.1 | 28.2 | 29.4 | 28.6 |
| Specific Caliper (mils/8 sheets/lb basis weight) | 2.97 | 3.01 | 2.99 | 3.01 | 3.00 | 3.13 | 3.05 |
| GM Tensile (grams/3 in) | 388 | 387 | 411 | 362 | 397 | 386 | 371 |
| Calender Loading (pli) | 9.3 | 10.9 | 12.1 | 10.9 | 12.1 | 12.1 | 15.1 |

Table 3 shows that, for all of the sheets produced with creping blades of the present invention, the calender pressure loading required to obtain the caliper target was greater than that required for calendering the control sheet, indicating that the uncalendered sheets made using the creping blades of the present invention were thicker than the uncalendered control sheet. It can also be seen from the table that increasing the notch frequency from 12 to 30 notches/inch or increasing the notch depth from 0.010" to 0.020" or even 0.030" resulted in a higher calender pressure being needed to bring the sheet to the targeted caliper. It should also be noted that the change in blade bevel does not seem to have significantly affected the calender pressure needed to achieve the desired sheet thickness.

The trend of increased specific caliper with increased notch depth, however, is not seen when the depth is increased. to 0.030 inch. For this product, the calender pressure needed to bring the base sheet to the targeted level was similar to that needed for the sheets made using an creping blade having a notch depth of 0.010 inch, indicating that the two sheets' uncalendered calipers are similar.

Figure 26:
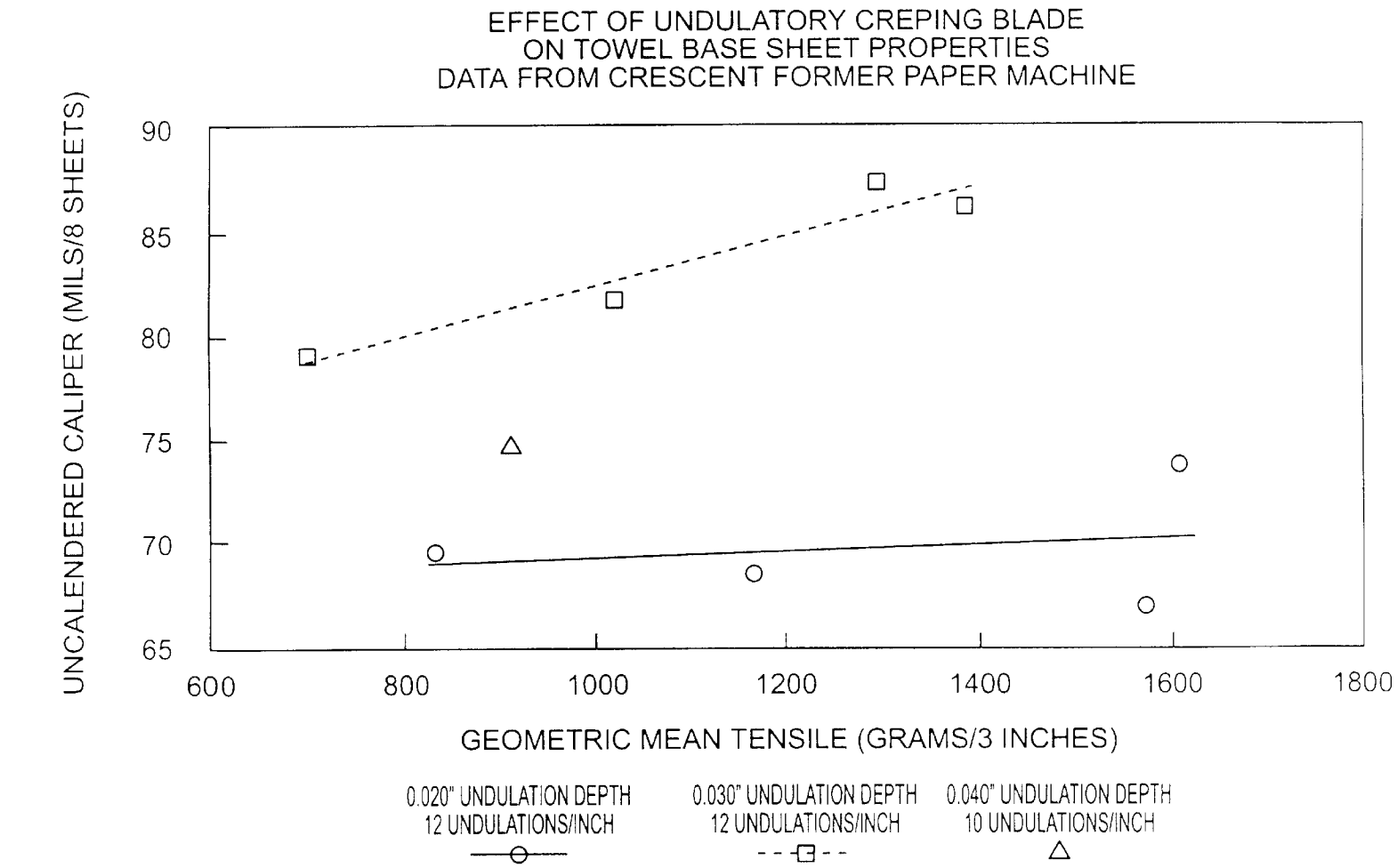
FIGS. 26 through 30 are graphs comparing various physical properties of base sheets and embossed products made using creping blades having a variety of configurations.

This same effect can also be seen in FIG. 26, which plots uncalendered calipers of towel base sheets as a function of their tensile strength. These base sheets were made to a targeted basis weight of 16 lbs/ream. The furnish was 70% Southern Hardwood Kraft, 30% Southern Softwood Kraft. Twelve pounds of wet strength resin per ton of pulp was added to the furnish.

As can be seen from FIG. 26, increasing the notch depth from 0.020 inch to 0.030 inch resulted in an increase in the base sheet specific caliper. However, when the notch depth was further increased to 0.040 inch, the sheet's specific caliper actually fell below that seen for a sheet of similar strength made using a 0.030-inch notch depth. It should be noted that the sheet made using the 0.040-inch notch depth has ten notches per inch as opposed to the 12 notches per inch for the products made at 0.020- and 0.030-inch depths. However, it is not believed that this small difference in notch frequency will have a significant effect on specific caliper, and, in any case, any specific caliper loss due to a decreased notch frequency would be expected to be more than compensated for by the increased notch depth.

Figure 27:
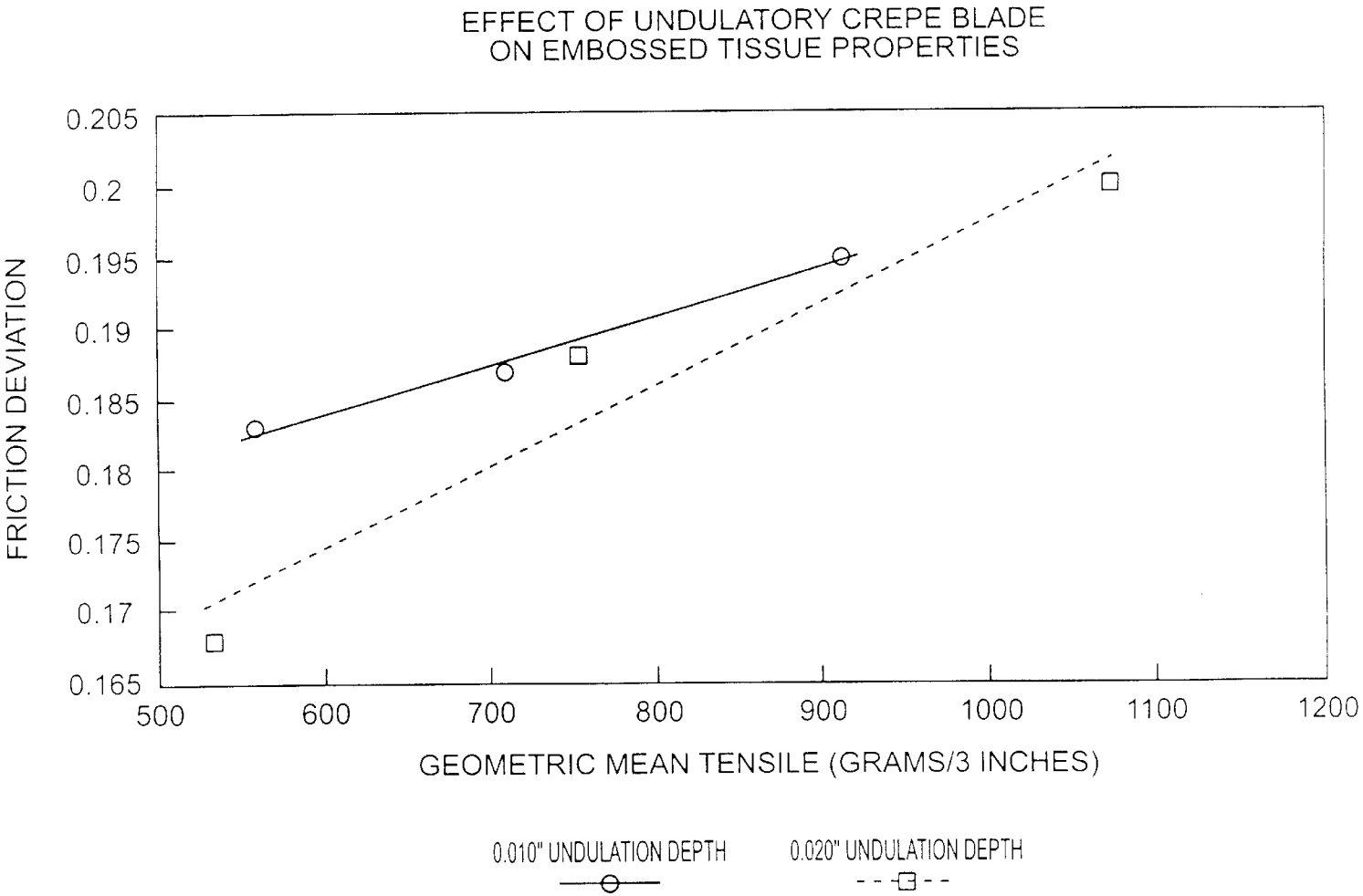

As additional evidence of the effect of notch depth on tissue properties, it has been found that, for single-ply CWP tissue products, an increase in the blade's notch depth can correspond to a reduction in the friction deviation of the embossed finished product. This reduction, which correlates to an increase in surface softness, can be seen in FIG. 27, which plots the products friction deviation as a function of the tissue's strength. These tissues were made from a furnish consisting of 50% Northern Softwood Kraft, 50% Northern Hardwood Kraft and were all calendered using a calender pressure of 10.8 pli. The base sheets were then embossed using a spot emboss pattern at an emboss depth of 0.075 inch. It can be seen that the products made using the creping blade of the present invention having a 0.020-inch notch depth have lower friction deviations, and thus better surface softness properties than do the products made using a blade that had a notch depth of 0.010 inch. This improvement in product softness is probably due to the additional calendering action applied to the increased caliper of the base sheet made using the 0.020-inch depth blade.

The notch frequency also has an impact on the properties of the towel and tissue products made using the creping blade. As was noted above, for the two-ply tissue base sheets, increasing the number of notches per inch from 12 to 30 necessitated an increase in calendering pressure to achieve a targeted caliper level.

Figure 28:
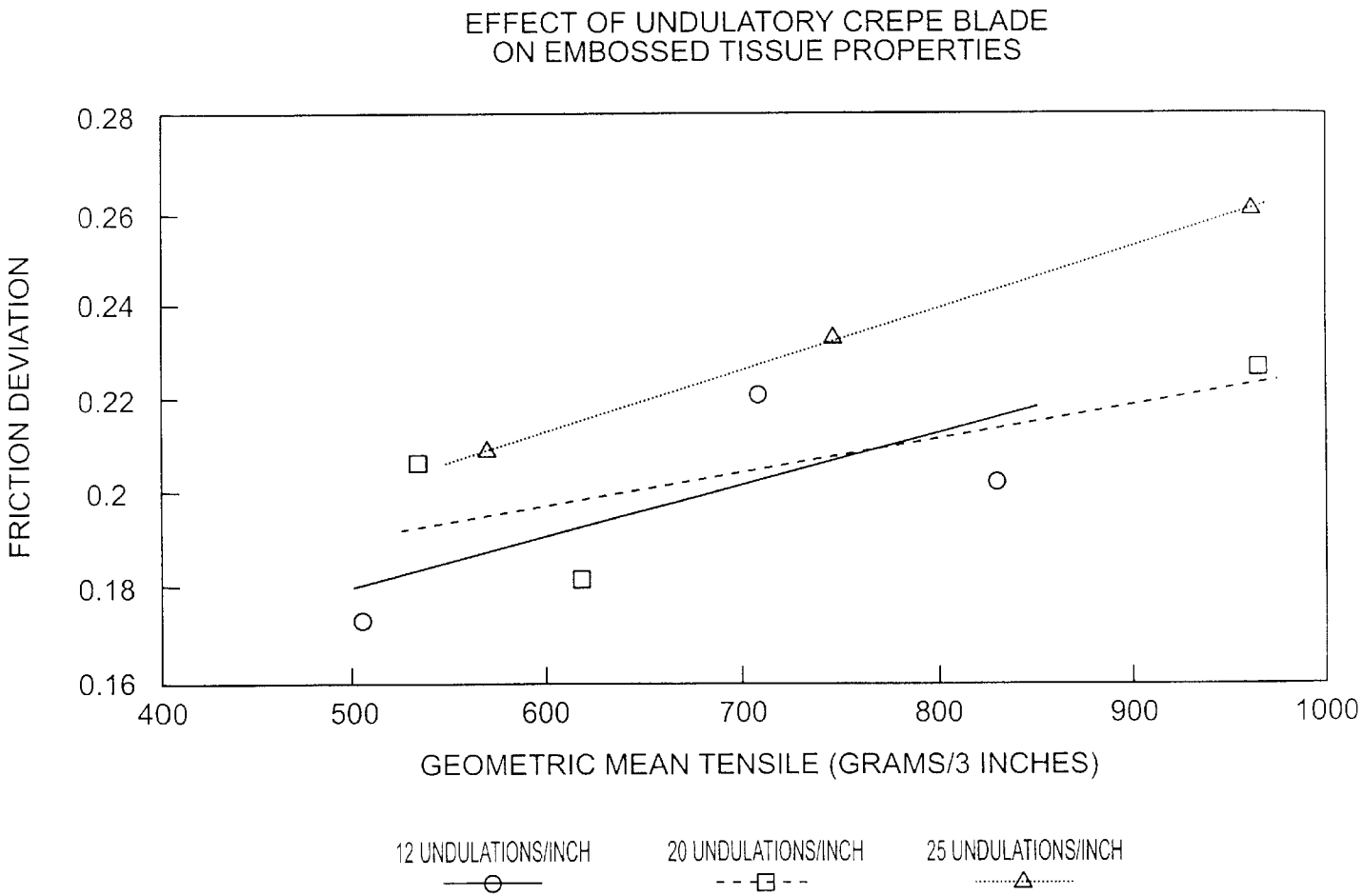

For the single-ply tissue product described above, changing the notch frequency had no substantial impact on the base sheet specific caliper. However, other tissue properties were affected. Tissue sheets were made at a notch depth of 0.010 inch having several notch frequencies. The base sheets were all calendered at the same level (10.8 pli) and embossed using a spot emboss at a 0.075-inch emboss depth. FIG. 28 shows the friction deviation of the embossed products as a function of the product strength. Although there is scatter in the data, it can be seen that increasing the notch frequency from 12 to 25 notches per inch seems to have resulted in an increase in product friction deviation, correlating to a decrease in surface softness.

Another important product aspect that will be impacted by the notch frequency is that of appearance. Even after calendering and embossing operations, the machine direction ridges produced by the creping blade of the present invention can be seen in the product. The pattern produced in the product by the blade of the present invention, especially when overlaid by an emboss pattern, will impact the product's appearance and may influence its acceptance by consumers.

Figure 29:
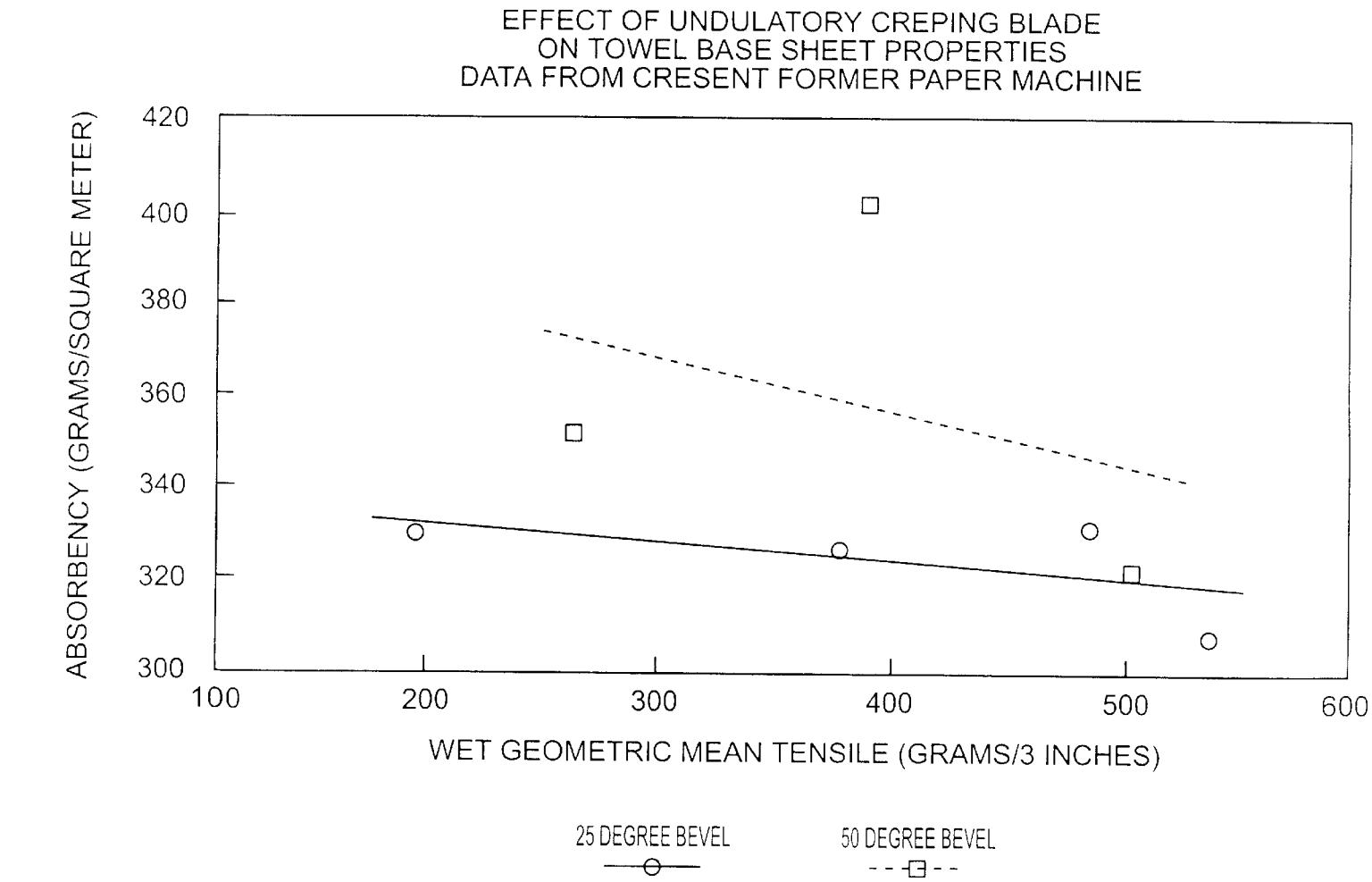
Figure 30:
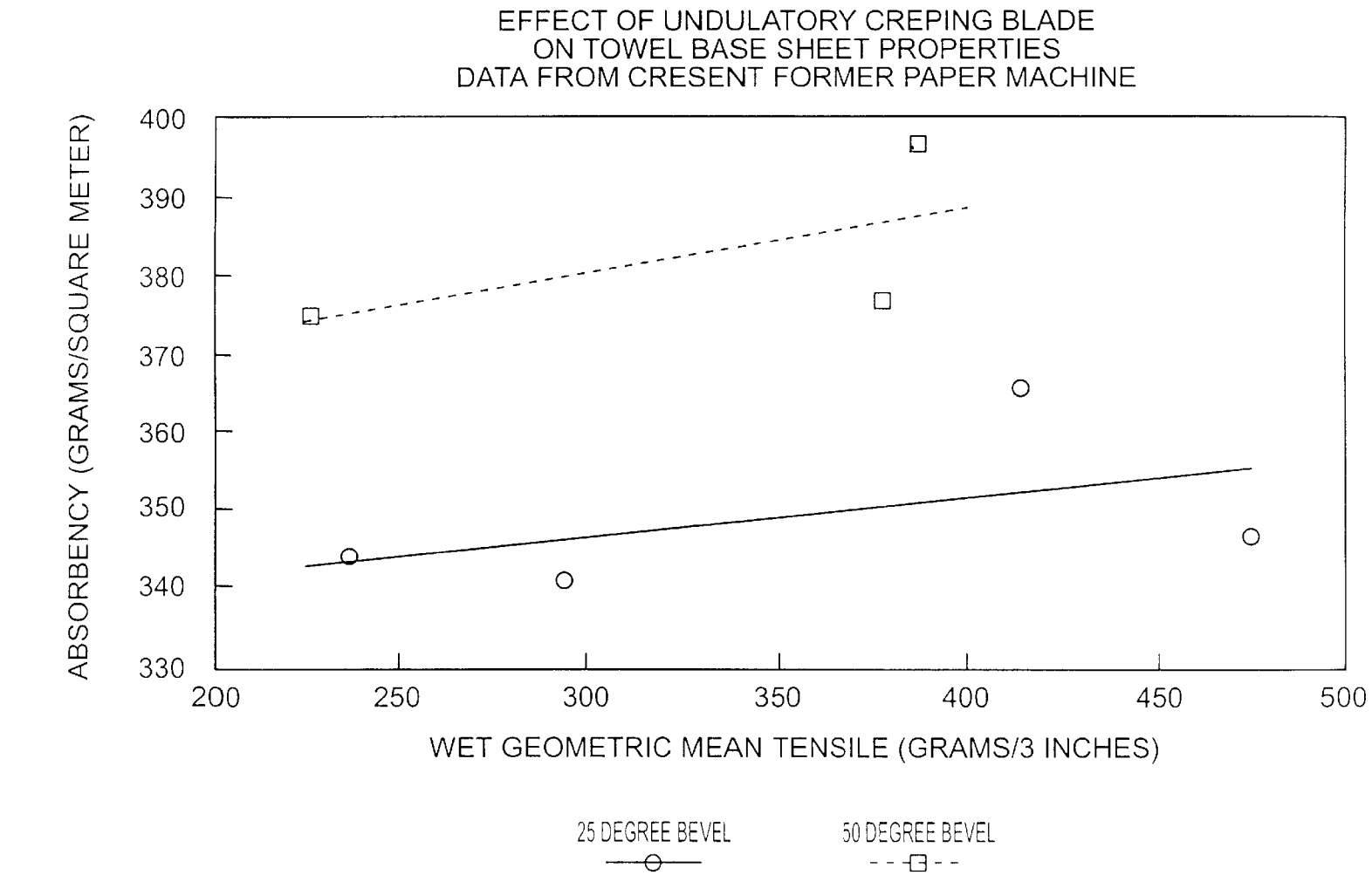

The other important blade parameter, blade bevel, has been shown to impact the absorption properties of towel base sheets. FIGS. 29 and 30 illustrate the finding that increasing the blade bevel from 25° to 50° has resulted in an increase in absorptive capacity or the towel base sheets for undulatory creping blades having notch depths of 0.020 and 0.030 inch.

Changing the blade bevel appears to have less of an effect on single- and two-ply tissues' thickness and softness properties. However, the choice of blade bevel will have an impact on the ease with which a blade having a desired notch depth and frequency can be made. Especially at the deeper notch depths, the knurling process is facilitated by use of blades having a greater bevel angle, as it is necessary to deform and displace less metal during the knurling process.

It should also be noted that the choice of blade bevel can also impact the ease with which a particular product can be made. For the two-ply base sheets discussed above, it was noted that tissue sheets were made using a blade having a 15° bevel, a notch depth of 0.030 inch, and a notch frequency of 12 notches per inch. An attempt was made to produce a similar product using a blade having the same notch depth and frequency, but a blade bevel of 35°. This attempt was unsuccessful as the sheet produced by this blade had numerous holes, with resulting low strength and poor runnability. Thus, as described herein, for some products, certain combination of blade parameters will prove less practical as they will either fail to easily produce product or will manufacture sheets of inferior quality. Desirable combinations of blade parameters may be easily identified by routine experimentation guided by the principles taught herein.

From the above discussion, it can be seen that the particular combination of notch frequency, notch depth, and crepe blade bevel angle that is chosen for a particular application will depend on the particular product being made (tissue, towel napkin, etc), the basis weight of the product, and what properties (thickness, strength, softness, absorbency) are most important for that application. For most tissue and towel products, it is believed that blade bevels in the range of 0° to 50°, notch frequencies of 5 to 50 notch/inch, and notch depths of 0.008 to 0.050 inch are most preferable. These ranges, however, are merely exemplary, and one of ordinary skill in the art would recognize that the invention.could be practiced in certain regions outside of these ranges.

EXAMPLE 3

This example illustrates the use of a creping blade of the present invention wherein the notches are cut at a side relief angle of about 35°. Tissue base sheets were made from a furnish containing 50% Northern Softwood Kraft, 50% Northern Hardwood Kraft. The sheets were creped from the Yankee dryer at 20% crepe using creping blades of the present invention. The blades both had a bevel angle of 25°, a notch frequency of 16 notches/inch and a notch depth of 0.025 inch. For one of the blades, the notches were perpendicular to the back surface of the blade yielding what we prefer to call right angle notches, i.e., the axes of symmetry of the notches were substantially perpendicular to the adjacent side face of the blade, as shown in FIG. 5F. For the other blade, the notches were cut at a side relief angle of 35°, as shown in FIG. 5G. The physical properties of the uncalendered sheets produced using these blades are shown in Table 4. For reference, a base sheet at approximately the same strength using a control (square) crepe blade is also included.

TABLE 4

Physical Properties of Tissue Base Sheets

| | Blade Type | | |
|---|---|---|---|
| | Control | Undulatory | Undulatory |
| Side Relief Angle (°) | — | 0 | 35 |
| Basis Weight (lbs/ream) | 17.42 | 16.6 | 17.13 |
| Caliper (mils/8 sheets) | 62.6 | 79.3 | 68.8 |
| Specific Caliper (mils/8 sheets/lb basis weight) | 3.59 | 4.78 | 4.02 |
| MD Tensile (grams/3 inches) | 1689 | 1711 | 1614 |
| CD Tensile (grams/3 inches) | 778 | 788 | 858 |
| MD Stretch (%) | 29.7 | 29.0 | 27.3 |
| CD Stretch (%) | 5.1 | 6.5 | 6.0 |

From the table it is clear that use of either blade resulted in an increase in specific caliper relative to the control sheet. However, the blade having a side relief angle of 0° produced a higher gain in specific caliper over the control blade than did the blade in which the side relief angle was 35°.

EXAMPLE 4

This example illustrates the higher uncalendered specific caliper obtained in sheets made using the blade of the present invention. Tissue base sheets were manufactured on a crescent former papermaking machine from a furnish containing 50% Northern Softwood Kraft; 50% Northern Hardwood Kraft. The base sheets were all made at a targeted weight of 18 lbs/ream, and were creped at a blade wear angle (i.e., holder angle) of 17°. All sheets were sprayed with 3 pounds of softener per ton of pulp. Three blade types were employed in this study: (1) a blade having a 0° bevel; (2) a blade with a 15° bevel, and (3) a blade with a 25° bevel. For each blade type, base sheets were manufactured at various strength levels that were achieved by addition of starch to the Northern Softwood Kraft portion of the furnish. Base sheets were also made using blades of the present invention which had the same three blade bevel angles. The various combinations of blade bevel, notch frequency, and notch depth that were employed in this study are shown in Table 5.

TABLE 5

Undulatory Crepe Blades Used in Tissue Study

| Blade Bevel (deg) | Notches/inch | Notch depth (in) |
|---|---|---|
| 0 | 20 | 0.010 |
| 15 | 12 | 0.010 |
| 15 | 20 | 0.010 |
| 15 | 25 | 0.010 |
| 15 | 12 | 0.020 |
| 15 | 16 | 0.020 |
| 15 | 20 | 0.020 |
| 25 | 12 | 0.010 |
| 25 | 20 | 0.010 |
| 25 | 12 | 0.020 |
| 25 | 20 | 0.020 |

Figure 20:
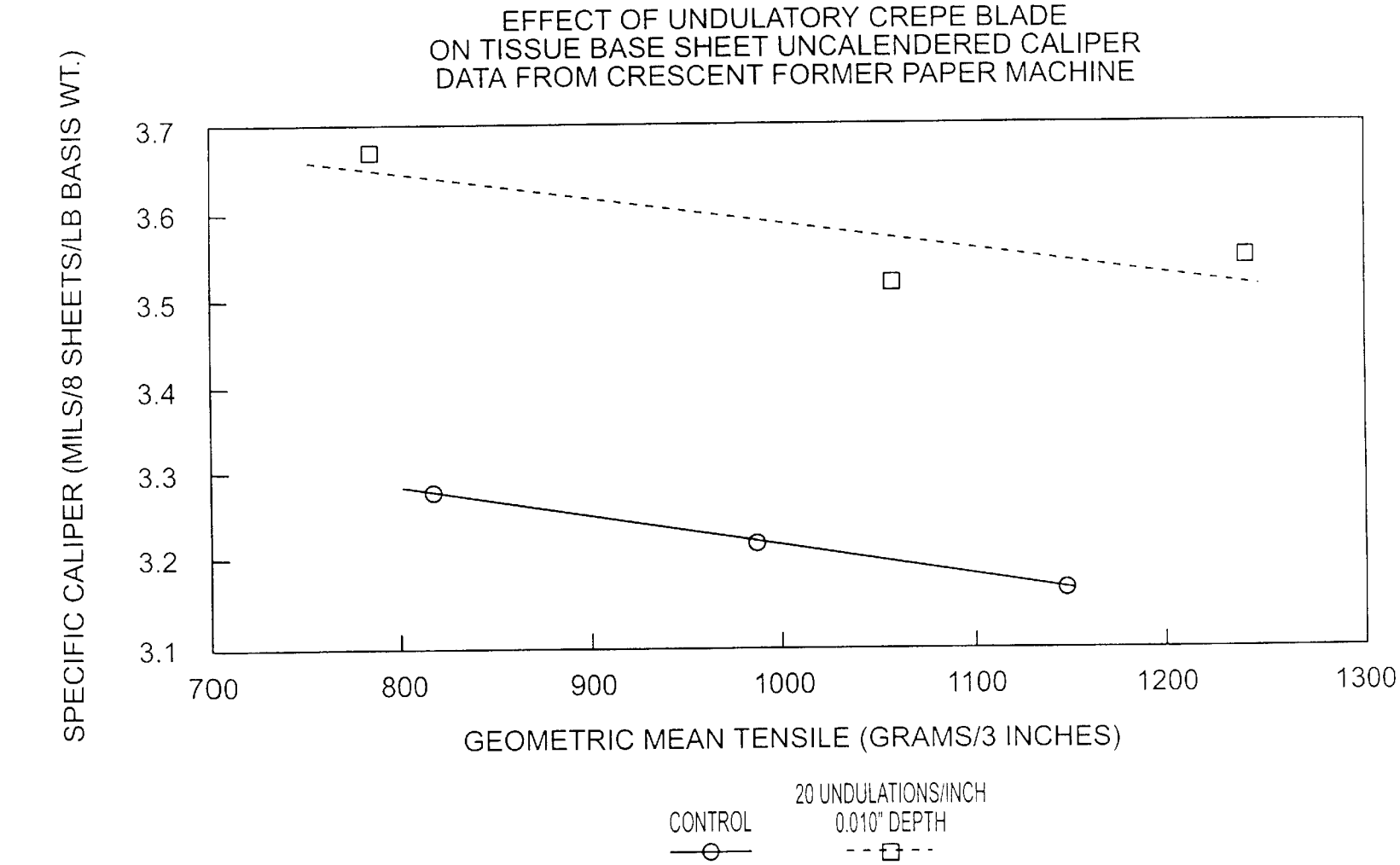
FIG. 20 is a graph of specific caliper versus geometric mean tensile strength comparing creped paper manufactured with one of the creping blades of the invention and a conventional unbeveled creping blade.
Figure 21:
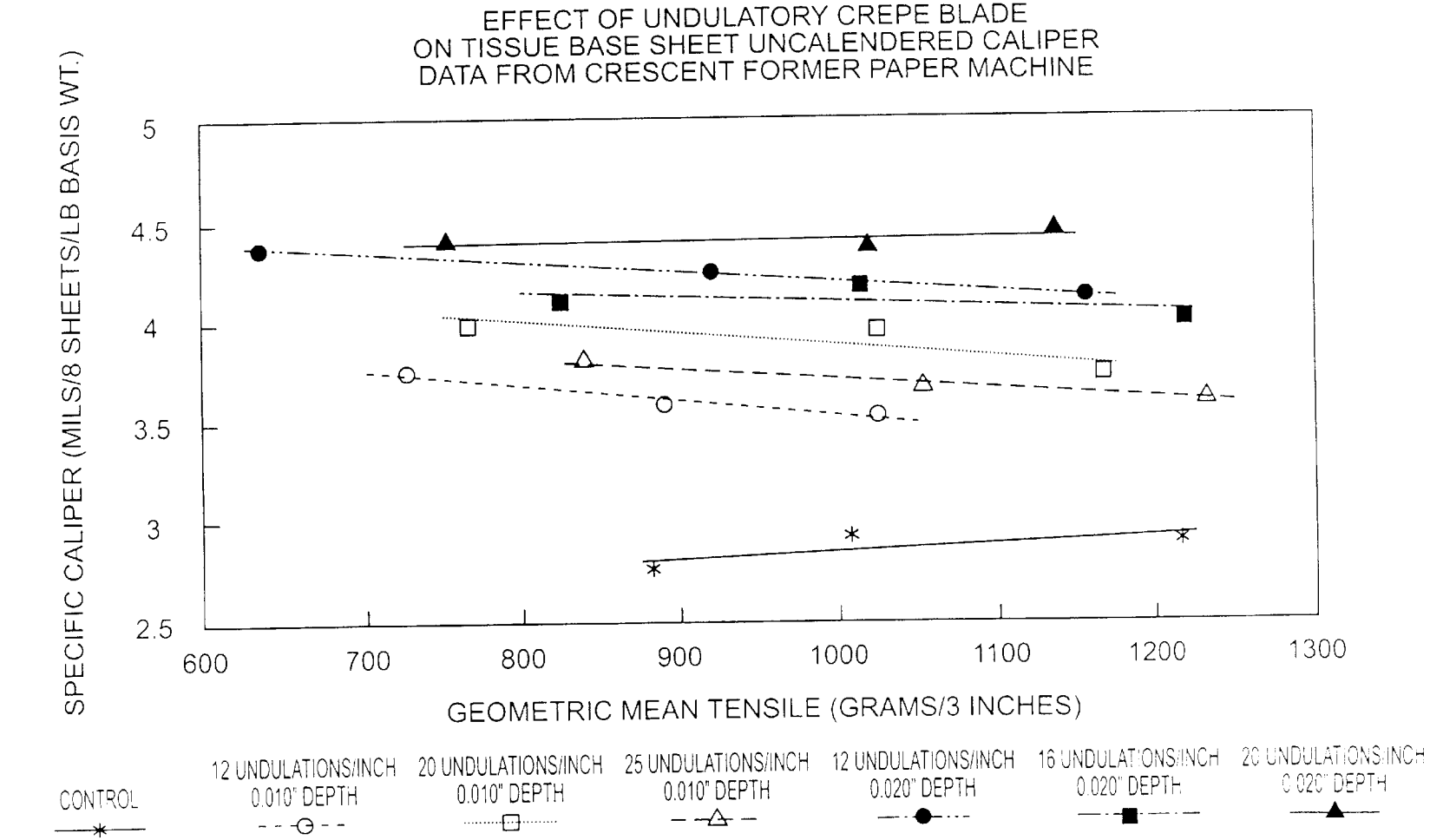
FIG. 21 is a graph of specific caliper versus geometric mean tensile strength comparing creped paper produced with creping blades of the invention having a 15° bevel and various notch frequencies and notch depths, with a conventional 15° beveled blade as control.
Figure 22:
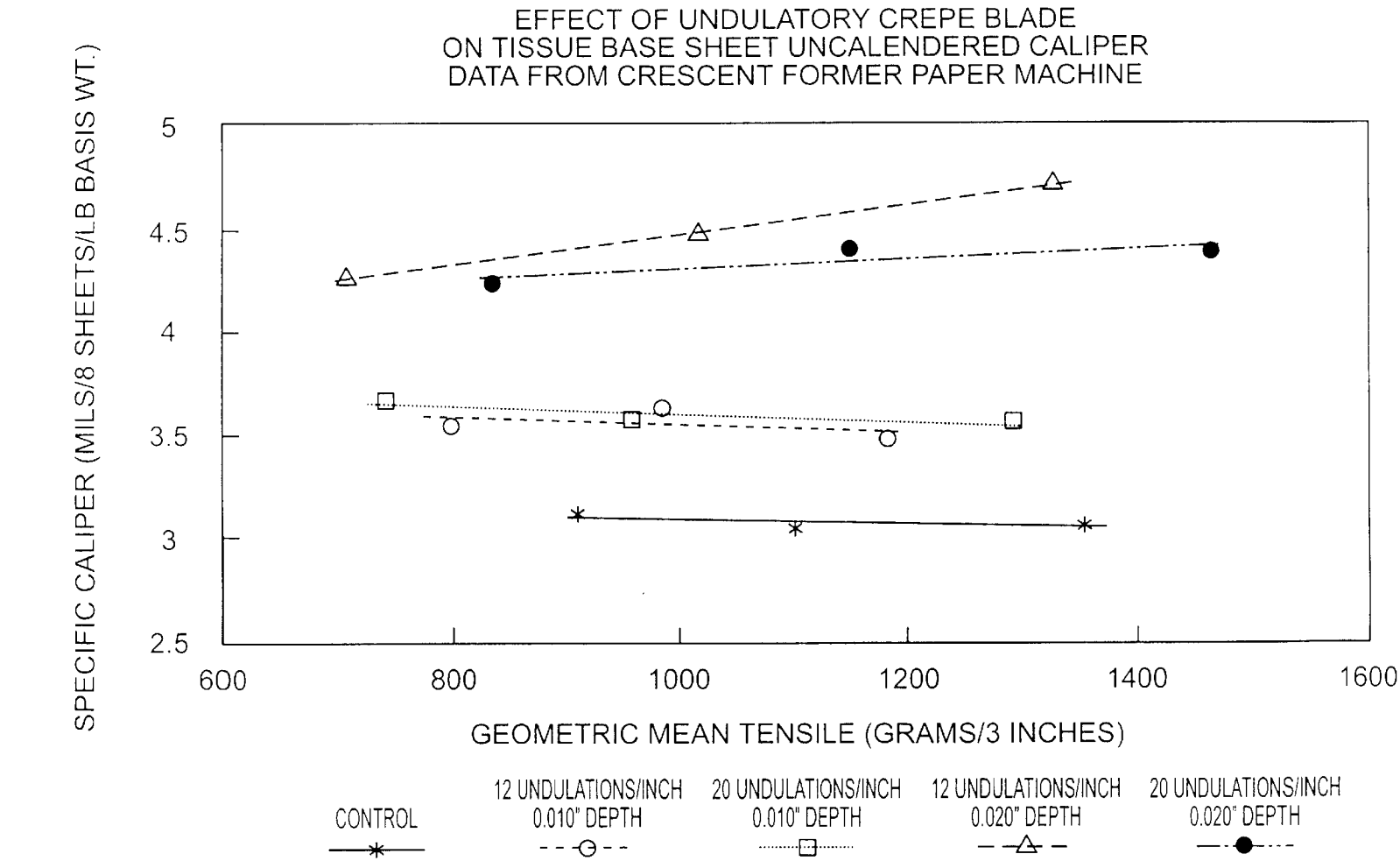
FIG. 22 is a graph of specific caliper versus geometric mean tensile strength comparing creped paper produced with creping blades of the invention having a 25° bevel and various notch frequencies and notch depths, with a conventional 25° beveled blade as control.

The uncalendered specific calipers of the various base sheets made using the undulatory crepe blades are shown as functions of their tensile strengths in FIGS. 20, 21, and 22. Each figure shows the results for the base sheets made at one of the three blade bevels employed in the study. As can be seen from FIGS. 20. 21 and 22, in every case, the sheets made using the creping blades of the present invention exhibited a higher uncalendered specific caliper than did the sheets made using the conventional blades. In some cases, gains of 50% or more are seen.

Figure 23:
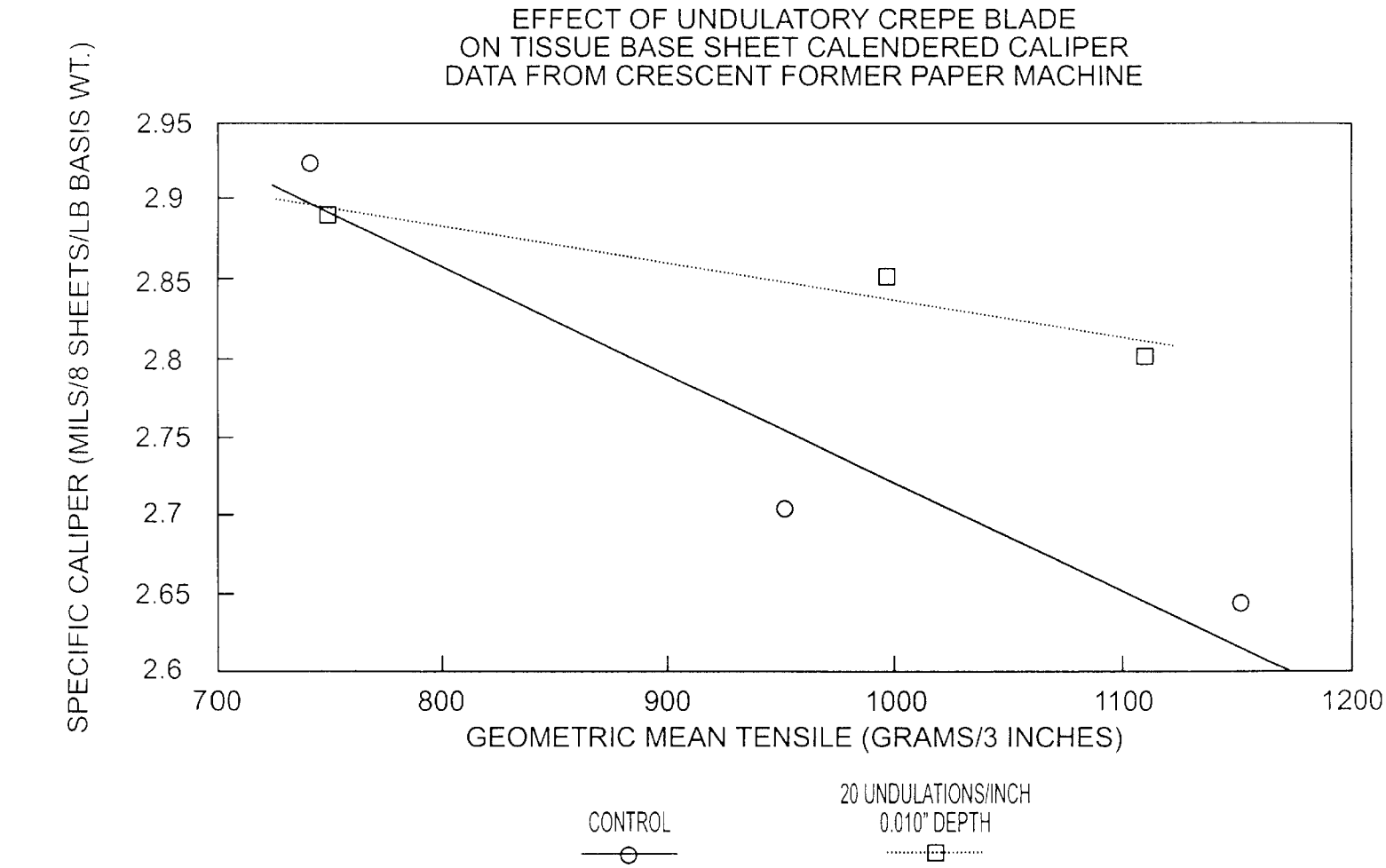
FIG. 23 is a graph of specific caliper versus geometric mean tensile strength comparing calendered creped paper produced with creping blades of the invention having no bevel, one notch frequency, and one notch depth, with a conventional creping blade as a control.
Figure 24:
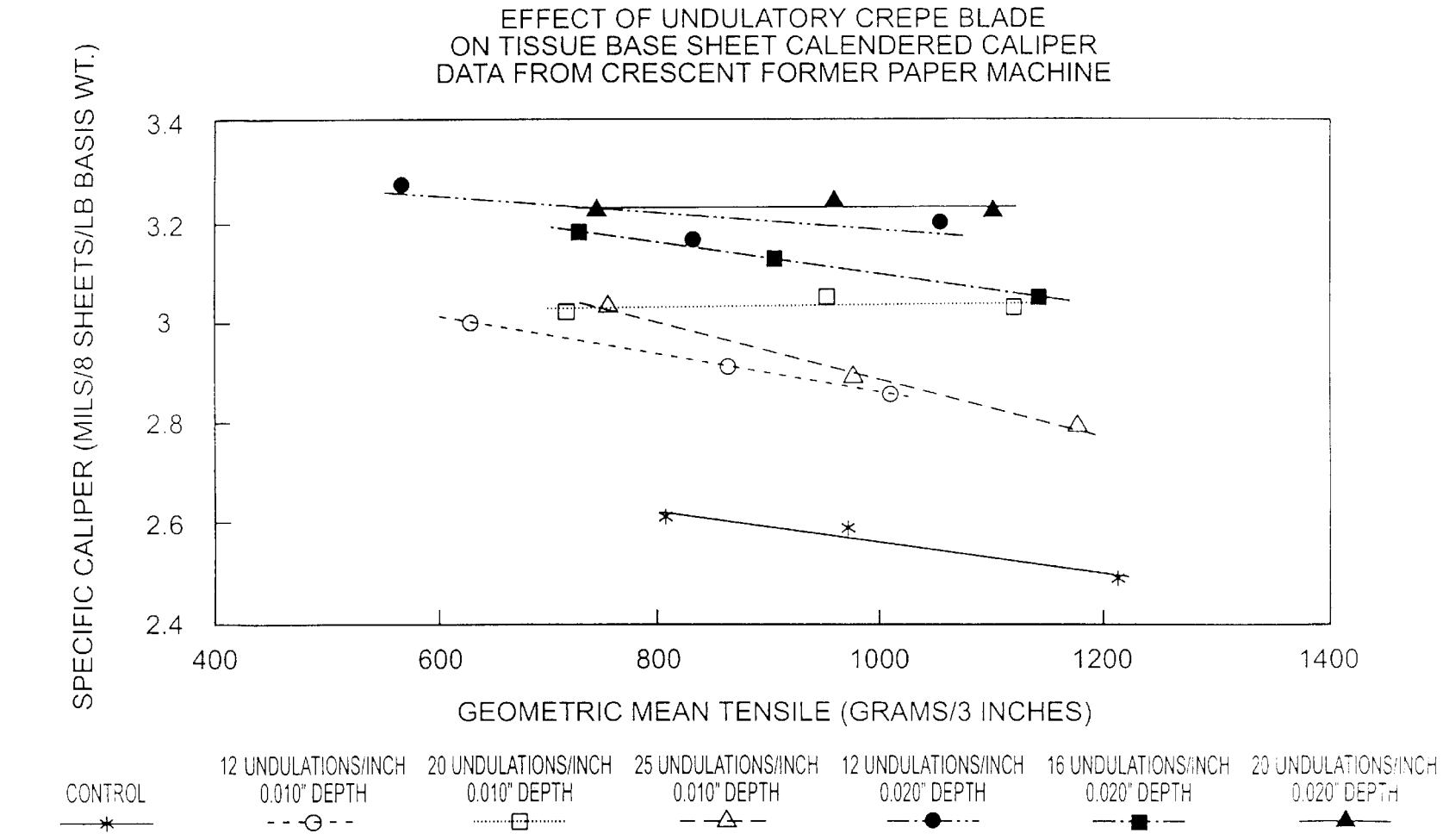
FIG. 24 is a graph of specific caliper versus geometric mean tensile strength comparing calendered creped paper produced with creping blades of the invention having a 15° bevel and various notch frequencies and notch depths, with a conventional 15° beveled creping blade as a control.
Figure 25:
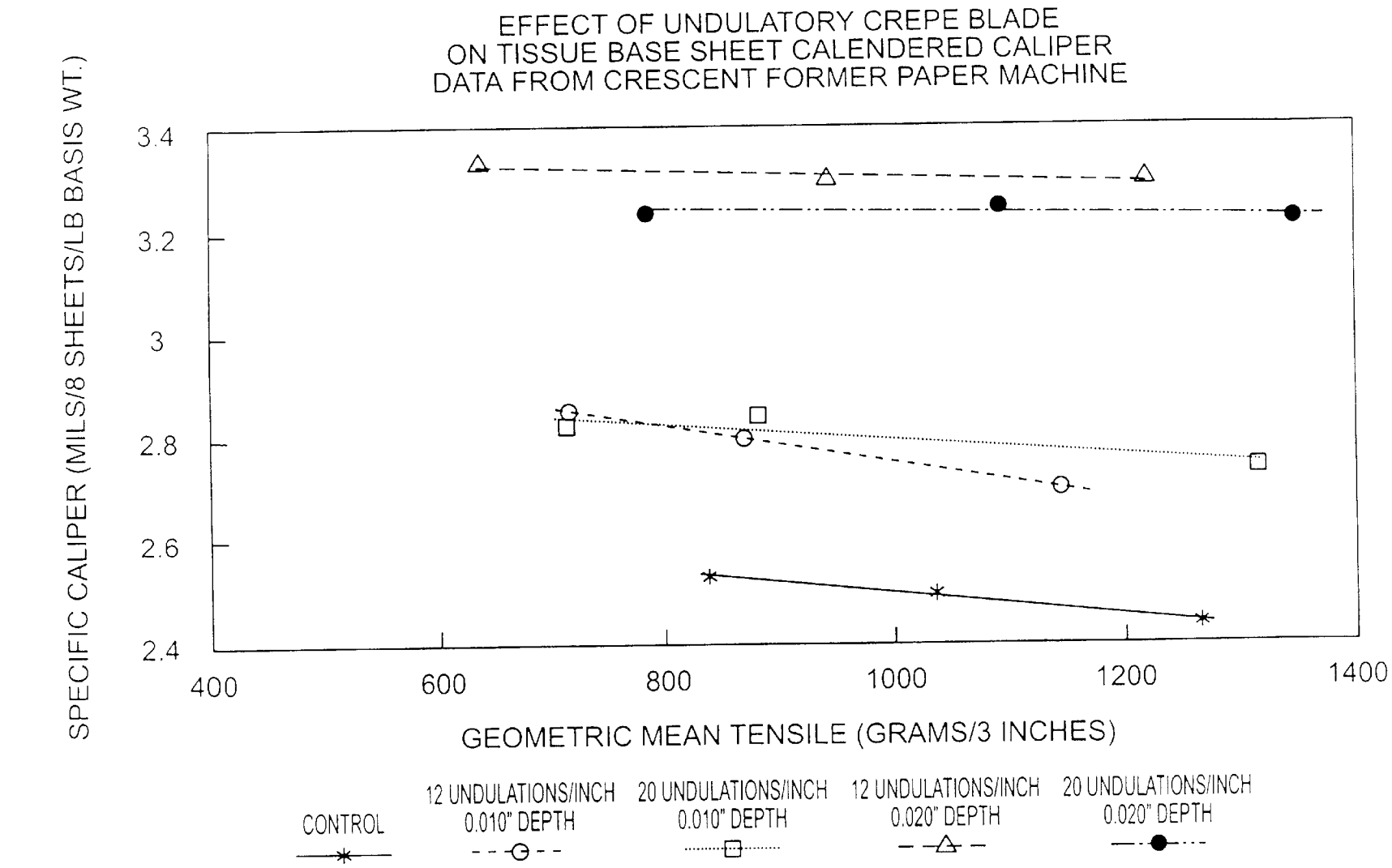
FIG. 25 is a graph of specific caliper versus geometric mean tensile strength comparing calendered creped paper produced with creping blades of the invention having a 25° bevel and various notch frequencies and notch depths, with a conventional 25° beveled creping blade as a control.

FIGS. 23, 24 and 25 show results for the calendered products made using the same crepe blades as mentioned above. The products were all calendered at a level of 10.8 pli. The products made using the square (0° bevel angle) blade do not show a large specific caliper gain with use of the crepe blade of the present invention, at least not at low strength levels (FIG. 23). However, both the blades of the present invention with bevel angles of 15° and 25° show large gains in calendered specific caliper. In some cases, a gain in specific caliper of over 20 percent is observed.

EXAMPLE 5

Effect of Embossing on Undulatory Tissue Products

This example illustrates that when embossing single-ply tissue made using blades of the present invention, base sheet gains in specific caliper are maintained. Calendered single-ply tissue base sheets were embossed on pilot plant embossing equipment at various emboss depths to determine the impact of embossing on tissue base sheets made using the creping technology of the present invention. Three base sheets from the previous example were selected for this trial: a control sheet creped using a conventional square (0°) blade, and two base sheets produced using blades of the present invention. The blades of the present invention were a 25° beveled blade that had been knurled at a frequency of 20 notches/inch and a notch depth of 0.020 inch, and a 15° beveled blade that had been knurled using the same notch frequency and depth. The base sheets were all calendered at the same level (10.8 pli). All three base sheets were embossed using a spot emboss pattern at three penetration depths: 0.060, 0.075, and 0.090 inch.

Figure 31:
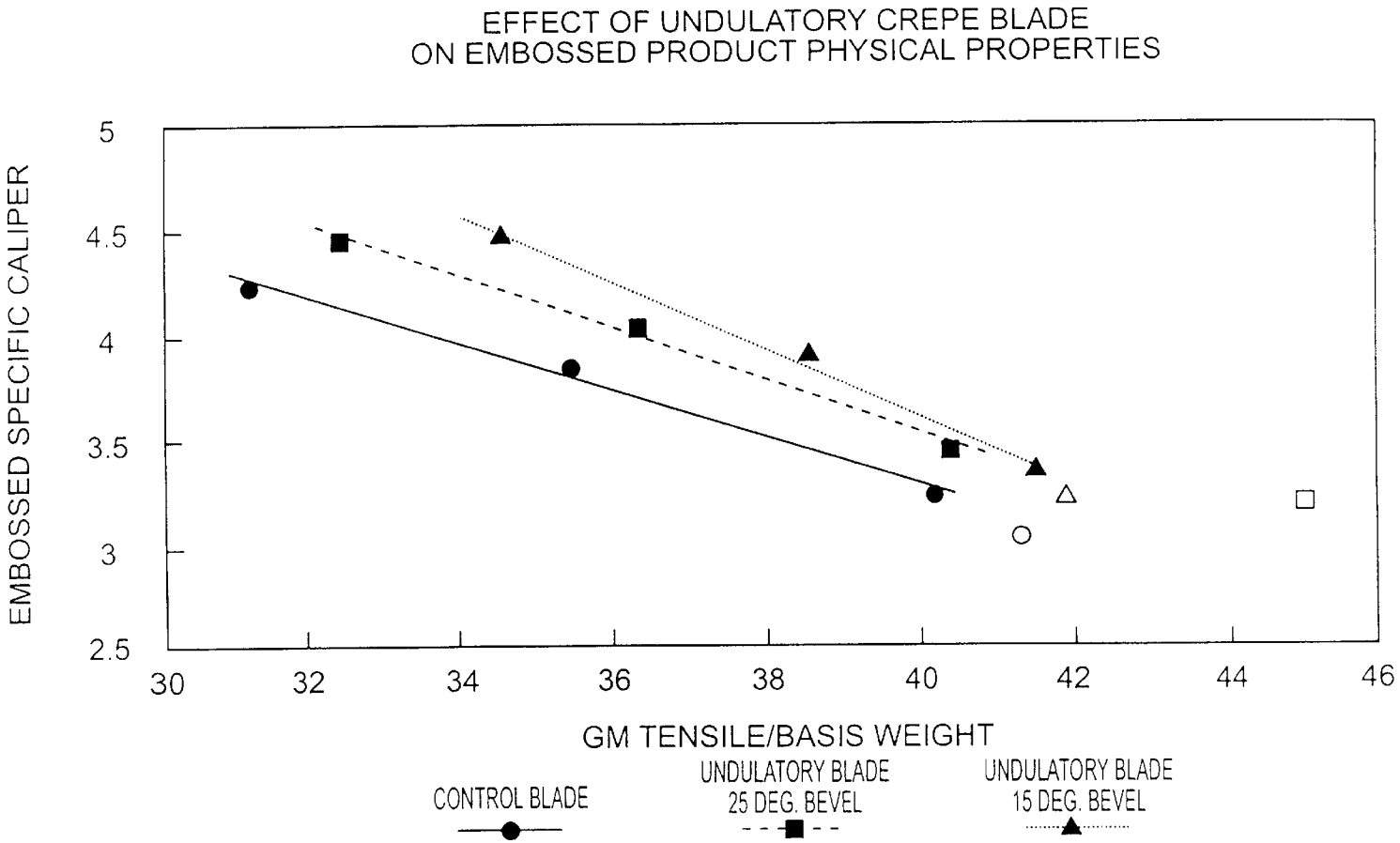
FIG. 31 is a graph comparing the caliper obtained after embossing of sheets creped using various creping blades of the invention and a conventional creping blade.

The results of this embossing are shown in FIG. 31, which presents embossed product caliper/basis weight as a function of GM tensile/basis weight. The values for the unembossed base sheets' caliper divided by basis weight (which we term "specific caliper") used in the trial are also shown. As can be seen from the graph, the base sheet ratio of caliper to basis weight for the two products made using the crepe blades of the present invention were higher after embossing than was that of the control sheet. The graph also shows that the thickness of the embossed product is greater for the sheets made using the crepe blade of the present invention for all emboss depths, indicating that the advantage in specific caliper shown by the base sheets made using the crepe blade of the present invention is maintained throughout embossing.

EXAMPLE 6

This example illustrates the basis weight of the sheets can be reduced without affecting adversely the uncalendered caliper. Tissue base sheets were manufactured on a crescent former paper machine using a furnish containing 50% Northern Softwood Kraft/50% Northern Hardwood Kraft. Sheets were made at a basis weight of 18 lbs/ream using a conventional (0°) crepe blade at a blade wear angle $\gamma_w$ of 17°. Tissue base sheets were also made at a target basis weight of 14 lbs/ream from the same furnish using a crepe blade of the present invention having a blade bevel of 25°. The blade had 20 notches/inch and a notch depth of 0.020 inch. The blade angle $\gamma_w$ employed was 17°. For both the control and the undulatory-blade base sheets, products of different strengths were produced by addition of starch to the Northern Softwood Kraft portion of the furnish. Both calendered and uncalendered base sheet samples were produced. The base sheets were tested for basis weight, caliper, and machine direction and cross direction tensile strength.

Figure 32:
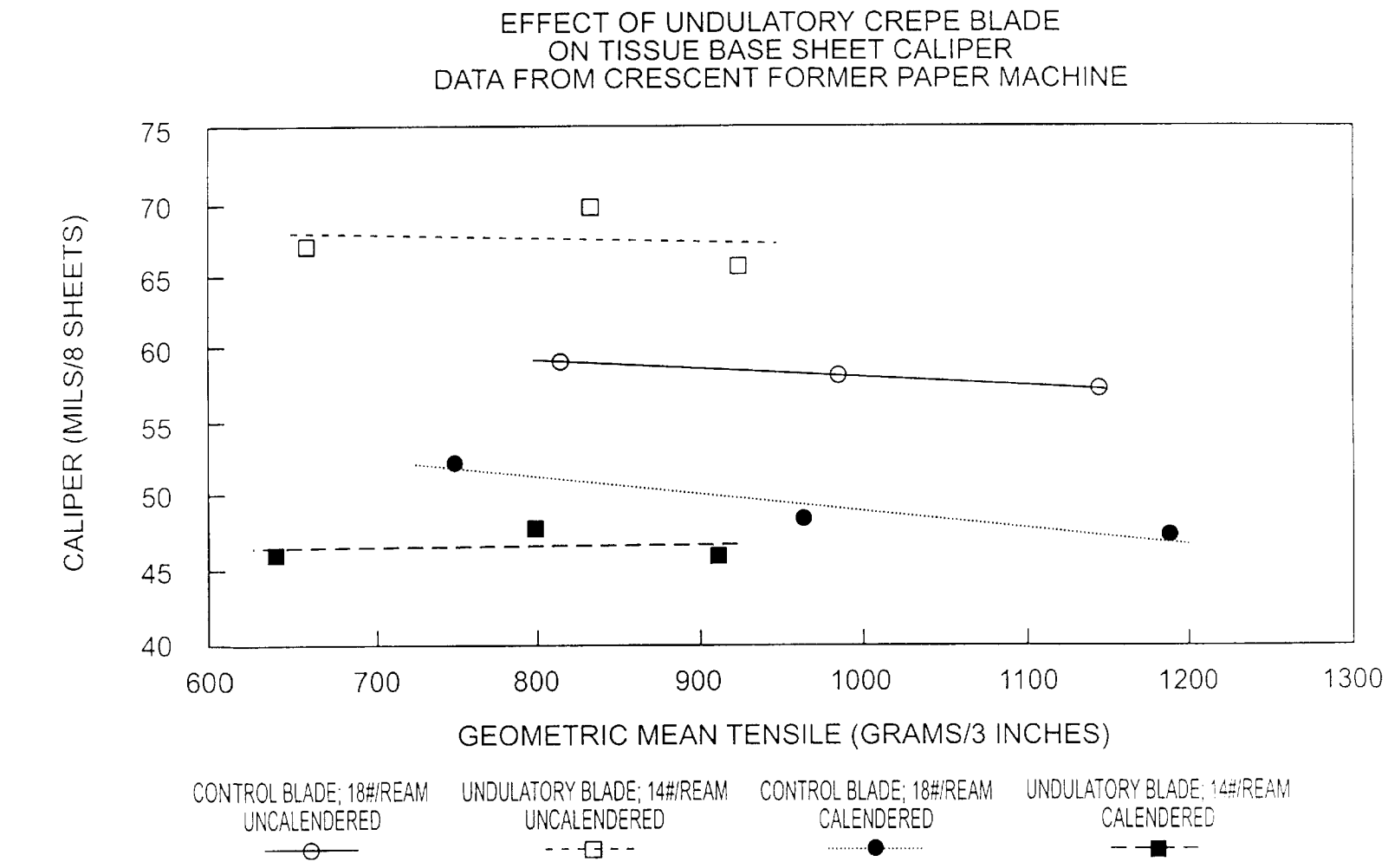
FIG. 32 is a graph comparing caliper of calendered and uncalendered sheets of low basis weight creped using one of the creping blades of the invention and a conventional creping blade.

The results of these physical tests are summarized in FIG. 32, which shows the caliper of the calendered and uncalendered base sheets as functions of their tensile strengths. In this figure, the caliper and strength values have been normalized to the targeted base sheet basis weights (18 and 14 lbs/ream). FIG. 32 shows that, even at a 22% reduction in basis weight, the sheets made at 14 lbs/ream using the blade of the present invention have a higher uncalendered caliper than do the control sheets made using the conventional creping blade at a weight of 18 lbs/ream. When the sheets were calendered at a pressure of 10.8 pli, the 18 lb/ream sheets did have slightly higher calipers than did the 14 lb tissues creped with the blade of the present invention. However, the results do indicate that the blade technology of the present invention will allow production of sheets having caliper equal to conventionally creped base sheets at a substantial reduction in basis weight.

The base sheets produced during the machine trial described above were converted into finished tissue products by embossing the base sheets with a spot emboss pattern. The embossed products were tested for physical properties including tensile modulus, which is a measure of the tissues' bulk softness, and friction deviation which is an indicator the tissue's surface softness.

Figure 33:
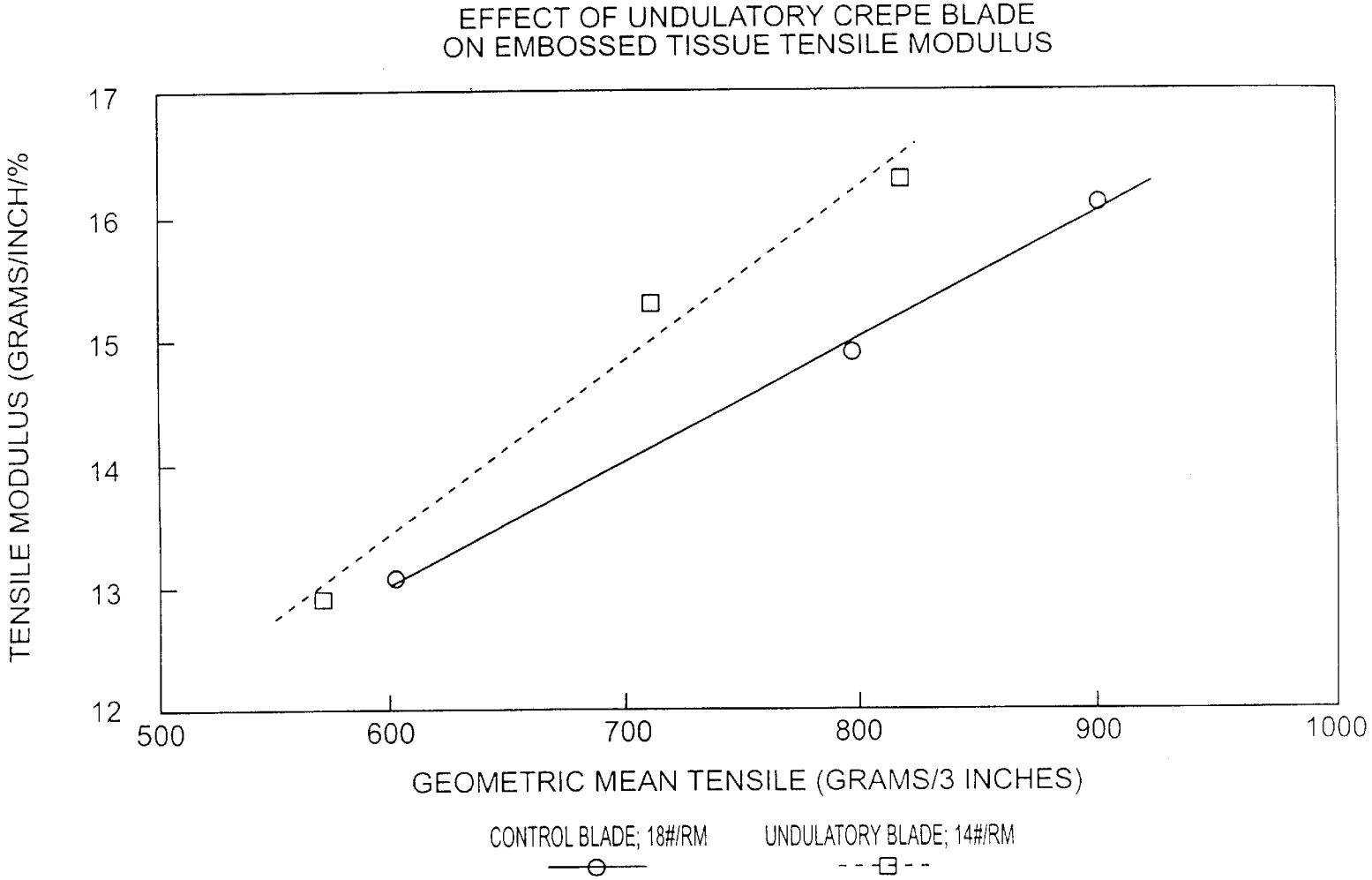
FIG. 33 is a graph comparing tensile modulus of single-ply embossed tissue creped using one of the creping blades of the invention and a conventional creping blade.
Figure 34:
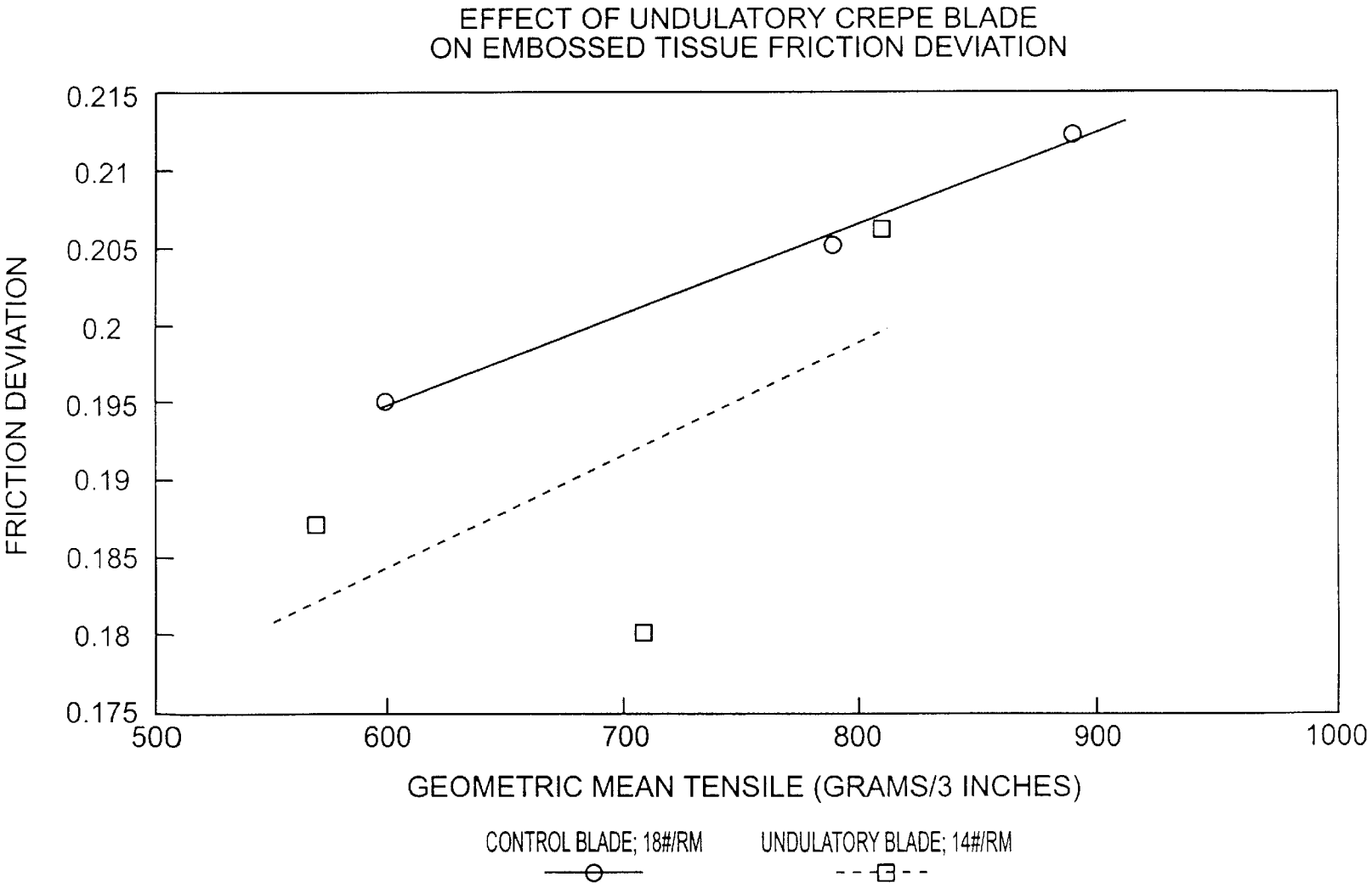
FIG. 34 is a graph comparing friction deviation of single-ply embossed tissue creped using one of the creping blades of the invention and a conventional creping blade.

The results of these tests are indicated in FIGS. 33 and 34, which plot the tensile modulus and friction deviation respectively against the embossed product's strength. From the graphs it appears that, in general, at similar strength levels, the lighter-weight product made using the crepe blade of the present invention has a slightly higher tensile modulus and a lower friction deviation than does the control product. These results indicate that the tissue made at the lower weight using the crepe blade of the present invention has a slightly lower bulk softness and a somewhat higher surface softness than does the higher-weight, conventionally creped tissue.

EXAMPLE 7

This example illustrates that when using the blade of the present invention, a softer single-ply tissue can be obtained. A tissue base sheet was made on a commercial paper machine using the crepe blade of the present invention. The blade employed had a blade bevel of 25°, a notch frequency of 20 per inch, and a notch depth of 0.020 inch. The base sheet was stratified with the Yankee-side layer making up 30% of the sheet and the air-side layer containing the remaining 70%. The Yankee-side layer was composed of 100% West Coast Softwood Kraft, while the air side layer contains 36% West Coast Softwood Kraft, 36% Eucalyptus, and 28% Broke. The base sheet was made using a crepe of 17.5%. The. base sheets physical properties are shown in Table 6. The properties of a conventional base sheet made on the same machine using the same furnish, but employing a conventional (square) creping blade, are also shown in Table 6. This sheet, however, was produced using 19.0% crepe. Both base sheets were gap calendered using the same gap settings. It can be seen that the specific calipers of the base sheet made using the blade of the present invention is greater than the specific caliper of the sheet made using conventional creping, despite the fact that the sheet made using the blade of the present invention was run at a lower creping level; a change that normally serves to decrease base sheet's specific caliper.

The two base sheets were embossed using a spot emboss pattern and were tested for physical properties. The results of these tests are also shown in Table 6. From Table 6, it can be seen that the weight, caliper, and strength of the two embossed products are quite similar. However, the product made using the crepe blade of the present invention has a lower friction deviation value, indicative of a sheet with higher surface softness.

The two products were also submitted to a sensory panel for testing of their sensory softness and bulk. The results of these panel tests are shown in Table 6. Values that differ by 0.4 are considered statistically significant at 95% confidence level. These results indicate that the tissue made using the blade of the present invention is preferred over the product made using the standard creping technology for softness by a statistically significant margin. The two products are not significantly different for bulk perception.

TABLE 6

Physical Properties of Base Sheets and Embossed Products

| | Base Sheet | | Embossed Product | |
|---|---|---|---|---|
| Crepe Blade | Standard | Undulatory | Standard | Undulatory |
| Basis Weight (lbs/ream) | 17.9 | 18.3 | 17.92 | 17.72 |
| Caliper (mils/8 sheets) | 47.8 | 50.7 | 57.2 | 56.9 |
| Specific Caliper (mils/8 sheets/lb basis weight) | 2.67 | 2.77 | 3.19 | 3.21 |
| MD Tensile (grams/3 inches) | 1245 | 1287 | 949 | 928 |
| CD Tensile (grams/3 inches) | 657 | 565 | 390 | 372 |
| Perf Tensile (grams/3 inches) | — | — | 356 | 333 |
| MD Stretch (%) | 21.0 | 19.6 | 19.5 | 16.8 |
| Tensile Modulus (grams/inch/%) | — | — | 14.4 | 13.9 |
| Friction Deviation | — | — | 0.190 | 0.171 |
| Sensory Softness | — | — | 16.47 | 16.95 |
| Sensory Bulk | — | — | 0.16 | 0.00 |

In addition to tests of their physical properties, the two products were examined to determine their free-fiber end (FFE) count. Some workers consider the free-fiber end count to be important in characterizing a tissue based on the premise that high FFE values correlate with perceived surface softness. In this test, the surface of the tissue samples is mechanically disrupted in a manner that emulates the disruption imparted to the tissue during a softness panel examination. The samples are then mounted and imaged microscopically. Image analysis is then used to determine the number and size of the fibers that are raised from the tissue surface. The test reports the average number of free-fiber ends over several measurements of a 1.95 mm length of tissue. For the two tested tissues, the number of free-fiber ends for the product made using the blade of the present invention was 12.5 as compared to 9.9 for the control product.

The two products were tested in Monadic Home-Use tests. In this type of test, consumers test a single product and are then asked to rate its overall performance as well as its performance in several attribute categories. These attributes can be ranked as Excellent, Very Good, Good, Fair, or Poor. Results from this test are summarized in Table 7. For tabulation purposes, each response was assigned a numerical value ranging from 5 for a rating of Excellent to 1 for a Poor rating. A weighted average rating for the tissues' Overall Rating and each attribute was then calculated. The Monadic Home-Use tests are described in the Blumenship and Green textbook "State of The Art Marketing Research," NTC Publishing Group Lincolnwood, Ill., 1993.

TABLE 7

Monadic Hut Results for One-Ply Tissue Products

| Crepe Blade Type | Control | Undulatory |
|---|---|---|
| Overall Rating | 3.41 | 3.50 |
| Being Soft | 3.57 | 3.85 |
| Being Strong | 3.65 | 3.65 |
| The Thickness of the Sheet Itself | 3.33 | 3.43 |
| Being Absorbent | 3.60 | 3.76 |
| Being Comfortable to Use | 3.48 | 3.65 |
| Not Being Irritating | 3.84 | 3.95 |
| Cleansing Ability | 3.70 | 3.70 |

As can be seen from the table, the performance of the product made using the undulatory crepe blade equals or exceeds that of the control product for these important tissue attributes.

EXAMPLE 8

This example illustrates that significant variation in blade wear angle $\gamma_w$ may be tolerated when using the blade of the present invention to manufacture single-ply tissue while retaining substantially enhanced specific caliper. Tissue base sheets were made from a furnish containing 50% Northern Softwood Kraft and 50% Northern Hardwood Kraft using the blade of the present invention having a 15° blade bevel, a notch frequency of 20 per inch, and a notch depth of 0.020 inch. The sheets were made with a blade wear angle $\gamma_w$ of 17°. The sheets were made at three strength levels, with sheet strength being controlled by addition of starch to the SWK portion of the furnish. Tissue sheets were also made using the same furnish and a similar undulatory crepe blade, however, the blade wear angle $\gamma_w$ for these sheets was 25°. These sheets were also made at three strength levels by using the addition of starch to control sheet strength.

Figure 35:
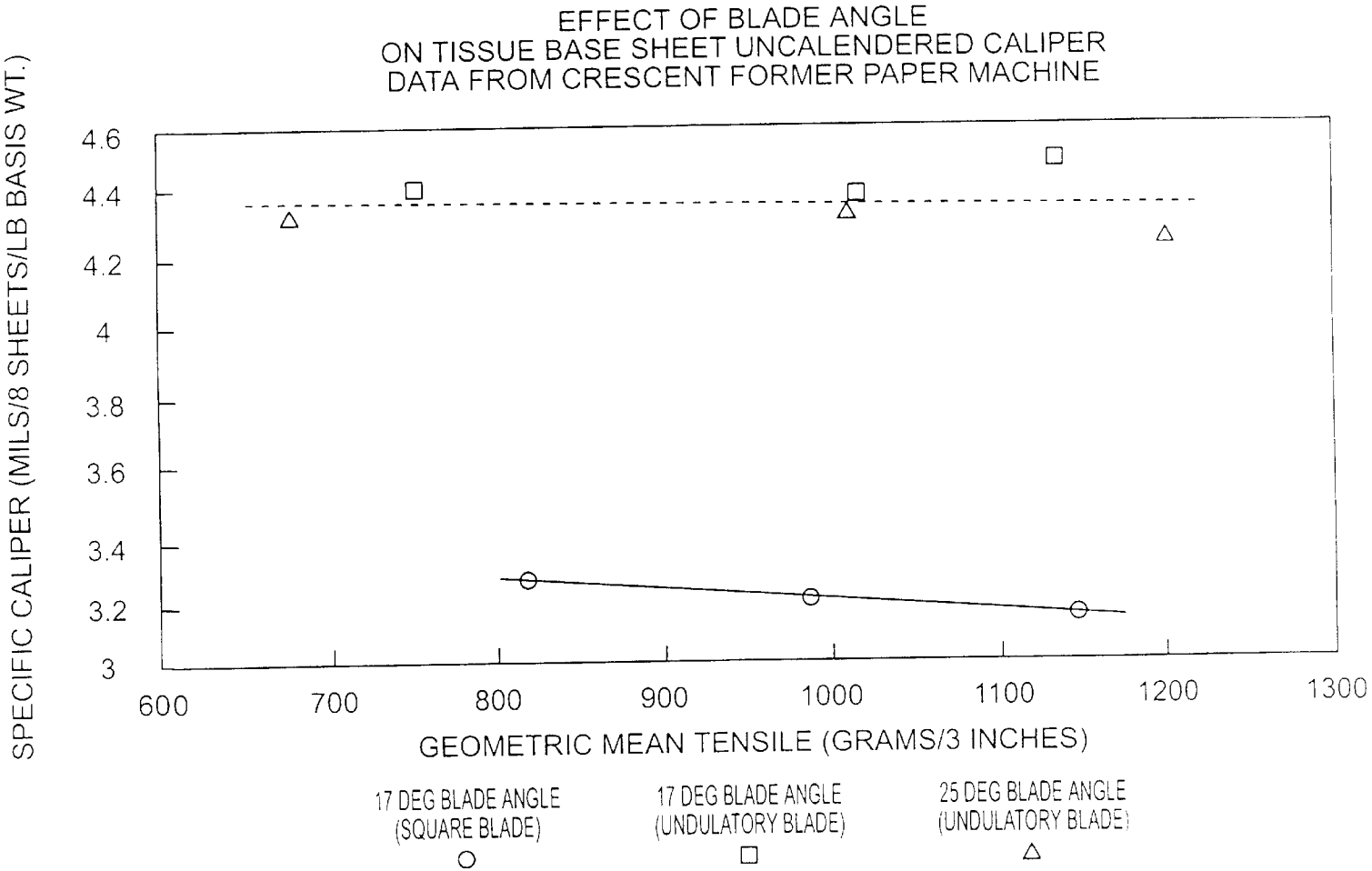
FIG. 35 is a graph showing the effect of blade angle on caliper of a base sheet creped using creping blades of the invention.

The physical properties of the various base sheets were measured and compared. FIG. 35 shows the results of these tests. Results from similar base sheets made using a conventional (square) creping blade are also shown. It can be appreciated that the uncalendered specific caliper of the base sheets made using the creping blades of the present invention at the two creping angles both have specific calipers that are much greater than that of the control sheet and that the sheets made using the blade of the present invention are, at a similar strength level, essentially equal and can be represented by a single regression line. This latter result is unexpected, since with conventional creping blades, such a change in blade wear angle $\gamma_w$ would be expected to result in a more substantial difference in base sheet properties, especially specific caliper. The tissue base sheets made using the higher blade wear angle $\gamma_w$ would be expected to have significantly higher specific calipers than would the sheets made using the lower angle.

Since the base sheet specific caliper is relatively insensitive to blade wear angle $\gamma_w$ with use of the undulatory crepe blade, it is often possible to manufacture similar tissue products on machines that have different blade wear angles. Use of the crepe blade of the present invention can not only provide a base sheet with improved specific caliper over that which can be obtained with a conventional creping blade, but can also make it easier to manufacture similar products on machines that have different creping geometries.

EXAMPLE 9

This example illustrates the effect of varying wear angle $\gamma_w$ (i.e., blade or holder angle) of an undulatory crepe blade in a process for creping two-ply tissue. Two-ply tissue base sheets were made using a crepe blade of the present invention having a bevel angle of 25°, a notch depth of 0.020 inch, and a notch frequency of 20 notches/inch. The base sheets were made using two different wear angles, that is, 18° and 25°. For both tissues the furnish was 60% Southern Hardwood Kraft, 30% Northern Softwood Kraft, and 10% Broke. The two tissues both employed the same refining levels (3.5 Hp-days/ton).

The physical properties of the base sheets made using the two blade angles are shown in Table 8. From the table, it can be seen that the properties are very similar, indicating that use of the crepe blade of the present invention results in a process for providing tissue which is relatively insensitive to blade wear angle, $\gamma_w$.

TABLE 8

Physical Properties of Two-ply Tissue Base Sheet Made at Different Blade Angles

| Blade Angle (°) | 18 | 25 |
|---|---|---|
| Basis Weight (lbs/ream) | 9.37 | 9.50 |
| Caliper (mils/8 sheets) | 28.6 | 27.7 |
| Specific Caliper (mils/8 sheets/lb basis weight) | 3.05 | 2.92 |
| MD Tensile (grams/3 inches) | 547 | 553 |
| CD Tensile (grams/3 inches | 251 | 254 |
| MD Stretch (%) | 16.1 | 14.5 |
| Friction Deviation | 0.164 | 0.159 |

EXAMPLE 10

This example illustrates the improvement in modulus resulting from the use of a blade of the present invention to produce base sheet for two-ply tissue as compared to the modulus obtained when a conventional blade is used. Two-ply tissue base sheets were made on a crescent former tissue machine. The sheets were made from a furnish consisting of 60% Southern Hardwood Kraft, 30% Southern Softwood Kraft, and 10% Broke. Both a control product, which was creped using a conventional square crepe blade, and a product creped with an undulatory blade were produced. The crepe blade of the present invention (i.e., the undulatory blade) had a blade bevel angle of 25°, a notch frequency of 20 notches/inch, and a notch depth of 0.020 inch. The two sheets were made to the same target basis weight, caliper, and tensile levels. Table 9 summarizes the physical properties of the two base sheets.

TABLE 9

Two-Ply Tissue Base Sheet Properties

| | Creping blade Type | |
|---|---|---|
| | Control | Undulatory |
| Basis Weight (lbs/ream) | 9.4 | 9.37 |
| Caliper (mils/8 sheets) | 27.9 | 28.6 |
| Specific Caliper (mils/8 sheets/lb basis weight) | 2.97 | 3.05 |
| MD Tensile (grams/3 inches) | 572 | 547 |
| CD Tensile (grams/3 inches) | 263 | 251 |
| MD Stretch (%) | 17.4 | 16.1 |
| CD Stretch (%) | 6.3 | 8.7 |
| MD Tensile Modulus (grams/inch/%) | 27.8 | 29.5 |

TABLE 9-continued

| Two-Ply Tissue Base Sheet Properties | Creping blade Type | |
|---|---|---|
| | Control | Undulatory |
| CD Tensile Modulus (grams/inch/%) | 43.9 | 27.2 |
| GM Tensile Modulus (grams/inch/%) | 34.9 | 28.2 |
| Friction Deviation | 0.147 | 0.151 |

It can be seen from the table that the tissue base sheet made using the creping blade of the present invention has a lower geometric mean tensile modulus than does the tissue sheet made using the standard creping blade. This lower GM modulus is in turn due to a lower CD modulus that, at least in part, results from the higher CD stretch that results from use of the creping blade of the present invention. Lower tensile modulus has been shown to correlate with tissue softness, thus the lower modulus value exhibited by the base sheet creped using the creping blade of the present invention should aid in producing a softer tissue product.

EXAMPLE 11

This example illustrates the physical properties of a two-ply tissue base sheet produced using a blade of the present invention, as compared to tissue produced using a conventional square blade. Two-ply tissue base sheets were made from a furnish containing 30% Northern Softwood Kraft, 60% Southern Hardwood Kraft, and 10% Broke. Three products were produced: a control product which was creped with a standard square creping blade, and two products which were made using the creping blade of the present invention. The creping blade of, the present invention had a bevel of 25°, 20 notches per inch, and a notch depth of 0.020 inch. The control base sheet was calendered at a pressure of 5 pli to produce a base sheet having a caliper targeted at approximately 29 mils/8 sheets. One of the undulatory-blade base sheets was calendered at 15 pli, to produce a base sheet having approximately the same caliper as the control product. The other undulatory sheet was calendered at a very light level (approximately 3 pli), to produce a sheet with increased base sheet caliper. The physical properties of the three base sheets are listed in Table 10. It can be appreciated that the blade of the present invention can be used to provide base sheet for tissue having very desirable combinations of specific caliper and softness.

TABLE 10

| Two-Ply Base Sheet Properties | Creping blade Type | | |
|---|---|---|---|
| | Standard | Undulatory | Undulatory |
| Calender Loading (pli) | 5 | 3 | 15 |
| Basis Weight (lbs/ream) | 9.3 | 9.4 | 9.4 |
| Caliper (mils/8 sheets) | 28.3 | 42.6 | 29.1 |
| Specific Caliper (mils/8 sheets/lb basis weight) | 3.04 | 4.53 | 3.10 |
| MD Tensile (grams/3") | 631 | 560 | 536 |
| CD Tensile (grams/3") | 234 | 234 | 226 |
| MD Stretch (%) | 17.2 | 19.9 | 16.6 |
| CD Stretch (%) | 6.5 | 9.6 | 9.5 |

TABLE 10-continued

| Two-Ply Base Sheet Properties | Creping blade Type | | |
|---|---|---|---|
| | Standard | Undulatory | Undulatory |
| Tensile Module (grams/inch/%) | 19.6 | 12.3 | 12.7 |
| Friction Deviation | 0.166 | 0.216 | 0.146 |

EXAMPLE 12

This example illustrates the results achieved when embossing the two-ply base sheets prepared in Example 11. The three base sheet types were two-ply embossed at an emboss depth of 0.085 inch. The physical properties of the two-ply embossed products are shown in Table 11. The products were submitted to a sensory panel for evaluation of their overall softness and bulk. The results from this panel are also shown in Table 11. For comparisons between products in sensory panel tests, a difference of 0.40 units is statistically significant at the 95% confidence level.

The results of these panel tests show that the undulatory creping blade technology can be used either to produce products having roughly equal softness but superior bulk perception to that of the control, or, on the other hand, a product having substantially equal bulk perception but superior softness.

TABLE 11

| Properties of Embossed Two-Ply Products | Creping blade Type | | |
|---|---|---|---|
| | Standard | Undulatory | Undulatory |
| Calender Loading (pli) | 5 | 3 | 15 |
| Emboss Depth (in) | 0.085 | 0.085 | 0.085 |
| Basis Weight (lbs/ream) | 18.1 | 18.4 | 18.4 |
| Caliper (mils/8 sheets) | 71.3 | 78.4 | 66.6 |
| Specific Caliper (mils/8 sheets/lb basis weight) | 3.94 | 4.26 | 3.62 |
| MD Tensile (grams/3") | 1070 | 952 | 997 |
| CD Tensile (grams/3") | 375 | 405 | 385 |
| Perf Tensile (grams/3") | 489 | 421 | 447 |
| MD Stretch (%) | 13.1 | 15.6 | 14.7 |
| CD Stretch (%) | 8.0 | 8.9 | 9.2 |
| Tensile Mod. (grams/in/%) | 19.5 | 21.1 | 19.5 |
| Friction Deviation | 0.180 | 0.162 | 0.160 |
| Sensory Softness | 17.63 | 17.30 | 18.56 |
| Sensory Bulk | 0.07 | 1.01 | 0.22 |

EXAMPLE 13

This example is similar to Example 12, except that a different emboss pattern is employed to combine base sheets as prepared in Example 11. Control base sheets and base sheets made using the creping blade of the present invention and calendered at the 15 pli calender setting were paired and embossed. The emboss depth for both products was 0.085 inch. The physical properties of the two embossed products are shown in Table 12.

TABLE 12

Physical Properties of Two-Ply Tissue

| | Creping blade Type | |
|---|---|---|
| | Standard | Undulatory |
| Emboss Depth (inches) | 0.085 | 0.085 |
| Basis Weight (lbs/ream) | 18.5 | 18.3 |
| Caliper (mils/8 sheets) | 68.5 | 67.9 |
| Specific Caliper (mils/8 sheets/lb basis weight) | 3.70 | 3.71 |
| MD Tensile (grams/3 inches) | 1053 | 934 |
| CD Tensile (grams/3 inches) | 373 | 364 |
| Perf Tensile (grams/3 inches) | 478 | 466 |
| MD Stretch (%) | 14.0 | 13.3 |
| CD Stretch (%) | 7.4 | 9.1 |
| Tensile Modulus (grams/in/%) | 19.0 | 16.7 |
| Friction Deviation | 0.197 | 0.190 |

EXAMPLE 14

This example sets forth sensory panel test results for tissue produced according to the procedure of Example 13. The two products were submitted to a sensory panel for comparison of the products' softness, thickness, bulk, and stiffness. The results of the panel for the various tissue properties are shown in Table 13. The numerical values listed are the number of panelists (out of 40) that judge a particular product to have more of a given property than does the other product. In the case of panelists that judged the two products to be equal for a certain attribute, the responses have been evenly divided between the two products. It should be noted that for all properties, except stiffness, a higher number of respondents corresponds to a preferred product. From the results, it can be seen that the product made using the creping blade of the present invention equals or exceeds the control product in all attributes tested.

TABLE 13

Sensory Panel Results - Two Ply Tissue

| | Creping blade Type | |
|---|---|---|
| | Standard | Undulatory |
| Overall Softness | 5 | 35 |
| Top surface Softness | 10.5 | 29.5 |
| Bottom Surface Softness | 9 | 31 |
| Bulk | 18.5 | 21.5 |
| Thickness | 18.5 | 21.5 |
| Stiffness | 29.5 | 10.5 |

EXAMPLE 15

This example demonstrates use of a blade of the present invention to obtain improved caliper, modulus and absorbency at equal weight for two-ply towel base sheets. Towel base sheets were made from a furnish consisting of 70% Southern Hardwood Kraft and 30% Southern Softwood Kraft. Twelve lbs of wet strength resin were added for each ton of pulp. The base sheets were made at various strength levels with refining being used to vary the sheet strength. The towel base sheets were made at two basis weight targets, 16 lbs/ream and 14 lbs/ream. Control sheets were creped using a 0° (square) creping blade. In addition, sheets were made using undulatory blades having various combinations of blade bevel, notch depth, and notch frequency.

Figure 36:
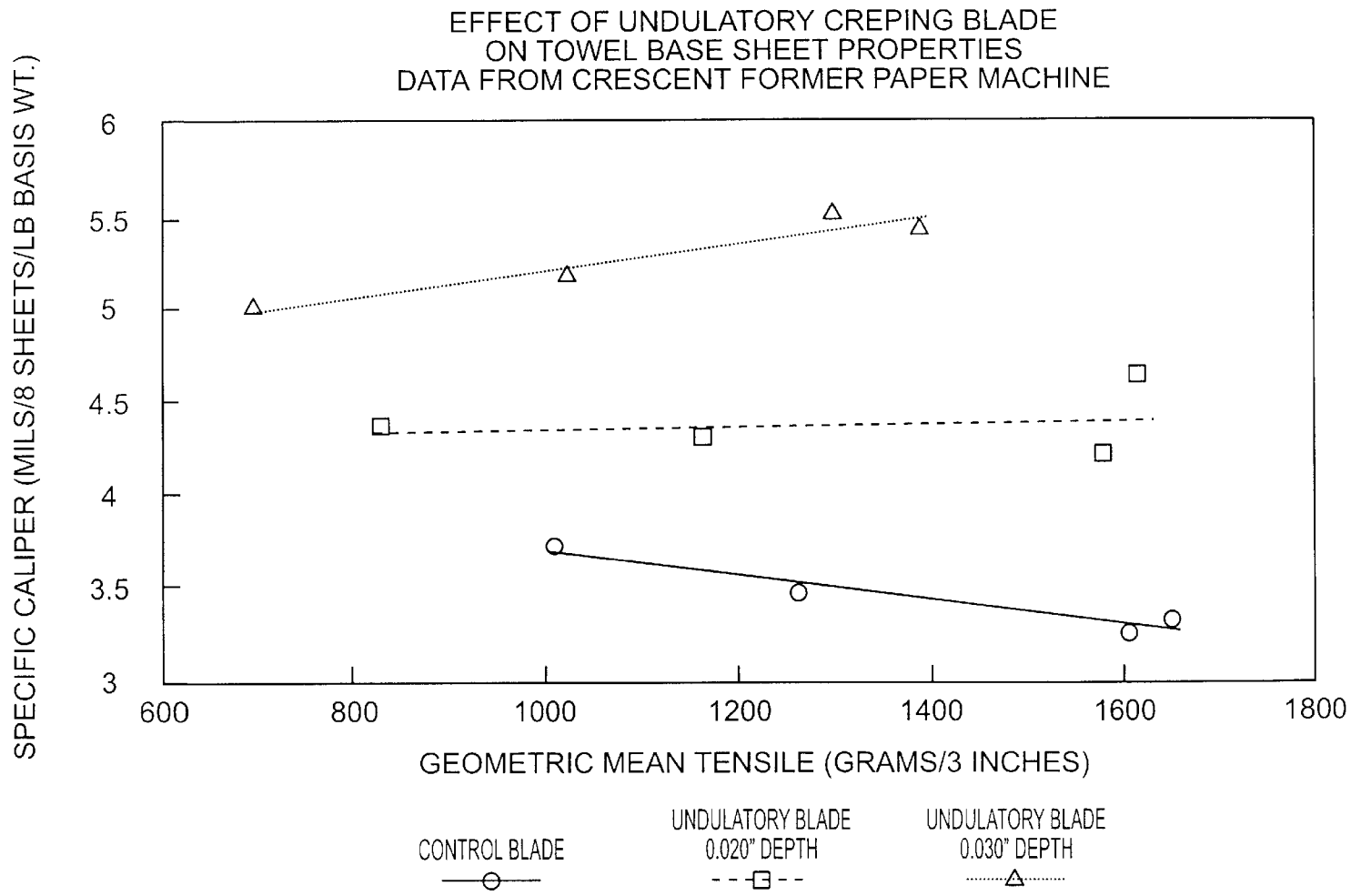
FIGS. 36–41 are graphs showing the effect of creping blades of the invention on towel base sheet properties.
Figure 37:
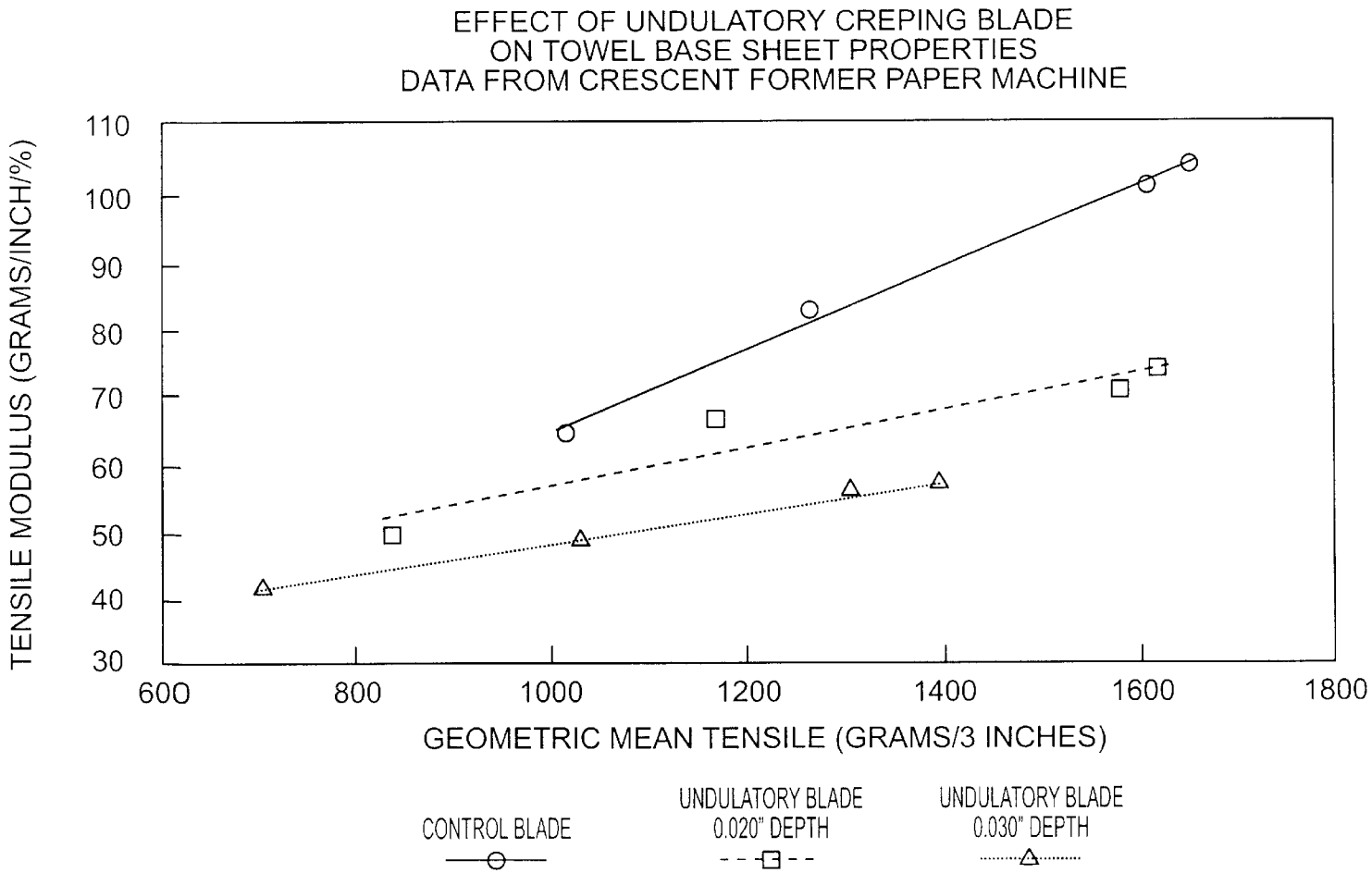
Figure 38:
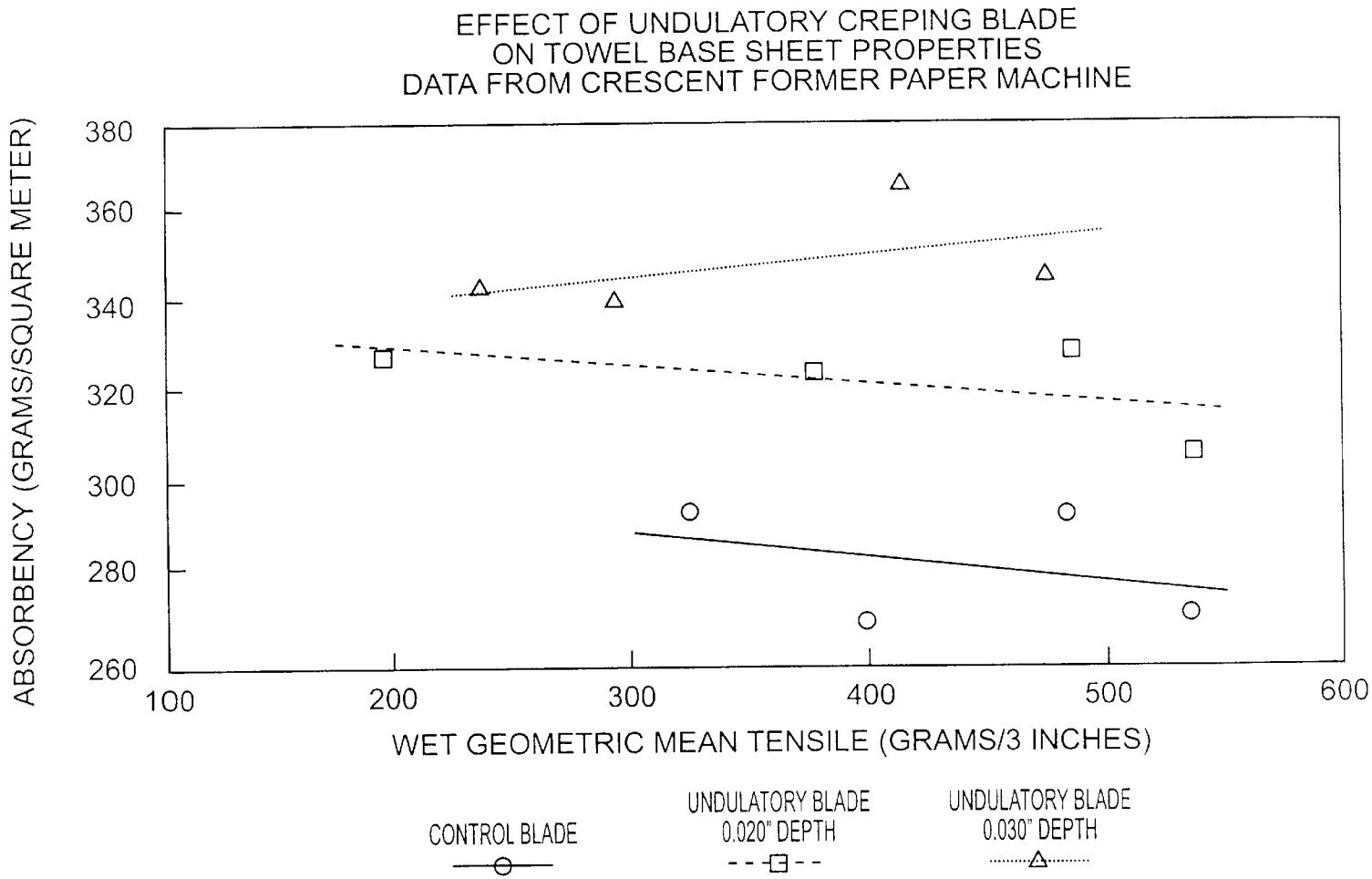

FIGS. 36, 37 and 38 show a comparison of the control blade and the creping blades of the present invention for the properties of caliper, tensile modulus, and absorbency. For caliper and tensile modulus, the properties are graphed as functions of the sheet's dry tensile strength. Absorbency is graphed as a function of wet tensile strength. In all three graphs, the property values have been normalized to their target (16 lbs/ream) basis weight.

The graphs show that the base sheets made using the creping blades of the present invention have specific caliper, modulus, and absorbency values that surpass those exhibited by the control sheets. It should be remembered that tensile modulus correlates negatively with product softness and thus a lower value is preferred.

Figure 39:
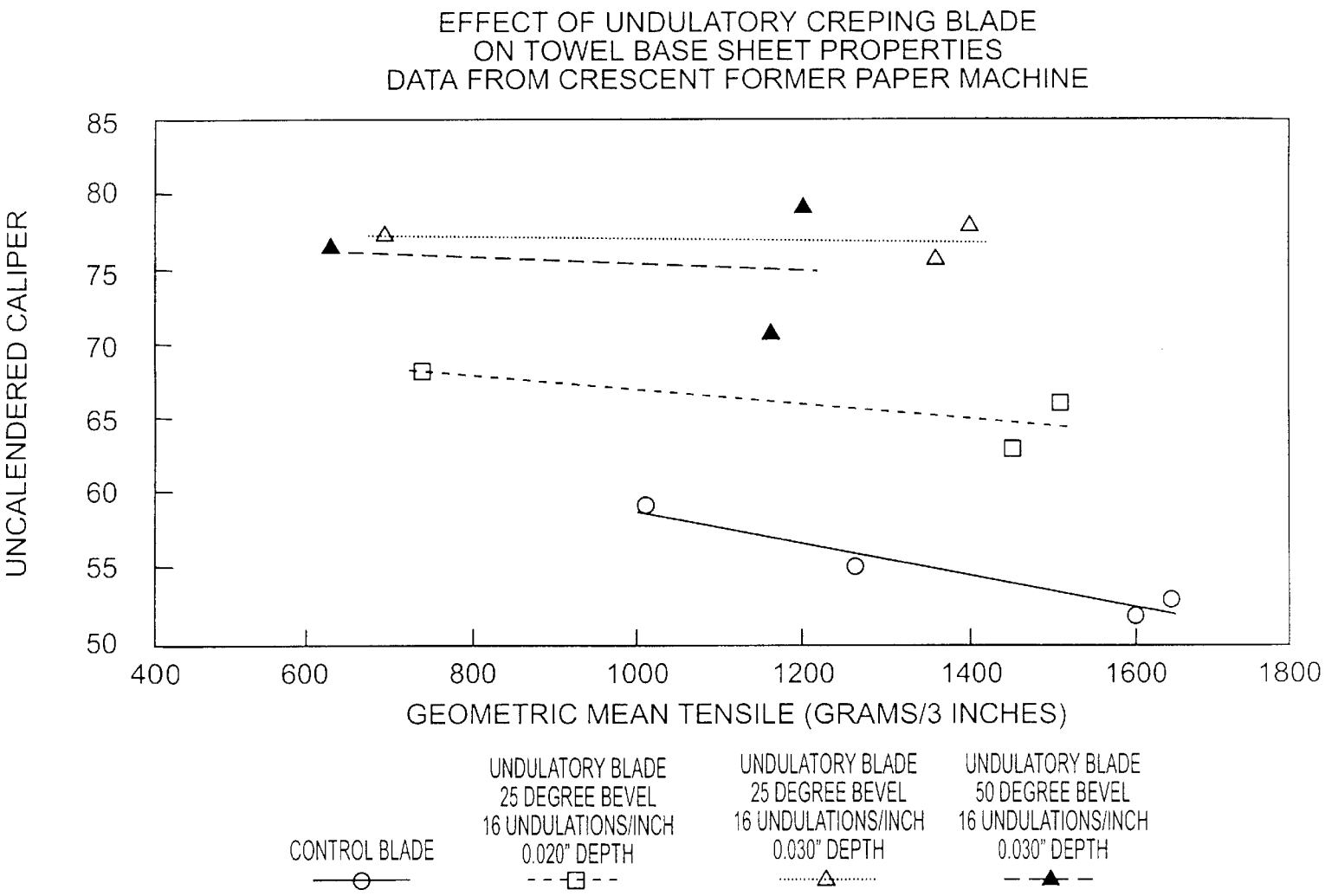
Figure 40:
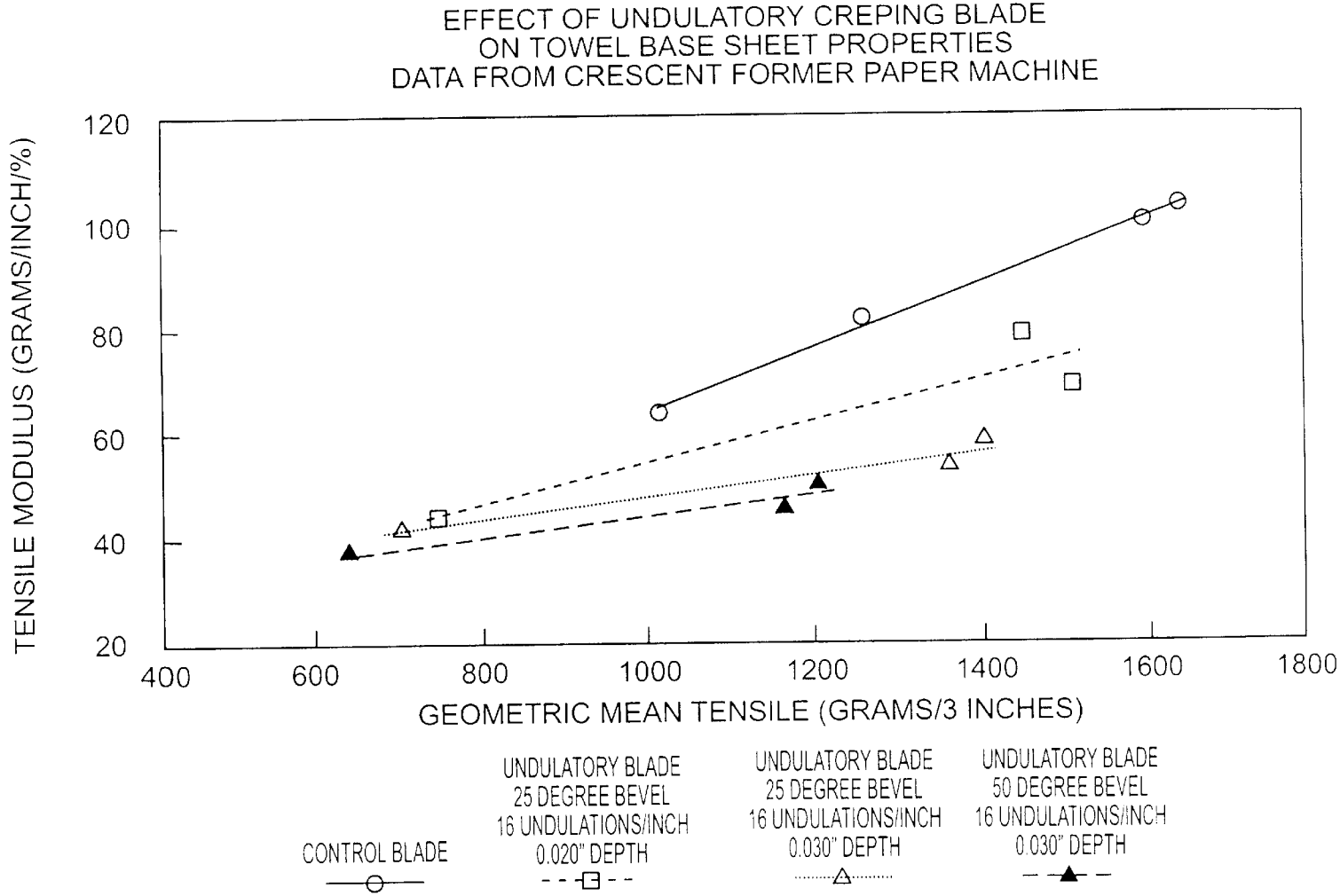
Figure 41:
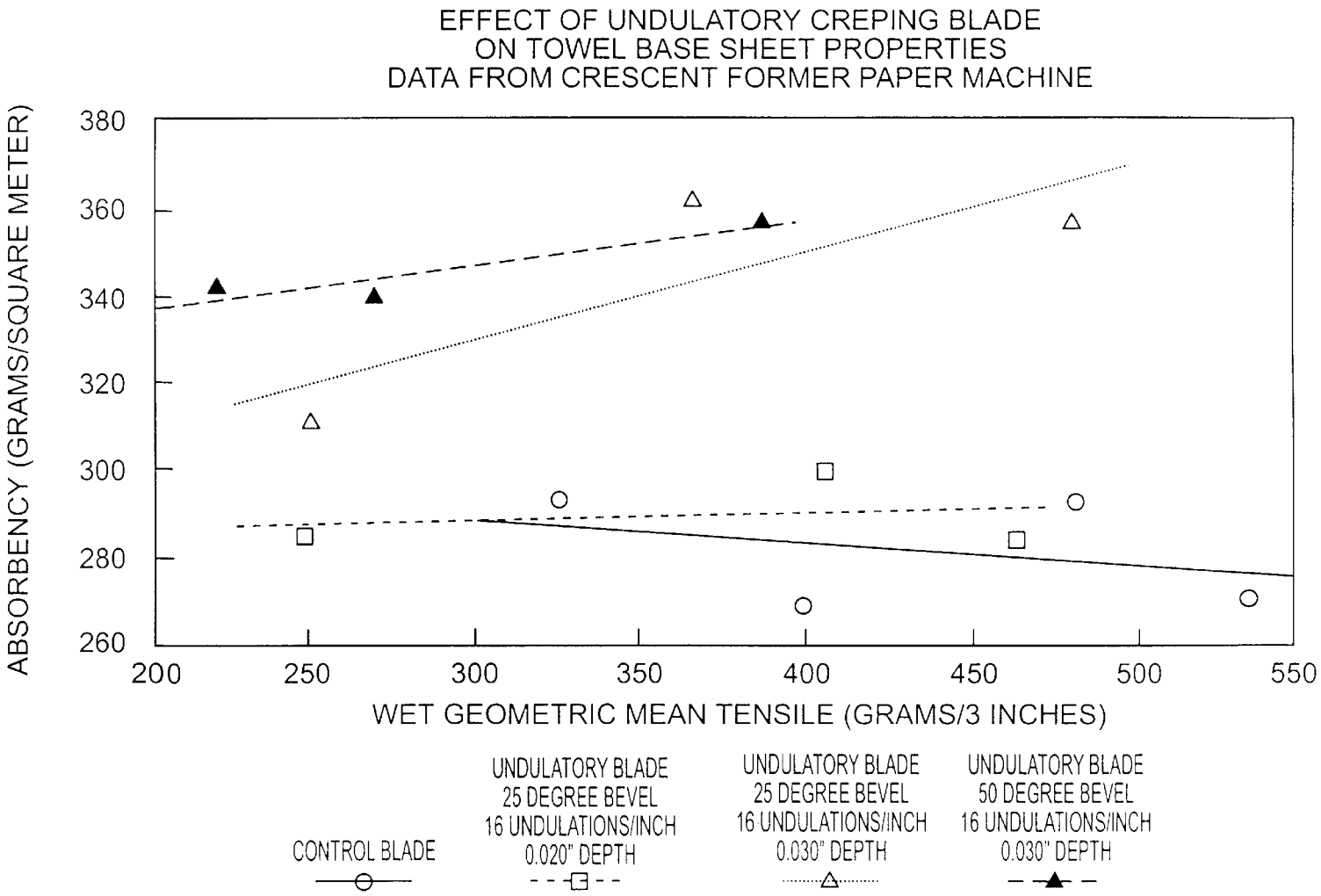

FIGS. 39, 40 and 41 compare the control sheets at 16. lbs/ream to biaxially undulatory base sheets that were made at a targeted weight of 14 lbs/ream. These figures show the caliper, modulus, and absorbency values of the base sheets as function of either their dry or wet tensile strength. As can be seen from the graph, the lighter-weight sheets made using the creping blades of the present invention equal or surpass those of the control sheet in all three properties, despite the control sheet's 14% advantage in basis weight.

EXAMPLE 16

This example illustrates that use of the creping blade of the present invention may result in an extended creping blade life. An undulatory creping blade having a 25° bevel, a notch frequency of 20 notches/inch, and a notch depth of 0.020 inch was installed on a crescent former paper machine running at a Yankee speed of 3465 ft/min. The blade wear angle $\gamma_w$ was 17°. The tissue sheet was composed of 60% Southern Hardwood Kraft, 30% Northern Softwood Kraft, and 10% Broke. The strength of the sheet was adjusted to the target level by refining of the entire furnish. Tissue sheets were made at two levels of calendering: (1) a heavily calendered sheet made using a calender pressure of 15 pli; and (2) a lightly calendered sheet made at a 3 pli calender pressure. The physical properties of these sheets are shown in Table 14. The run lasted for four hours (three hours at high calendering level, one at lower level), with the same creping blade being used throughout. On a second paper machine run, with the same machine speed and furnish as above, the same undulatory creping blade was reinserted into the blade holder and used to crepe the product. The product was run for three hours using a 17° blade wear angle $\gamma_w$, after which time the blade wear angle $\gamma_w$ was increased to 25°. The product was made using this second blade angle for one and one-half hours, after which the blade was removed. The physical properties of the products made during the second run are also shown in Table 14.

TABLE 14

Physical Properties of Tissue Base Sheet

| | | | | |
|---|---|---|---|---|
| Run Number | 1 | 1 | 2 | 2 |
| Refining level (HP-day/ton) | 5.43 | 5.43 | 5.20 | 5.20 |
| Calender Pressure (pli) | 15 | 3 | 15 | 15 |
| Blade Angle (°) | 17 | 17 | 17 | 25 |
| Basis Weight (lbs/ream) | 9.4 | 9.4 | 9.4 | 9.5 |
| Caliper (mils/8 sheets) | 29.1 | 42.6 | 28.6 | 27.7 |
| Specific Caliper (mils/8 sheets/lb basis weight) | 3.10 | 4.53 | 3.04 | 2.92 |

TABLE 14-continued

| Physical Properties of Tissue Base Sheet | | | | |
|---|---|---|---|---|
| MD Tensile (grams/3 in) | 536 | 560 | 547 | 553 |
| CD Tensile (grams/3 in) | 226 | 234 | 251 | 254 |
| MD Stretch (%) | 16.6 | 19.9 | 16.1 | 14.5 |

As can be seen from the values in the table, the physical properties of the base sheets remained relatively constant throughout both of the machine runs, despite the fact that all of the sheets were creped using a single creping blade. The total run time of this single blade was eight and one-half hours. This time contrasts with the normal blade life of a standard blade, which, on this machine, is typically about four hours.

EXAMPLE 17

Figure 42:
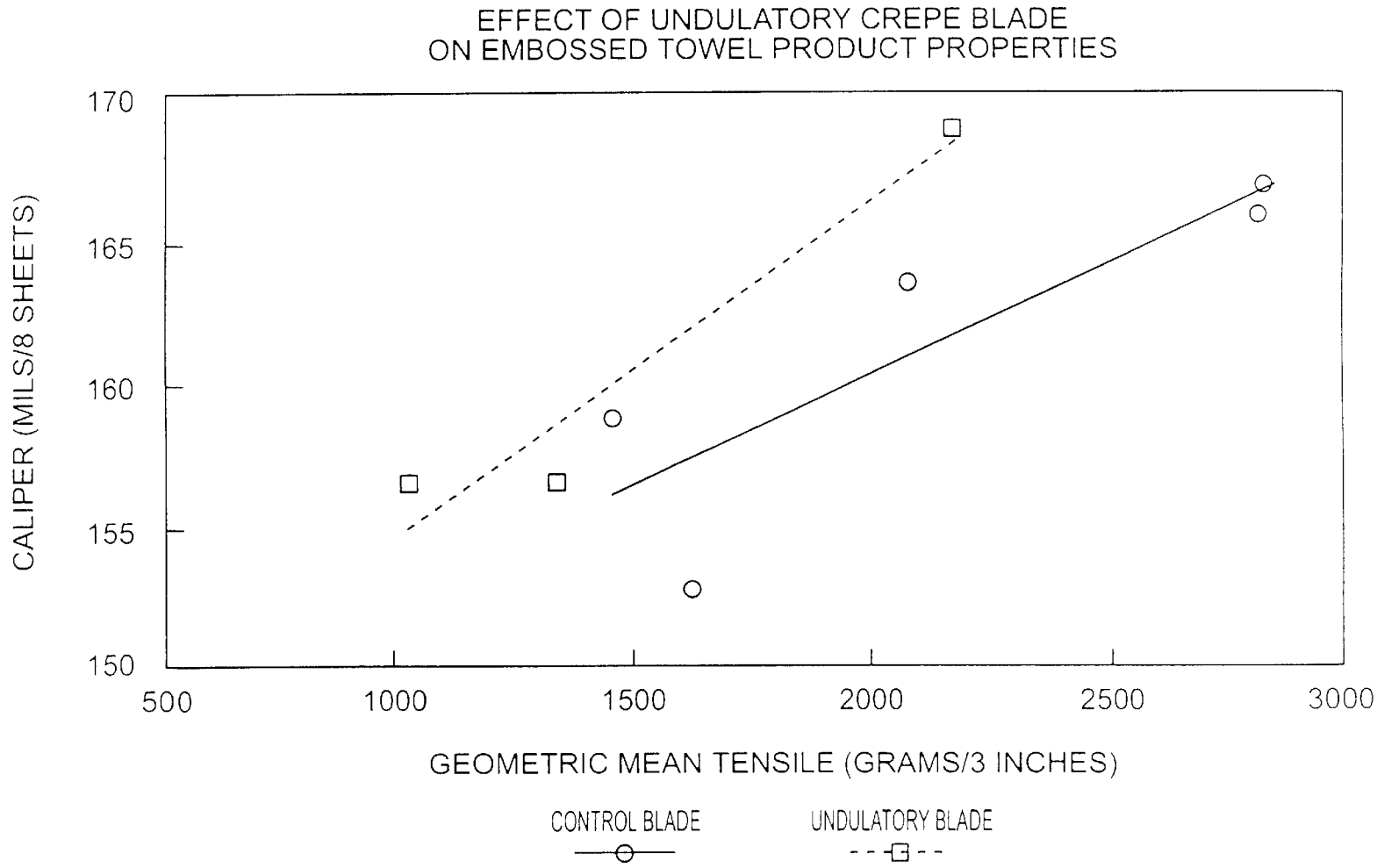
FIGS. 42–44 are graphs showing the effect of creping blades of the invention on embossed towel product properties.
Figure 43:
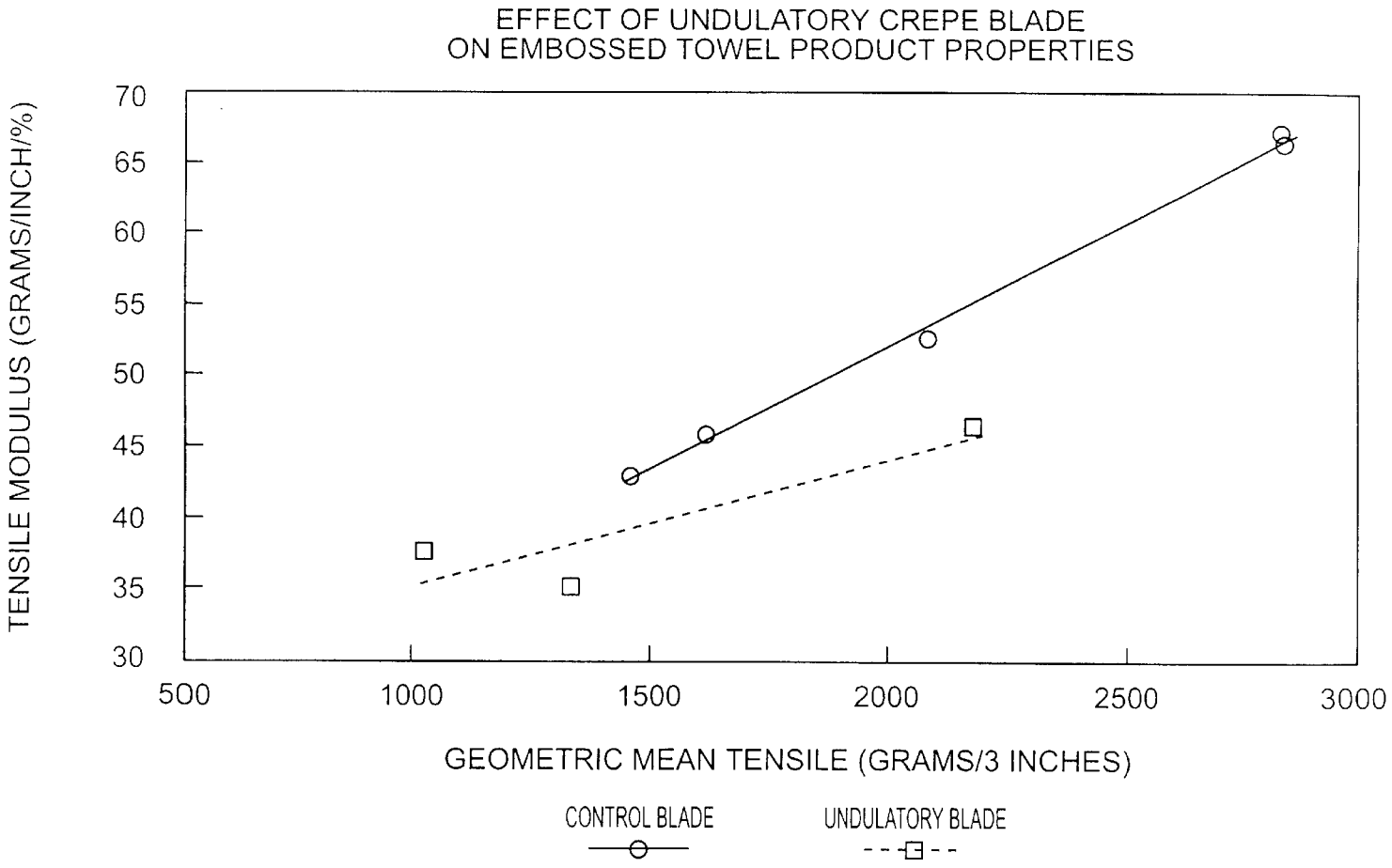
Figure 44:
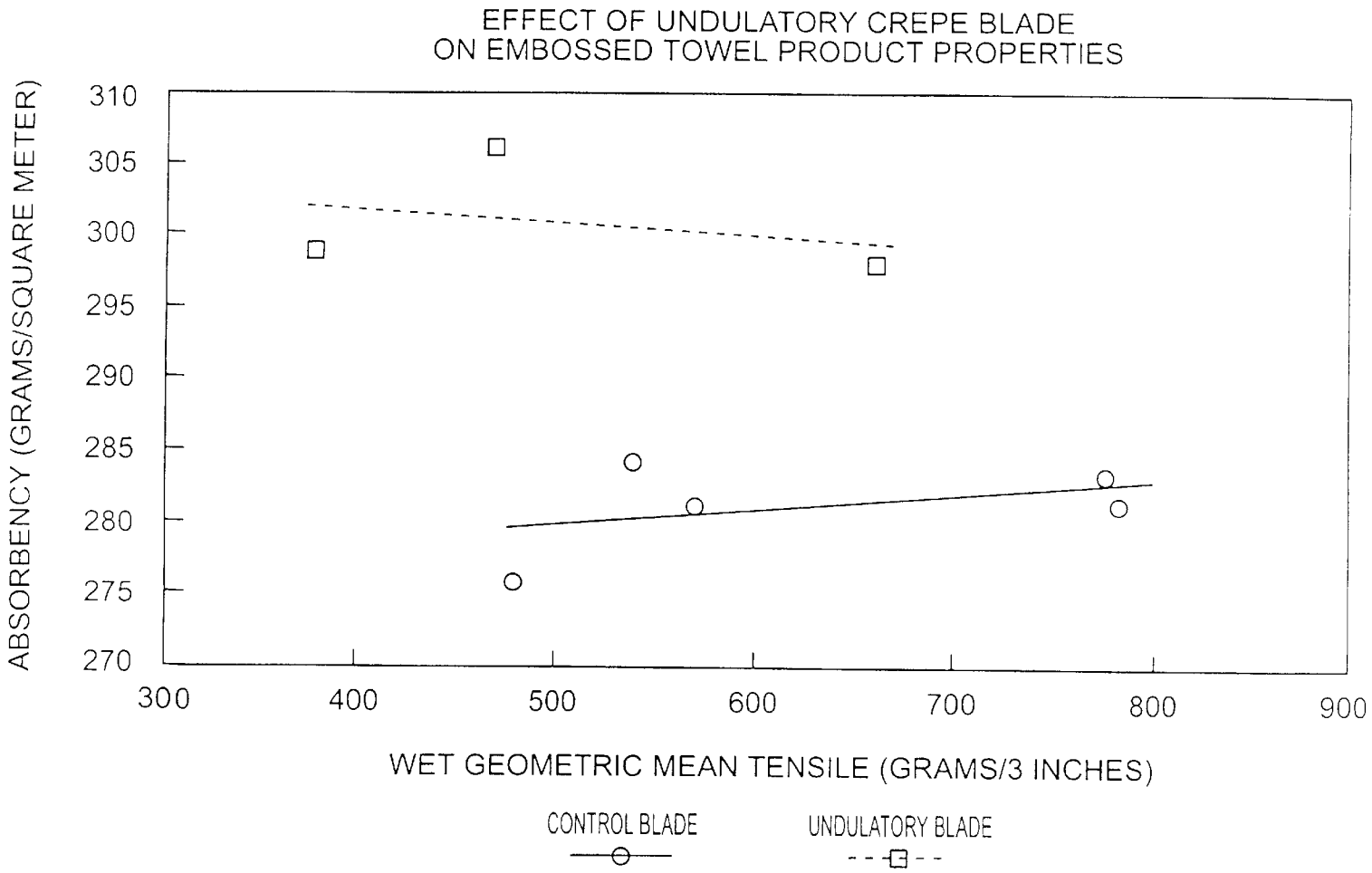

Control towel base sheets from example 15 were selected for converting into two-ply finished towel products. Base sheets produced using a creping blade of the present invention were also chosen for converting. These base sheets were produced on the same paper machine and had the same furnish and same concentration of wet strength resin as did the control sheets. The blade of the present invention employed had a blade bevel of 50°, a notch frequency of 16 notches/inch, and a notch depth of 0.030 inch. The average physical properties for the base sheets that were paired for converting are shown in Table 15. The base sheets produced by both creping methods were embossed using a nested emboss configuration and an emboss depth of 0.080 inch. FIGS. 42–44 compare the embossed product properties of the control and products made with the blade of the present invention. FIG. 42 plots the product caliper as a function of product dry strength. The towels tensile modulus is plotted against dry strength in FIG. 43. FIG. 44 shows absorbency of the two products as a function of their wet tensile strength. As can be seen from the graphs, the product made using the creping blade of the present invention tends to have higher caliper, lower modulus, and higher absorbency at a given wet or dry strength than does the control product. All three of these differences are in the preferred direction.

TABLE 15

Physical Properties of Towel Base Sheets Used in Converting Trial

| | Creping blade Type | | | | | | | |
|---|---|---|---|---|---|---|---|---|
| | Cntrl | Cntrl | Cntrl | Cntrl | Cntrl | Und | Und | Und |
| Blade Bevel (°) | 0 | 0 | 0 | 0 | 0 | 50 | 50 | 50 |
| Notch frequency (notches/inch) | — | — | — | — | — | 16 | 16 | 16 |
| Notch depth (inches) | — | — | — | — | — | 0.030 | 0.030 | 0.030 |
| Basis Weight (lbs/ream) | 15.94 | 15.88 | 15.92 | 16.40 | 16.10 | 16.16 | 16.06 | 15.98 |
| Caliper (mils/8 sheets) | 59.0 | 55.5 | 59.3 | 54.1 | 52.2 | 78.2 | 75.7 | 80.6 |
| Specific Caliper (mils/8 sheets/lb basis weight) | 3.70 | 3.49 | 3.72 | 3.30 | 3.24 | 4.84 | 4.71 | 5.04 |
| MD Dry Tensile (grams/3 in.) | 1296 | 1549 | 1211 | 2007 | 1948 | 1096 | 802 | 1692 |
| CD Dry Tensile (grams/3 inches) | 828 | 1060 | 856 | 1389 | 1948 | 621 | 602 | 992 |
| MD Stretch (%) | 25.0 | 24.9 | 25.2 | 24.2 | 25.7 | 23.6 | 21.,4 | 22.9 |
| CD Stretch (%) | 4.4 | 4.0 | 4.0 | 4.3 | 4.3 | 6.6 | 5.5 | 6.6 |
| Mb Wet Tensile (grams/3 in.) | 482 | 516 | 402 | 724 | 610 | 426 | 231 | 586 |
| CD Wet Tensile (grams/3 in.) | 259 | 309 | 262 | 421 | 338 | 426 | 231 | 586 |
| Absorbency (grams/sq. meter) | 284 | 270 | 293 | 274 | 294 | 340 | 332 | 378 |
| Tensile Modulus (grams/inch/%) | 43.3 | 81.9 | 63.5 | 104.3 | 100.3 | 64.0 | 49.3 | 60.50 |

EXAMPLE 18

This example illustrates increased specific caliper and absorbency for unembossed towel prepared using the blade of the present invention. Towel base sheets were made on a crescent former pilot paper machine at a Yankee speed of 2,000 ft/min and a percent crepe of 20%. The furnish for the sheet was 30% Southern Softwood Kraft and 70% Southern Hardwood Kraft. Fourteen lbs/ton of wet strength enhancer resin, Kymene 557H was added to the furnish to provide wet strength. The base sheets were produced using both a conventional (square) and a creping blade of the present invention. The creping blade of the present invention had a bevel angle of 25°, a notch frequency of 16 notches/inch, and a notch depth of 0.020 inch. The physical properties of these sheets are shown in Table 16. Each of the physical properties reported are the average of two base sheets. From the table, it can be seen that the sheets made using the creping blades of the present invention provided, at approximately the same or higher cross directional wet tensile strength, both improved base sheet caliper and increased water absorbency.

TABLE 16

Physical Properties of Towel Base Sheets

| | Blade Type | |
|---|---|---|
| | Standard | Undulatory |
| Blade Bevel | 0 | 25 |
| Lines/inch | — | 16 |
| Notch Depth | — | 20 |
| Basis Weight (lbs/ream) | 16.94 | 16.95 |
| Caliper (mils/8 sheet) | 55.3 | 76.2 |
| Specific Caliper (mils/8 sheets/lb basis weight) | 3.26 | 4.50 |
| MD Dry Ten. (grams/3 in) | 1814 | 1535 |
| CD Dry Ten. (grams/3 in) | 1126 | 1072 |
| CD Wet Ten. (grams/3 in) | 314 | 352 |
| Absorbency (grams/square meter) | 296 | 381 |

EXAMPLE 19

This example illustrates that when the towel base sheets described in Example 18 were embossed in a point-to-point configuration lower emboss depth was required. For all base sheets, the embossed towel product was produced with the air sides of the base sheets on the outside of the converted product. Each ply of the control base sheet was embossed at a penetration depth of 0.095" prior to the two sheets being joined together to form the two-ply finished product. For the base sheets made using the creping blade of the present invention, the penetration depth was 0.050" for one sheet and 0.090" for the other. Because of the higher-caliper base sheet resulting from use of the undulatory creping blade, it was possible to create an embossed towel having a similar finished caliper and roll diameter to that of the control product using a lower penetration depth. Table 17, which lists the physical properties of the two embossed towels, shows that the lower emboss depth allowed by the blade of the present invention, has resulted in a towel having higher strength (both wet and dry) than that of the more heavily embossed control.

TABLE 17

Physical Properties of Embossed Towel Products

| | Blade Type | |
|---|---|---|
| | Standard | Undulatory |
| Blade Bevel | 0 | 25 |
| Lines/inch | — | 16 |
| Notch Depth | — | 20 |
| Emboss Depth (in) | 0.095/0.095 | 0.050/0.090 |
| Basis Weight (lbs/ream) | 32.16 | 33.08 |
| Caliper (mils/8 sheet) | 148.9 | 150.0 |
| Specific Caliper (mils/8 sheets/lb basis weight) | 4.63 | 4.53 |
| MD Dry Ten. (grams/3 in) | 2391 | 2654 |
| CD Dry Ten. (grams/3 in) | 1119 | 1823 |
| MD Wet Ten. (grams/3 in) | 714 | 801 |
| CD Wet Ten. (grams/3 in) | 347 | 518 |
| Absorbency (grams/square meter) | 291 | 337 |
| Roll Diameter (inches) | 4.33 | 4.31 |
| Roll Compression (%) | 19.0 | 19.7 |

EXAMPLE 20

This example illustrates the improved properties obtained when using the blade of the present invention in the manufacture of towels comprising up to 30% anfractuous fiber. Towel base sheets were made from a furnish containing 40% Southern Hardwood Kraft, 30% Southern Softwood Kraft, and 30% HBA. HBA is commercially available Softwood Kraft pulp from Weyerhauser Corporation that has, been rendered anfractuous by physically and chemically treating the pulp such that the fibers have permanent kinks and curls imparted to them. Inclusion of these fibers in a towel base sheet will serve to improve the sheet's bulk and absorbency. A control base sheet made from this furnish was creped using a standard creping blade having a 5° bevel. Base sheets having similar strength were also made employing a creping blade of the present invention having a 25° bevel, 20 notches per inch, and a notch depth of 0.020 inch. Both base sheets contained 20 lbs of wet strength resin and 7 lbs of carboxymethyl cellulose per ton of pulp as additives. The physical properties of the towel base sheets are shown in Table 18. Each value represents the average of two base sheet values. Both products have similar strength levels, both wet and dry. However, the sheet made using the creping blade of the present invention exhibits higher specific caliper and absorbency than does the control sheet, indicating that even products containing substantial amounts of bulking fiber can have their properties enhanced by use of the creping blade of the present invention.

TABLE 18

Physical Properties of HBA-Containing Base Sheet

| Product | Control | Blade of the invention |
|---|---|---|
| Basis Weight (lbs/ream) | 15.13 | 15.32 |
| Caliper (mils/8 sheets) | 66.68 | 78.18 |
| Specific Caliper (mils/8 sheets/lb basis weight) | 4.41 | 5.10 |
| MD Dry Tensile (grams/3 in) | 1102 | 1149 |
| CD Dry Tensile (grams/3 in) | 886 | 852 |
| MD Stretch (%) | 24.9 | 22.6 |
| CD Stretch (%) | 5.3 | 6.4 |
| MD Wet Tensile (grams/3 in) | 442 | 406 |
| CD Wet Tensile (grams/3 in) | 289 | 269 |
| Absorbency (grams/sq. meter) | 386 | 438 |

EXAMPLE 21

This example illustrates the manufacture of towel base sheets using blades having alternating undulatory patterns (i.e. non-uniform notch). Towel base sheets were made from a furnish containing 50% Northern Softwood Kraft, 50% Northern Hardwood Kraft. Sixteen pounds of wet strength resin per ton of pulp was added to the furnish. Base sheets were made at several strength levels, with the strength being controlled by refining of the total furnish. In addition to control sheets, which were made by creping the tissue from the Yankee dryer using a square (0° bevel) creping blade, towel products were also made using several creping blades of the present invention. All of the blades of the present invention had a blade bevel of 25°. One of the blades had a notch frequency of 20 notches/inch and a notch depth of 0.020 inch. Alternative undulating patterns were employed in making the other two creping blades of the present invention. One of the blades had 40 notches/inch with notch depths of 0.020 and 0.009 inch alternating. This blade is shown schematically in FIG. 9. The other alternatively blade of the present invention used during the trial contained half-inch sections along the length of the blade that alternated between sections that exhibited a notch frequency of 20 notches/inch and a notch depth of 0.020 inch and sections having a 40 notch/inch notch frequency and a 0.009 inch notch depth. FIG. 10 is a schematic representation of this blade. Throughout the examples in this specification, it should be understood that the generators of the notch surface (e.g., knurling tool) are generally perpendicular to the adjacent side surface of the blade unless indicated to the contrary.

Figure 45:
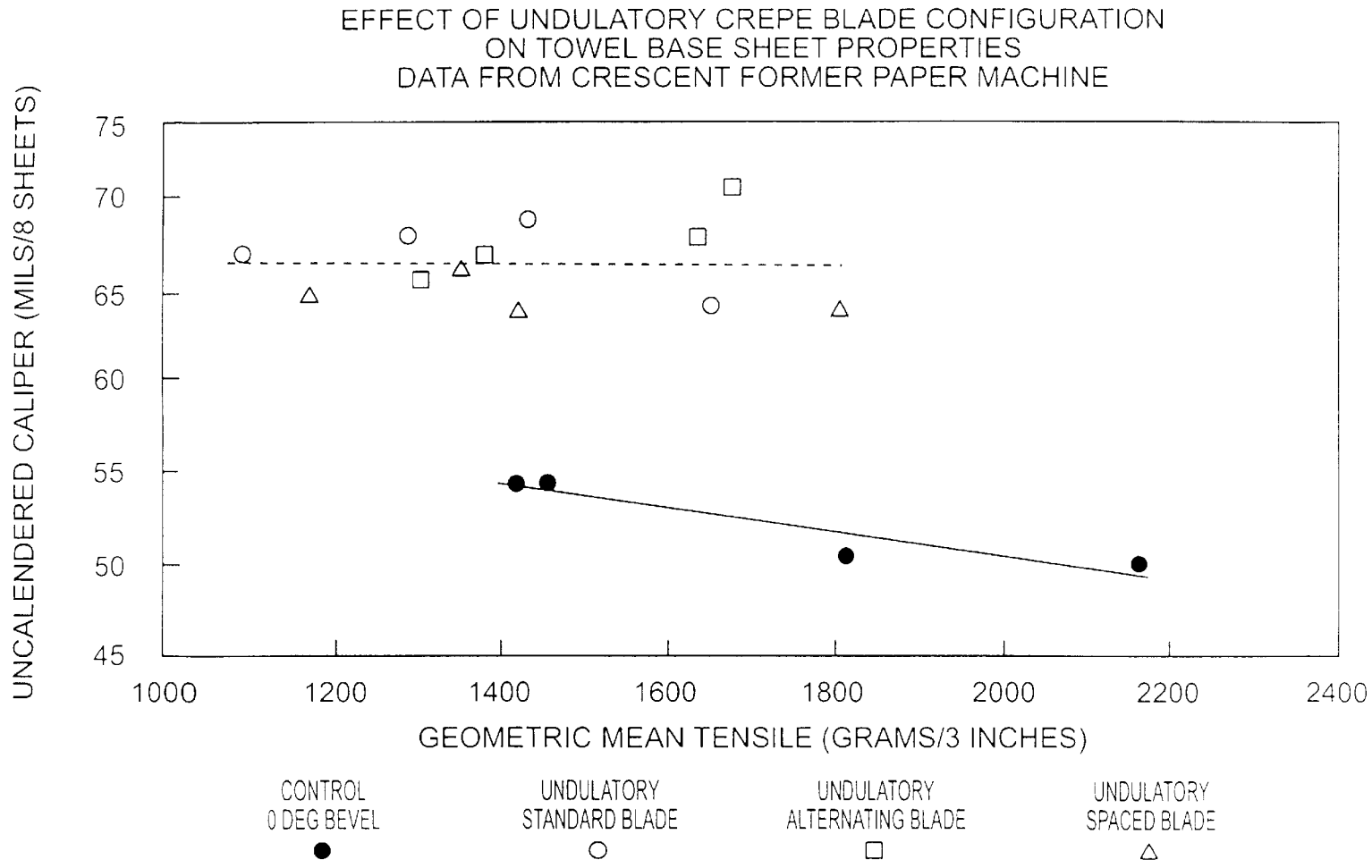
FIGS. 45–48 are graphs showing the effect of the configurations of creping blades of the invention on towel base sheet properties.
Figure 46:
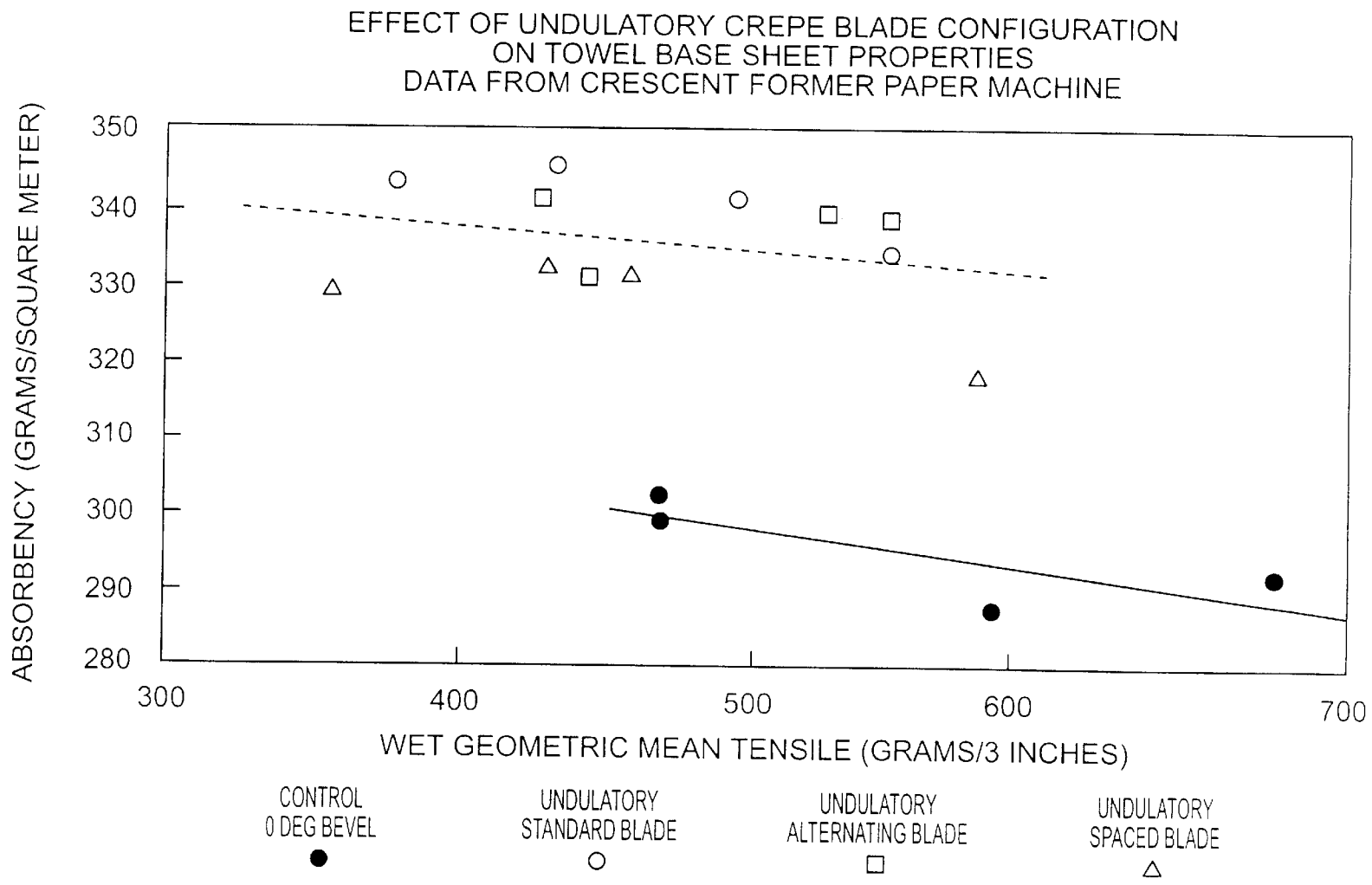

The properties of the base sheets produced by use of these various creping blades are shown in FIGS. 45 and 46. FIG. 45 shows the base sheet caliper of the products as functions of their dry tensile strengths, while FIG. 46 plots the base sheet's absorbencies against its wet tensile strengths. As the figures show, the base sheets made using the various creping blades of the present invention all have calipers and absorbencies well above those exhibited by the control base sheet at a given level of wet or dry strength. It can also be seen that the sheets produced by the three undulatory creping blades have similar bulk and absorbency properties, despite the differences in blade geometry.

Figure 47:
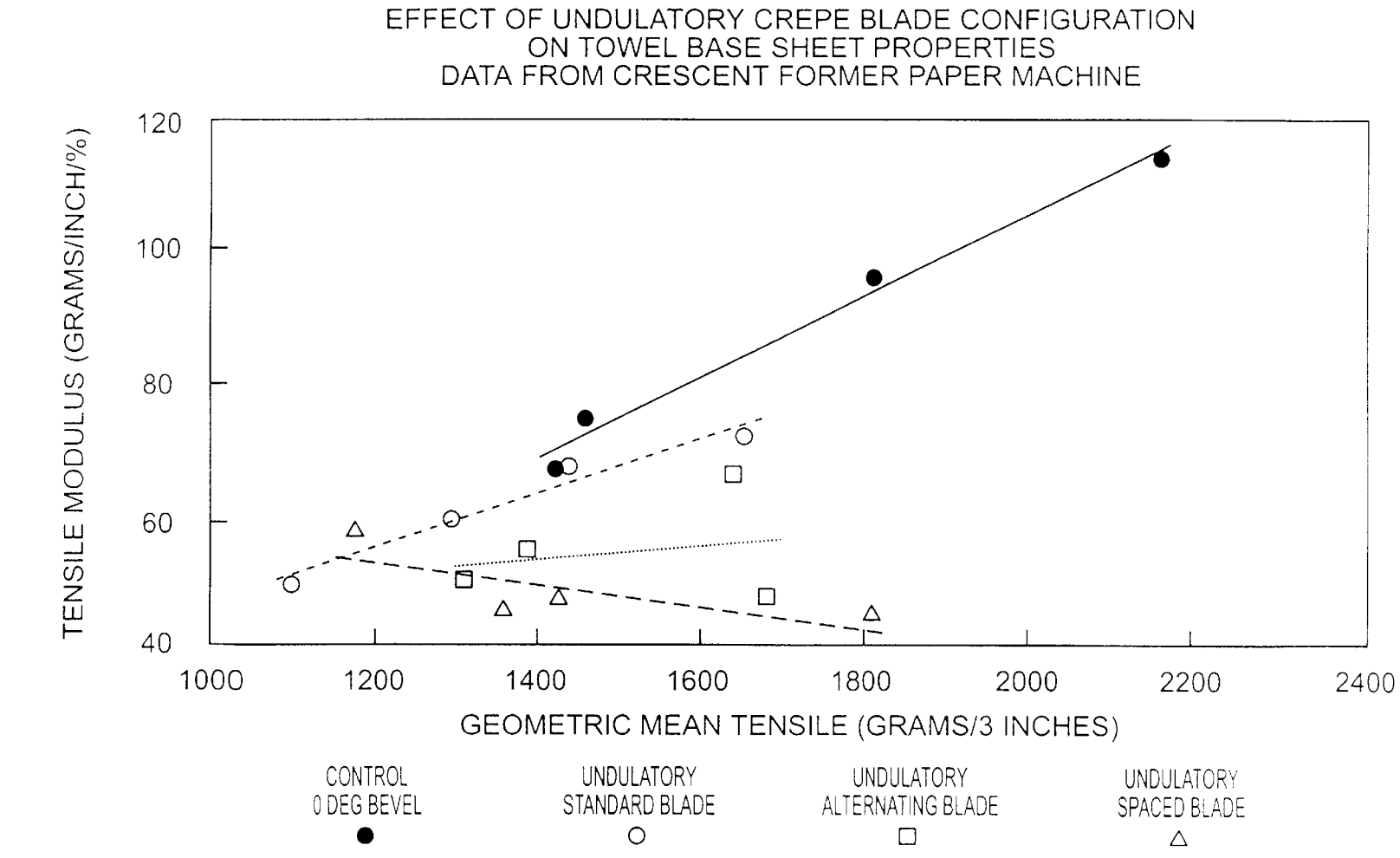
Figure 48:
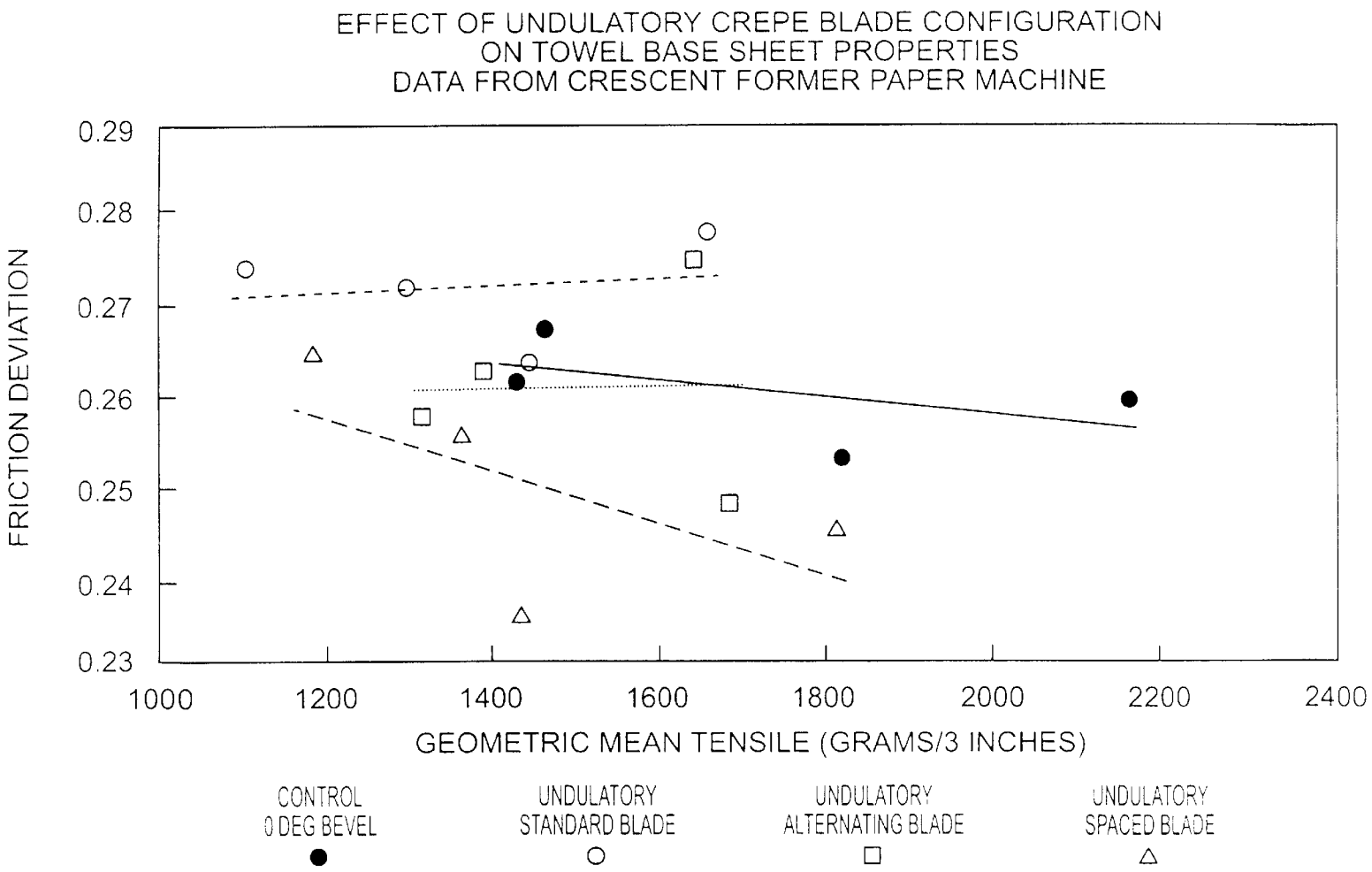

FIGS. 47 and 48 show the values of tensile modulus and friction deviation of the sheets made using the control and blades of the present invention as functions of their tensile strength. In FIG. 47, it can be seen that the base sheets made using the blades of the present invention all tend to have tensile module equal to or less than those made using the standard blade, and that the lowest modulus values are achieved by base sheets creped using the blades of the present invention employing the alternating undulatory pattern. In FIG. 48 it can be seen that the base sheet made using the blade of the present invention with a 20 notches/inch frequency and 0.020-inch notch depth has a slightly higher friction deviation than the control, while the blades made using the alternating undulatory pattern geometry produce base sheets that have friction deviation values that are essentially equal to or lower than those produced by the control blade.

Secondary fiber, 20% Western Softwood Kraft, and 20% magnetite pulp. Twelve pounds of wet strength resin per ton of fiber was added to the furnish. The sheets were made at a machine (Yankee) speed of 50 ft/min and a 15% crepe. The target basis weight was 24 lbs/ream. The base sheets were partially dried to one of several selected levels on the Yankee dryer, creped in the partially dried state, and dried to the final desired solids level using conventional can dryers.

Three creping blades were used in creping the product: a conventional 15° blade and two undulatory creping blades. Both of the undulatory blades had a 15° blade bevel. One of the undulatory blades had 20 notches per inch and a notch depth of 0.020 inch. The other blade had 12 notches per inch and a notch depth of 0.025 inch. Both of these blades were dressed (as shown in FIG. 6B) such that the protrusion were completely removed, leaving a flat surface on the back (Yankee) side of the blade.

The physical properties of the base sheets are shown in Table 19. From the table, it can be seen that use of the blades of the present invention results in increased base sheet caliper for the sheets creped at 67 and 76% solids. It is our experience that absorbency in this type of product generally follows caliper. Although no gain in specific caliper was seen for the sheets creped at 54% solids using the creping blade of the present invention, machine direction ridges resulting from the sheet's contact with the blade's notches were observed in the sheet. It can be seen from the table that the gain in specific caliper resulting from use of the creping blade of the present invention increases with increasing creped solids content.

TABLE 19

Wet-Crepe Towel Trial Using Undulatory Creping blade

| | Creping blade Type | | | | |
|---|---|---|---|---|---|
| | Pulp Freeness CSF | % Solids at Creping blade | Caliper/Basis Weight | Dry GM Tensile/Basis Weight | Wet GM Tensile/Basis |
| Standard: 15 deg bevel | 470 | 54 | 2.36 | 248.2 | 72.7 |
| Undulatory: 15 deg bevel, 20 notches/inch, 0.020" deep | 470 | 54 | 2.38 | 243.2 | 72.9 |
| Undulatory: 15 deg bevel, 12 notches/inch, 0.025" deep | 470 | 54 | 2.30 | 236.5 | 70.7 |
| Standard: 15 deg bevel | 580 | 67 | 2.47 | 185.1 | 54.5 |
| Undulatory: 15 deg bevel, 20 notches/inch, 0.020" deep | 580 | 67 | 2.75 | 169.2 | 52.9 |
| Undulatory: 15 deg bevel, 12 notches/inch, 0.025" deep | 580 | 67 | 2.93 | 179.0 | 52.7 |
| Standard: 15 deg bevel | 380 | 76 | 1.82 | 296.7 | 87.5 |
| Undulatory: 15 deg bevel, 20 notches/inch, 0.020" deep | 380 | 76 | 2.25 | 262.8 | 78.7 |
| Undulatory: 15 deg bevel, 12 notches/inch, 0.025" deep | 380 | 76 | 2.57 | 272.7 | 83.0 |

As both tensile modulus and friction deviation are inversely related to sheet softness, the results of this trial suggest that use of these alternating undulatory patterns may be used to produce softer base sheets without sacrificing thickness or absorbency.

EXAMPLE 22

This example illustrates the preparation and properties of wet crepe towel base sheet. Towel base sheets were made using the wet crepe process. The furnish contained 60%

Two of these sheets were analyzed for free-fiber ends (FFE) in the same manner as described in Example 7. The first was the sheet creped using the control blade that had been dried to 76 percent solids prior to creping. The second was the sheet creped using the blade of the present invention having 12 notches/inch. This sheet had been dried to 76% solids prior to creping. The results of this analysis showed a FFE count of 4.3 free-fiber ends/1.95 mm length of tissue for the base sheet made using the blade of the present invention versus a count of 3.2 free-fiber ends/1.95 mm for the sheet made using the standard creping blade. This larger number of free-fiber ends for the product made using the creping blade of the present invention might be considered to aid the surface softness perception of the towel product.

Figure 14A:
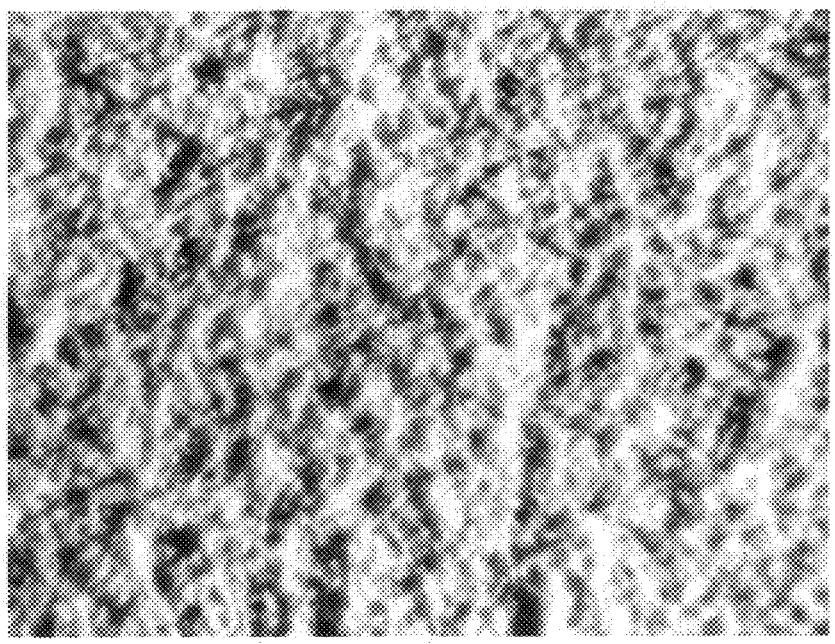
FIG. 14A is a photomicrograph (16 times) showing the prominent machine direction undulations of a Yankee side of a wet creped sheet produced with a conventional creping blade having a 15° bevel.
Figure 14B:
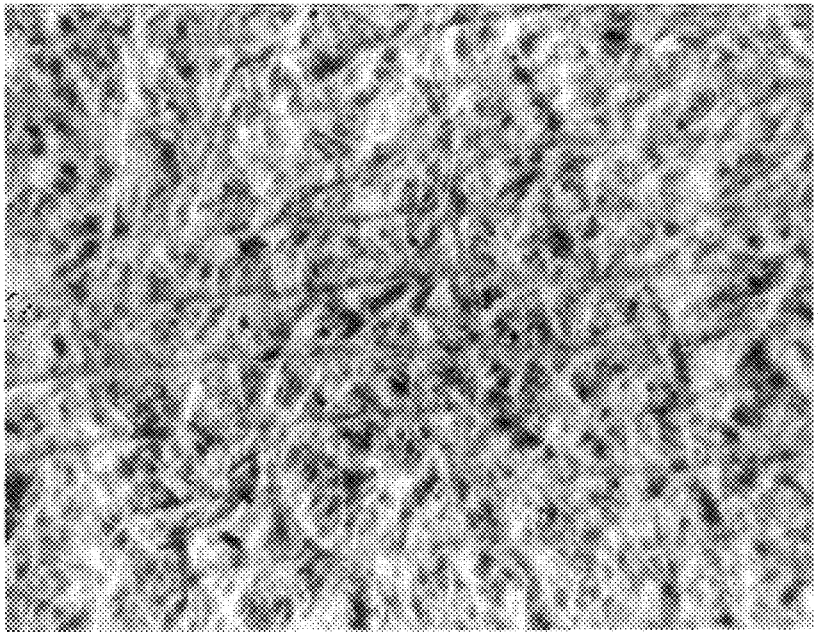
FIG. 14B is a photomicrograph (16 times) showing the prominent machine direction undulations of an air side of a wet creped sheet produced with a conventional creping blade having a 15° bevel.
Figure 14C:
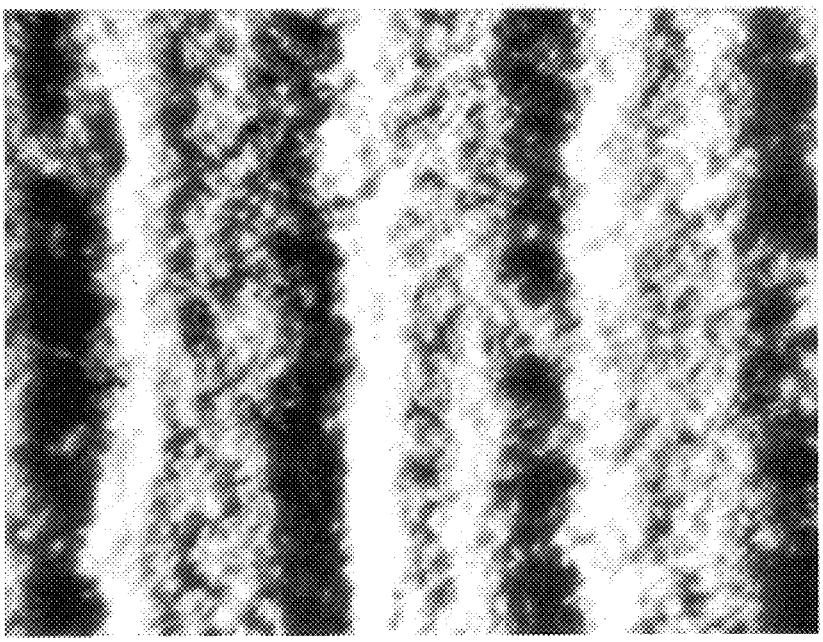
FIG. 14C is a photomicrograph (16 times) showing the prominent machine direction undulations of a Yankee side of a wet creped sheet produced with one of the creping blades of the invention having a 15° bevel, a notch frequency of 12 notches/inch, and a notch depth of 0.025 inch.
Figure 14D:
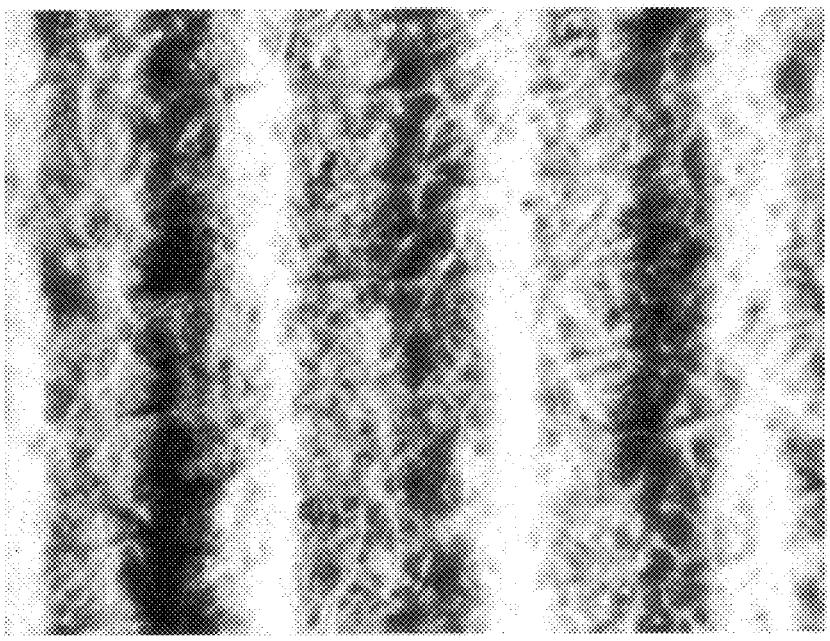
FIG. 14D is a photomicrograph (16 times) showing the prominent machine direction undulations of an air side of a wet creped sheet produced with one of the creping blades of the invention having a 15° bevel, a notch frequency of 12 notches/inch, and a notch depth of 0.025 inch.

Photomicrographs (16 times magnification) of both sides of the two base sheets that were analyzed for FFE are shown in FIGS. 14A–D. FIGS. 14A and 14B show the Yankee and air sides, respectively, of the sheets made using the creping blade of the present invention, while the Yankee and air sides of the sheet made using the control creping blade are shown in FIG. 14C and 14D, respectively. FIGS. 14A and 14B clearly show the machine-direction ridges present in the sheet creped using the blade of the present invention. The crepe frequency for the two base sheets can be seen in FIGS. 14A and 14C, which show the sheets' Yankee sides. From the figures it can be seen that the spacing of crepe lines for both sheets is similar, indicating that the use of the creping blade of the present invention did not significantly alter the sheet's crepe frequency.

EXAMPLE 23

This example illustrates the applicability of the blade of the present invention to through air drying (TAD) processes for the manufacture of tissue and towel. Tissue and towel base sheets were made on a pilot paper machine. The furnish for both products was 50% Northern Softwood Kraft and 50% Northern Hardwood Kraft. The tissue sheets were made at a target basis weight of 18 lbs/ream. The weight target for the towel sheets was 15 lbs/ream. Wet strength resin was added to the towel furnish at a level of 12 lbs of resin per ton of fiber. The dry strength of the tissue base sheets was controlled by addition of starch to the furnish. Refining of the entire furnish was used to control the towel furnish strength.

The sheets were formed on an inclined wire former, transferred to a through-air-drying fabric, partially dried using a through-air-dryer (TAD), and then pressed onto a Yankee dryer for completion of drying. The fabric used to transport the sheet through the TAD and press it against the Yankee dryer had a weave of 44 strands/inch in the machine direction by 38 strands in the cross direction. The machine direction strands were 0.01375 inch in diameter while the diameter of the cross direction strands was 0.01575 inch. Use of this fabric to transfer the sheet to the Yankee dryer resulted in a non-uniform pressing of the sheet against the dryer. The moisture level of the sheets exiting the TAD was in the range of 29 to 38 percent for the towel product and 38 to 47 percent for the tissue sheets.

Most of the sheets were creped from the Yankee dryer using a standard creping blade having a bevel of 8°. For some of the products, a creping blade of the present invention was also employed. A blade having a 15° blade bevel, 20 notches/inch, and a notch depth of 0.020" was used for one of the towel base sheets. For the tissue sheets, the same blade and another undulatory creping blade having a blade bevel of 15°, a notch frequency of 12 notches/inch, and a notch depth of 0.032 inch were employed.

Figure 49:
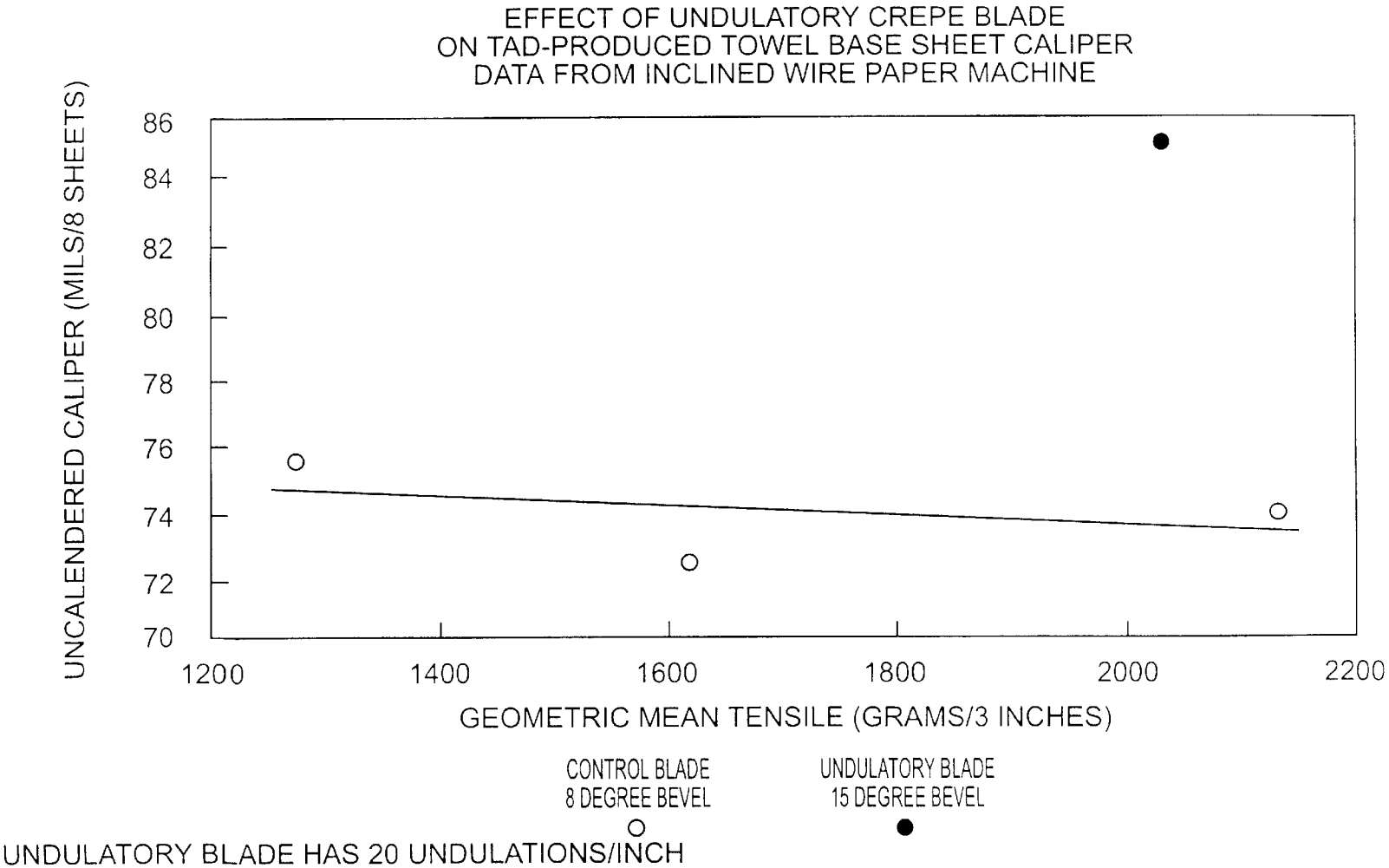
FIG. 49 is a graph showing the effect of one of the creping blades of the invention on the caliper of towel base sheet manufactured using the through air drying (TAD) process.
Figure 50:
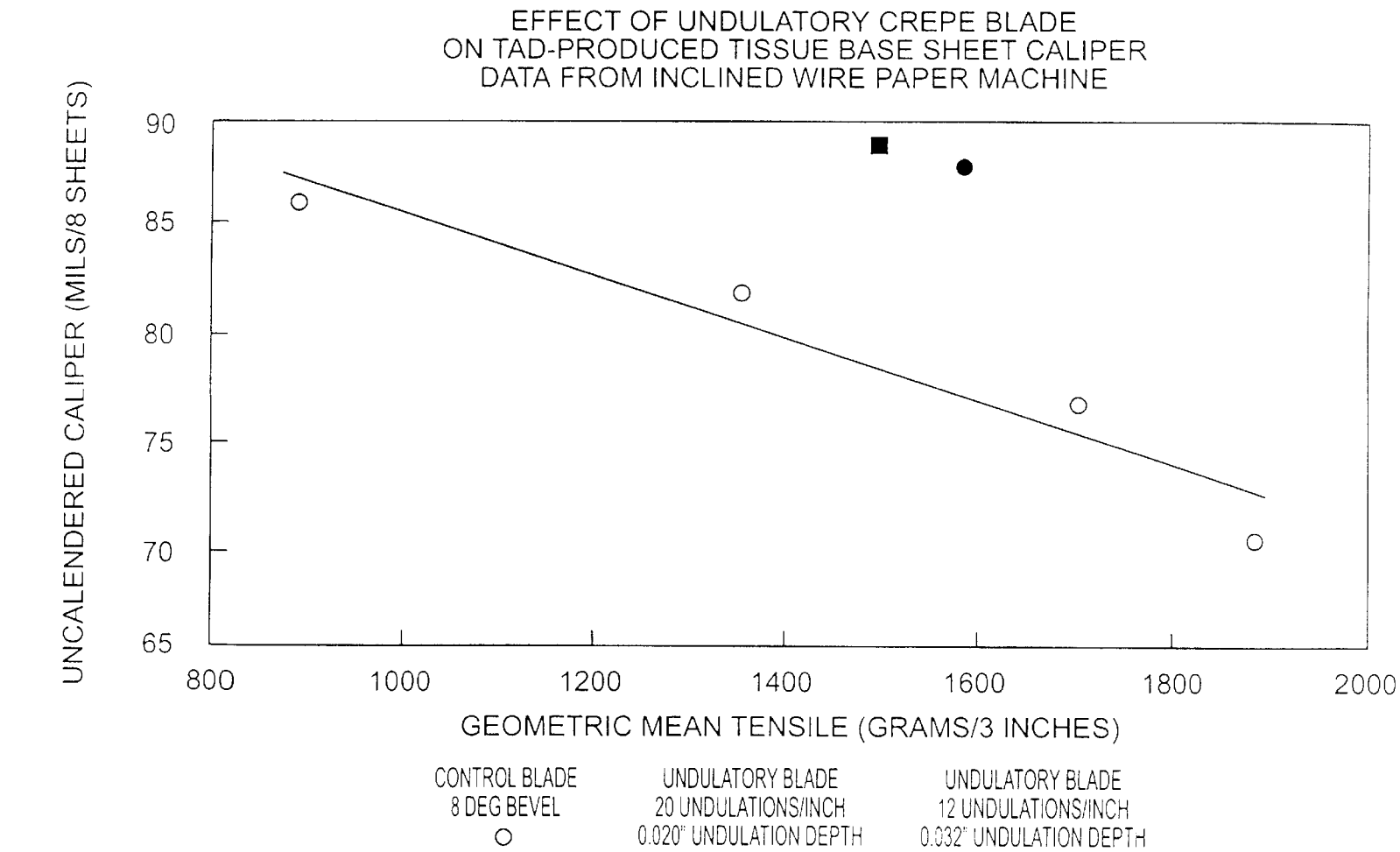
FIG. 50 is a graph showing the effect of one of the creping blades of the invention on the caliper of TAD-produced tissue base sheet.

The results of physical tests performed on these base sheets are shown in FIGS. 49 and 50, which plot the base sheets' uncalendered calipers as a function of the sheets' tensile strength. From the graphs it can be seen that the use of the creping blades of the present invention increased the base sheet caliper approximately 10 to 15 percent.

EXAMPLE 24

This example illustrates various blades of the present invention. Some of the blades have protrusions, while others are flush dressed. The blades were used with light and heavy tissue base sheets for single-and two-ply tissues. The single-ply product was made using a 25° beveled blade that had been knurled at a spacing of 20 notches/inch and a depth of 0.020 inch. The base sheet made at the two-ply weight was creped using a blade having a bevel of 15°, a notch frequency of 20 notches/inch, and a notch depth of 0.020 inch. Both the single- and two-ply sheets were calendered while on the paper machine. The details of the sheets' furnish and physical properties are shown in Table 20. For both of the products, base sheet samples were generated using blades of the present invention that were dressed to leave the protrusions ("relief dressing") and also using blades that had been dressed "flush". The dressed blades were treated such that the relieved "burr" or "foot" that is produced on the back side of the blade during the knurling process is shaped at an angle equal to the blade wear angle when the blade is in use (See FIG. 6A). For the blades having the flush dressing (FIG. 6B), the protrusions were completely removed, leaving a blade that was completely flat across its back (Yankee) side.

The single-ply-weight product ran well using both the blade that had received the relief dressing and the blade for which the protrusions had been removed. It was observed that the pattern of machine direction ridges produced by the creping blade was not as pronounced on the sheet made using the flush-dressed blade as was the case for the product made using the blade with the dressed protrusions.

When the product made at the two-ply basis weight was run using the flush-dressed blade, the sheet ran for approximately five minutes before suffering a break after the creping blade. Several efforts to rethread the sheet and continue winding it were unsuccessful, as the sheet continued to break between the creping blade and the reel. Finally, the attempts to continue to run using the blade were halted and the flush-dressed creping blade was replaced with an blade of the present invention that had been dressed using the relieved dressing technique leaving the protrusions. Use of this blade allowed the sheet to be threaded and wound without difficulty.

Comparison of the values in Table 20 indicates that sheets having similar physical properties can be made using creping blades that employ either the relieved or flush dressing technique. There is some indication that a blade that has been flush dressed may produce a base sheet that has slightly lower specific caliper and higher strength than will result from use of a blade made using the relieved dressing technique. However, from the standpoint of runnability, especially for lighter-weight products, it appears that the relieved dressing technique offers an advantage over the flush-dressing method. In addition to operational advantages, the relief-dressed blade offers the additional benefit of being much easier and faster to prepare than the flush-dressed blade. This consideration is particularly important when the time and effort needed to flush dress a blade to be used in a wide commercial tissue machine is considered.

TABLE 20

| Undulatory Creping blade Study | | | | |
|---|---|---|---|---|
| | Product | | | |
| | Single-Ply Weight | | Two-Ply Weight | |
| Furnish | 52% NHWK; 28% NSWK; 20% Broke | | 65% NHWK; 35% NSWK | |
| Calendering Load (pli) | 9.6 | | 10.8 | |
| Blade Dressing | Relieved | Flush | Relieved | Flush |
| Basis Weight (lbs/ream) | 17.4 | 17.4 | 9.3 | 9.4 |
| Caliper (mils/8 sht) | 61.0 | 57.5 | 32.8 | 31.5 |
| Spedific Caliper (mils/8 sheets/lb basis weight) | 3.51 | 3.30 | 3.53 | 3.35 |
| MD Tensile (grams/3") | 952 | 968 | 524 | 573 |
| CD Tensile (grams/3") | 446 | 482 | 223 | 271 |
| MD Stretch (%) | 30.3 | 29.8 | 16.4 | 18.2 |
| CD Stretch (%) | 6.6 | 6.2 | 6.7 | 7.7 |

For the single-ply-weight product only, an attempt was also made to produce tissue using a blade that had been dressed such that the protrusions were completely removed and the back (Yankee) side of the blade was beveled at an angle equal to that of the blade wear angle when it contacts the Yankee dryer (reversed relieved dressing, FIG. 6C). This blade, prior to dressing, was a 25° beveled blade and had been knurled at a frequency of 20 notches/inch and a notch depth of 0.020 inch.

Attempts to manufacture a single-ply base sheet using this blade were not successful, and the sheet had numerous holes that prevented it from being wound.

Single-ply base sheets made using the relieved and flush dressed blades from the above trial were embossed using a spot emboss pattern at an emboss depth of 0.075". Embossed product was produced both from base sheets made using the relief dressed blade of the present invention and from sheets that had been made using the blade that had been flush dressed. The physical properties for these two finished products are shown in Table 21. The similar values for the physical properties of both of the rolls indicate that the mode of blade dressing did not significantly affect the embossed product quality.

TABLE 21

| Undulatory Creping blade Study - Embossed Product | | |
|---|---|---|
| Product | Single-Ply Weight | |
| Furnish | 52% NHWK; 28% NSWK; 20% Broke | |
| Emboss Depth (inches) | 0.075 | |
| Blade Dressing | Relieved | Flush |
| Basis Weight (lbs/ream) | 16.54 | 17.21 |
| Caliper (mils/8 sht) | 67.3 | 67.8 |
| Specific Caliper (mils/8 sheets/lb basis weight) | 4.07 | 3.94 |
| MD Tensile (grams/3") | 777 | 832 |
| CD Tensile (grams/3") | 330 | 353 |
| MD Stretch (%) | 22.2 | 21.7 |
| CD Stretch (%) | 6.5 | 6.1 |
| Tensile Modulus (gr/in/%) | 11.8 | 12.5 |
| Function Deviation | 0.204 | 0.198 |

EXAMPLE 25

The Example illustrates the preferred knurling procedure for construction of blades of the present invention having the following characteristics:

width "δ": of crescent shaped region 0.008–0.025";

depth "λ": 0.008–0.050";

span "σ": 0.01–0.095";

low linear elongated regions of width "ϵ": 0.005–0.012"; and length "l": 0.002–0.084".

For the knurling tool itself, as illustrated schematically in FIG. 53, we prefer steel containing about 5% cobalt and hardened to hardness $R_c$ of about 65–67, although less expensive alloys are also suitable, for example, alloys having $R_c$ of 63–65. We note that the blades usually have a hardness $R_c$ of around 42. As starting material, a standard blade may be used.

The knurling tool is rotatably supported in a clevis so that the tool can spin about a horizontal axis and is fixed in position above the upper surface of the blade, which is comprised of a steel commonly used for creping blades (e.g., 1075 steel having a 15° bevel). Heavy pieces of steel are secured around the blade to prevent the body blade from being deformed by the forces necessary to knurl the cutting edge of the blade and form the notches by displacing metal. Care should be taken that the blade is supported well both laterally and vertically as the forces required for knurling can easily ruin an unsupported blade.

With the knurling tool supported solidly, the blade is brought into contact with the knurling tool. To begin the knurling process, the blade is put in motion longitudinally with respect to the knurling tool. The blade is slowly raised by a distance equal to the desired notch depth, easing the knurl tool into the blade over about 1" of longitudinal travel of the blade.

Once the knurling tool is into the blade the desired depth, the blade is moved with respect to the knurling tool at a moderate speed (e.g., 12 inches per minute table speed). At the end of the travel, the direction of movement of the blade is reversed and the knurl is brought back to approximately its starting position. At this point the blade is separated away from the knurling tool and is un-clamped. The above described process can be used over the entire blade length or repeated in a piecemeal fashion until the blade is knurled along its entire length. The knurling process increased the microhardness near the base of the notch by about 3–6 points on the Rockwell 'C' scale.

Figure 54B:
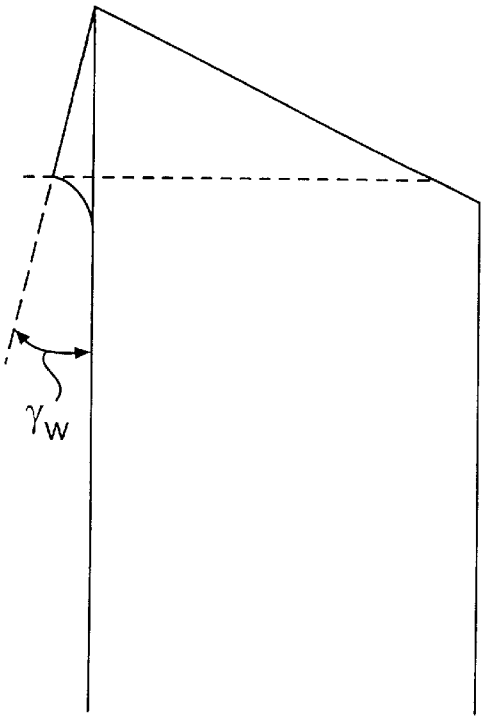
Figure 54A:
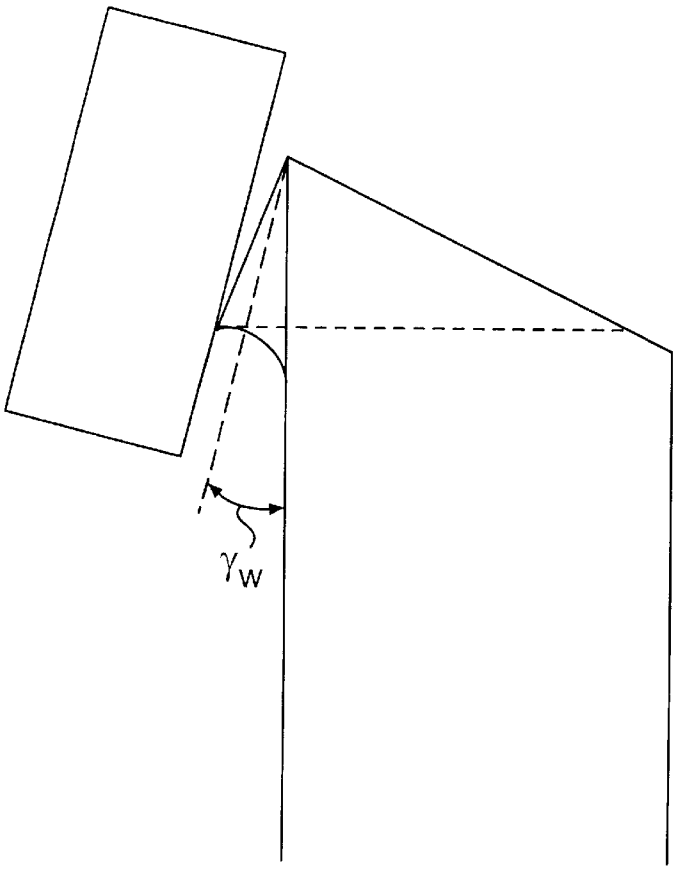

The blade may be finished according to the following procedure:

The blade is set up in a blade dressing holder and a coarse, hard hand stone is used to take off the bulk of the burr on the high side (or Yankee side) of the bevel. The stone is held against the burr at the same angle the blade makes with the dryer. A small piece of metal of appropriate thickness may be laid along the blade as a guide to help maintain the correct stone angle and ensure that a foot having the proper height remains on the relief side of the blade. Once the bulk of the burr has been removed, the final finish is applied by hand polishing. Conveniently, a small block wrapped with 120 grit emery cloth may be used for the initial polish, while 180 grit is used for the final polish. When using the 180 grit cloth, only enough metal is removed to produce a surface having the shape shown in FIG. 54B and to maintain the requisite angle.

EXAMPLE 26

This example compares a two-ply towel product made from base sheets creped using the creping blade of the present invention to a product made from base sheets made using a conventional creping blade. Towel base sheets were made on a crescent-former paper machine. The towels' furnish was composed of 70% Southern Hardwood Kraft and 30% Southern Softwood Kraft. Base sheets were made using both a conventional (square) creping blade and an undulatory creping blade. The control sheet that was made using the square blade had 8 lbs of wet-strength resin Kymene® 557H per ton of pulp added to the furnish. The towel base sheet made using the undulatory creping blade had wet-strength resin Kymene® 557H added to the sheet at a level of 12 lbs/ton of pulp. The blade employed to crepe the product had a 25 degree bevel, a 16 notches/inch notch frequency, and a notch depth of 0.020 inch. The physical properties of the base sheets are shown in Table 22.

The base sheets were embossed to provide finished two-ply towel products. The emboss depth for the control product was 0.090 inch, while the base sheets produced using the creping blade were embossed at a depth of 0.098 inch. The emboss depths were chosen so that both products would have approximately equal cross directional wet tensile strength. Embossing in this fashion negated the benefits of undulation. The properties of the embossed products are also shown in Table 22.

TABLE 22

Physical Properties of Towel Base Sheet and Embossed Towel Products

| | Base Sheet | | Embossed Product | |
|---|---|---|---|---|
| | Creping blade Type | | | |
| | Control | Undulatory | Control | Undulatory |
| Basis weight (lb/ream) | 16.5 | 17.0 | 31.8 | 31.3 |
| Caliper (mil/8 sheet) | 52.4 | 82.1 | 168 | 168 |
| Specific Caliper (mils/8 sheets/lb basis weight) | 3.18 | 4.83 | 5.28 | 5.37 |
| MD Dry Tensile (gr/3") | 1893 | 1931 | 2850 | 2581 |
| CD Dry Tensile (gr/3") | 1390 | 1452 | 1406 | 1408 |
| MD Wet Tensile (gr/3") | 589 | 658 | 803 | 756 |
| CD Wet Tensile (gr/3") | 335 | 356 | 380 | 399 |
| Absorbency (gr/sq. meter) | — | — | 292 | 322 |
| MD Stretch (%) | 16.2 | 22.2 | 15.5 | 13.0 |
| CD Stretch (%) | 4.1 | 6.6 | 5.7 | 6.9 |
| Tensile Modulus (gram/inch/%) | — | — | 55.1 | 50.5 |
| Friction Deviation | — | — | 0.306 | 0.337 |

The control and blade of the present invention products were placed in Monadic Home Use Tests. The consumers testing these various towels products were asked to rate the product for their overall performance and to rate the product for specific attributes. The products could be rated as "Excellent", "Very Good", "Good", "Fair", or "Poor". The sum of the percentage of consumers that rated a product as either "Excellent" or "Very Good" are shown in Table 23 for the control product and for the product made using the undulatory creping blade. The results indicate that the two products were preferred about equally both for overall performance and for most important attributes.

TABLE 23

Monadic Home-Use-Test Results Percentage of Consumers Rating a Product Excellent or Very Good

| | Creping blade Type | |
|---|---|---|
| | Control | Undulatory |
| Overall rating | 73 | 74 |
| Absorbing quickly | 75 | 77 |
| Absorbing a lot | 82 | 79 |
| Not tearing or falling apart when wet | 80 | 75 |
| Strength | 79 | 79 |
| Softness | 60 | 62 |
| Thickness | 77 | 80 |
| Not leaving lint | 72 | 69 |

It will be apparent to those skilled in the art that various modifications and variations can be made to the structure and methodology of the present invention without departing from the scope or spirit of the invention. Thus, it should be understood that the invention is not limited to the examples discussed in the specification. Rather, the present invention is intended to cover modifications and variations of this invention, provided they fall within the scope of the following claims and their equivalents.

What is claimed is:

1. A creping blade for creping a cellulosic web from a rotatable cylinder in a creping process, the creping blade comprising:

first and second side faces, said first side face being at least substantially opposite to said second side face;

an upper surface adjacent to said first and second side faces;

a plurality of notches spaced along the upper surface, each of the notches having a bottom portion and an open end defined by at least a portion of the upper surface, the notches being configured to increase the caliper of the cellulosic web when the creping blade crepes the cellulosic web from an outer surface of the rotatable cylinder; and an engagement surface adjacent to the upper surface and one of said first and second side faces, the engagement surface being dressed such that an angle between the engagement surface and the adjacent side face is approximately equal to a wear angle of the creping blade when the creping blade is positioned on an outer surface of a rotatable cylinder, wherein a perpendicular distance between a lower portion of the engagement surface and an upper edge of the upper surface is at least as large as a perpendicular distance between the bottom portion of each of the notches and the upper edge, and wherein the engagement surface forms a substantially continuous line of contact with the outer surface of the rotatable cylinder when the creping blade is positioned on the outer surface, thereby obviating the need for substantial running in of the creping blade.

2. The creping blade of claim 1, wherein the upper surface is not perpendicular to at least one of said first and second side faces.

3. The creping blade of claim 1, wherein the perpendicular distance between the lower portion of the engagement surface and the upper edge of the upper surface is larger than the perpendicular distance between the bottom portion of each of the notches and the upper edge.

4. The creping blade of claim 1, further comprising a plurality of protrusions adjacent to the notches and extending from the adjacent side face, each of the protrusions including an engagement portion defining at least a part of the engagement surface.

5. The creping blade of claim 4, wherein the notches and protrusions are formed by displacing material from the creping blade.

6. The creping blade of claim 4, wherein the plurality of protrusions are spaced apart from one another.

7. The creping blade of claim 5, wherein the engagement portion of each protrusion extends from an edge on the bottom portion of a respective notch, the edge intersecting an imaginary plane including the adjacent side face.

8. The creping blade of claim 7, further comprising rectilinear regions between the protrusions, the rectilinear regions being formed when the engagement surface is dressed.

9. The creping blade of claim 8, wherein outer faces of the rectilinear regions form a portion of the engagement surface.

10. The creping blade of claim 2, wherein the upper surface is beveled at an angle ranging from approximately 0° to approximately 50° with respect to a plane perpendicular to the adjacent side face.

11. The creping blade of claim 1, wherein a frequency of the notches ranges from approximately 5 notches per inch to approximately 50 notches per inch.

12. The creping blade of claim 1, wherein the notches are serrulate shaped.

13. A system for creping a cellulosic web, the system comprising:

a rotatable cylinder; and the creping blade of claim 1, the creping blade being positioned with respect to the cylinder so that the creping blade is capable of creping the cellulosic web from an outer surface of the cylinder when the web is on the outer surface and the cylinder is rotated.

* * * * *